US005122444A

United States Patent [19]

Sakai

[11] Patent Number: 5,122,444

[45] Date of Patent: Jun. 16, 1992

[54] SILVER HALIDE COLOR PHOTOGRAPHIC MATERIAL CONTAINING A MAGENTA COUPLERS AND COLOR FADING PREVENTING AGENT

[75] Inventor: Nobuo Sakai, Kanagawa, Japan

[73] Assignee: Fuji Photo Film Co., Ltd., Kanagawa, Japan

[21] Appl. No.: 393,747

[22] Filed: Aug. 15, 1989

[30] Foreign Application Priority Data

Aug. 15, 1988 [JP] Japan ..... 63-203025
Apr. 26, 1989 [JP] Japan ..... 1-107011

[51] Int. Cl.[5] ..... G03C 1/34; G03C 7/38

[52] U.S. Cl. ..... 430/505; 430/551; 430/558

[58] Field of Search ..... 430/558, 551, 503, 505

[56] References Cited

U.S. PATENT DOCUMENTS

| | | | |
|---|---|---|---|
| 3,700,455 | 10/1972 | Ishikawa et al. | 430/554 |
| 4,675,275 | 6/1987 | Nishijima et al. | 430/551 |
| 4,748,100 | 5/1988 | Umemoto et al. | 430/558 |
| 4,895,793 | 1/1990 | Seto et al. | 430/548 |

FOREIGN PATENT DOCUMENTS

| | | | |
|---|---|---|---|
| 0167762 | 1/1986 | European Pat. Off. | 430/551 |
| 207794 | 1/1987 | European Pat. Off. . | |
| 2135788 | 9/1984 | United Kingdom | 430/551 |

OTHER PUBLICATIONS

Patent Abstracts of Japan, vol. 11, No. 203 (P-591)(2660), Jul. 2, 1987.

*Primary Examiner*—Lee C. Wright
*Attorney, Agent, or Firm*—Sughrue, Mion, Zinn, Macpeak & Seas

[57] ABSTRACT

A silver halide color photographic material comprised of a support having thereon at least three kinds of silver halide emulsion layers each sensitive to radiation each having a different spectral region; at least one of said silver halide emulsion layer containing the combination of a coupler represented by formula (I), a compound represented by formula (II) and a compound represented by formula (III), and the amount of the compound represented by formula (III) being not more than 30 mol % based on the amount of the coupler represented by formula (I) or the amount of the compound represented by formula (III) being more than 30 mol % based on the amount of the coupler represented by formula (I), excluding the compounds represented by formula (III) where both substituent groups at the ortho-positions against the hydroxyl group are tert-alkyl group:

(I)

wherein the compound is as defined in the specification;

(II)

wherein the compound is as defined in the specification;

(III)

wherein the compound is as defined in the specification. The color photographic material provides excellent resistance to light fading and staining of white areas, particularly with respect to the magenta dye image.

16 Claims, No Drawings

SILVER HALIDE COLOR PHOTOGRAPHIC MATERIAL CONTAINING A MAGENTA COUPLERS AND COLOR FADING PREVENTING AGENT

FIELD OF THE INVENTION

This invention relates to a silver halide color photographic material and more particularly to a silver halide color photographic material which is excellent in spectral absorption characteristics, gives a dye image having improved fastness to light and has greatly improved resistance to the staining of white area caused by light irradiation and heat and moisture during storage.

BACKGROUND OF THE INVENTION

Silver halide color photographic materials have a multi-layer structure in which a sensitive emulsion layer containing three silver halide emulsion layers is coated on a support. The three silver halide emulsion layers selectively sensitized so that one is sensitive to red light, another is sensitive to green light and is sensitive to blue light. For example, color photographic paper (hereinafter referred to as color paper) has a red-sensitive emulsion layer, a green-sensitive emulsion layer and a blue-sensitive emulsion layer coated generally in order from the outermost layer. Further, intermediate layers such as a color mixing inhibiting layer, an ultraviolet absorbing layer and a protective layer are interposed between the sensitive emulsion layers. Color positive films have a green-sensitive emulsion layer, a red-sensitive emulsion layer and a blue-sensitive layer coated in order from the outermost layer. Color negative films have various layer arrangements. Generally, a blue-sensitive emulsion layer, a green-sensitive emulsion layer and a red-sensitive emulsion in order from the outermost layer are coated. In photographic materials having two or more emulsion layers which have the same color-sensitivity, but are different in sensitivity, however, an emulsion layer having a different color-sensitivity is sometimes arranged between the emulsion layers. A bleachable yellow filter layer or, an intermediate layer, are optionally interposed therebetween and a protective layer is provided as the outermost layer.

In order to form color photographic images, photographic couplers capable of forming three colors of yellow, magenta and cyan are incorporated in the sensitive emulsion layers, and the exposed photographic material is processed with a color developing agent.

The colors formed are desirably clear yellow, magenta and cyan dyes which scarcely cause secondary absorption, in order to form a color photographic image with good color reproducibility.

Dyes formed from 5-pyrazolone magenta couplers widely used to form magenta dyes have a main absorption at about 550 nm and a secondary absorption at about 430 nm, and efforts have been made to solve this problem.

Pyrazoloazole magenta couplers are proposed in U.S. Pat. Nos. 3,061,432, 4,540,654, 4,621,046 and 4,500,630, JP-B-47-27411 (the term "JP-B" as used herein means an "examined Japanese patent publication"), JP-A-60-33552 (the term "JP-A" as used herein means an "unexamined published Japanese patent application"), JP-A-60-43659 and Research Disclosure No. 24626.

Further, it is required that the color photographic image formed is well-preserved under various conditions. The image should undergo neither discoloration nor fading even when exposed to light over a long period of time or preserved under high temperature and humidity conditions.

However, magenta couplers have serious problems, in that undeveloped areas cause yellow-staining by light, heat and moisture, and color image are faded by light as compared with yellow couplers and cyan couplers.

The present inventors have proposed spiro-indane compounds described in JP-A-59-118414, phenolic compounds and phenol ether compounds described in U.S. Pat. Nos. 4,588,679, and 4,735,893 and JP-A-61-282845, metal chelate compounds described in U.S. Pat. No. 4,590,153, silyl ether compounds described in U.S. Pat. No. 4,559,297 and hydroxychroman compounds described in JP-A-61-177454 to improve the light resistance of the phyrazoloazole magenta couplers. While these improvements in light resistance have been significant, it is considered that further improvement is necessary.

In particular, the degree of improvement in loss of density in the region of low density is poor as compared with the improvement in loss of density in the region of high density, affecting the color balance among yellow, magenta and cyan colors as the residual dye image is changed. Thus current materials are not considered to be fully satisfying with respect to density change.

Further, JP-A-61-5936, JP-A-61-158329, JP-A-61-158333, JP-A-62-81639, JP-A-62-85247 and JP-A-62-98352 are known as publications correlated to magenta couplers and others.

The present inventors have made studies to further improve the light resistance of the dye image formed from these couplers excellent in spectral absorption characteristics and having good color reproducibility. As a result, the present inventors have found that light resistance can be greatly improved when two specific compounds are used as anti-fading agents.

SUMMARY OF THE INVENTION

A silver halide color photographic material composed of a support having thereon at least three kinds of silver halide emulsion layers each sensitive to radiation each having a different spectral region; at least one of said silver halide emulsion layer containing the combination of a coupler represented by formula (I), a compound represented by formula (II) and a compound represented by formula (III):

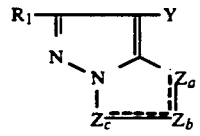

(I)

wherein $R_1$ represents hydrogen or a substituent; $Z_a$, $Z_b$ and $Z_c$ each represents methine, substituted methine, =N— or —NH—: and Y represents hydrogen or a coupling-off group; provided that $R_1$, Y or a substituted methine group represented by $Z_a$, $Z_b$ or $Z_c$ may be linked to a second coupler represented by formula (I) or a polymer;

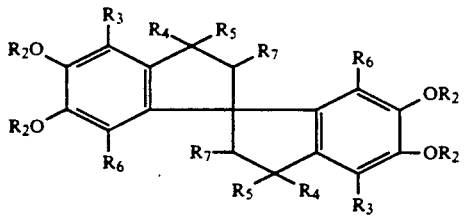

(II)

wherein $R_2$ represents an aliphatic group, an aromatic group, a heterocyclic group or a substituted silyl group represented by

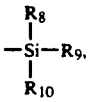

wherein $R_8$, $R_9$ and $R_{10}$, which may be the same or different, each represents an aliphatic group, an aromatic group, an aliphatic oxy group or an aromatic oxy group; $R_3$, $R_4$, $R_5$, $R_6$ and $R_7$, which may be the same or different, each represents hydrogenm, an aliphatic group, an aromatic group, an acylamino group, a monoalkylamino group, a dialkylamino group, an aliphatic thio group, an aromatic thio group, an aliphatic oxycarbonyl group, an aromatic oxycarbonyl group or an $-OR_2$ group; and

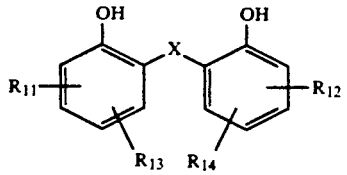

(III)

wherein $R_{11}$, $R_{12}$, $R_{13}$ and $R_{14}$, which may be the same or different, each represents an alkyl group containing from 1 to 18 carbon atoms, provided that the total number of carbon atoms contained in $R_{11}$, $R_{12}$, $R_{13}$ and $R_{14}$ is at most 32; and X represents a single bond, oxygen, sulfur, sulfonyl group, or a group represented by

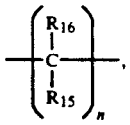

wherein $R_{15}$ and $R_{16}$, which may be the same or different, each represents hydrogen or an alkyl group containing 1 to 10 carbon atoms; n is an integer of 1 to 3, and plural $R_{15}$ and $R_{16}$ groups may be the same or different when n represents 2 or 3.

DETAILED DESCRIPTION OF THE INVENTION

The present invention is described in greater detail below.

The couplers represented by the formula (I) are five-membered ring and five-membered ring-condensed nitrogen-containing heterocyclic ring type couplers (hereinafter referred to as "5, 5N heterocyclic couplers"). The color forming matrix nucleus thereof is aromatically isoelectronic to naphthalene, and its chemical structure is generally called "azapentalene". Among the couplers of the formula (I), preferred compounds are IH-imidazo [1, 2-b] pyrazoles, IH-pyrazolo [1, 5-b] pyrazoles, IH-pyrazolo [1, 5-c] [1, 2, 4] triazoles, IH-pyrazolo [1, 5-b] [1, 2, 4] triazoles and IH-pyrazolo [1, 5-d] tetrazoles.

Typical examples of $R_1$ are the same as the groups represented by $R_{16}$ disclosed hereinafter.

The coupler represented by formula (I) may be a polymer by a reaction of the coupler moiety of formula (I) and a polymer or a copolymer which is derived from an ethylene series monomer.

The pyrazoloazole magenta couplers represented by formula (I) and methods for synthesizing them are disclosed in JP-A-59-1625485, JP-A-60-43659, JP-A-59-171956, JP-A-60-33552, JP-A-60-172982, JP-A-61-292143, JP-A-63-231341 and JP-A-63-291058 and U.S. Pat. Nos. 3,061,432 and 4,728,598.

The compounds represented by formula (II) are as follows.

An aliphatic groups represented by $R_2$ include an alkyl group such as a straight, branched or cyclic alkyl group (e.g., methyl, ethyl, propyl, isopropyl, butyl, tert-butyl, hexyl, octyl, decyl, dodecyl, hexadecyl, octadecyl, cyclohexyl, benzyl), or an alkenyl group (e.g., vinyl, allyl, oleyl, cyclohexenyl).

The aromatic groups represented by $R_2$ include, for example, a phenyl group.

The aliphatic groups or the aromatic groups represented by $R_8$ to $R_{10}$ include the same as those disclosed above.

The alkyl groups represented by $R_3$ to $R_7$ include a straight, branched or cyclic alkyl group (e.g., methyl, ethyl, hexyl, decyl, octadecyl, cyclohexyl, benzyl).. The alkenyl groups represented by $R_3$ to $R_7$ include, for example, a vinyl group, an allyl group, an oleyl group and a cyclohexenyl group. The aryl groups represented by $R_3$ to $R_7$, include, for example, a phenyl group and a naphthyl group. The acylamino groups represented by $R_3$ to $R_7$ include, for example, an acetylamino group, or propionylamino group and a benzamino group. The mono- or di-alkylamino group represented by $R_3$ to $R_7$ include, for example, an N-ethylamino group, an N,N-diethylamino group, an N,N-dihexylamino group, a piperidino group, a morpholino group, an N-cyclohexylamino group, an N-(tert-butyl) amino group.

Of the groups represented by $R_2$ to $R_7$, groups having an alkyl group, an alkenyl group or an aryl group may be further substituted by a substituent. The substituent include, for example, an alkyl group, an aryl group, an alkenyl group, an alkynyl group, an alkoxy group, an alkenoxy group, an aryloxy group, an alkylthio group, an alkenylthio group, an arylthio group, a heterocyclic group, a heterocycloxy group, a heterocyclothio group, a hydroxy group, a halogen atom, a nitro group, a cyano group, a mono- or di-alkylamino group, an acylamino group, a sulfonamido group, an imido group, a carbamoyl group, a sulfamoyl group, a ureido group, a urethane group, a sulfo group, a carboxy group, a sulfonyl group, a sulfinyl group, a silyl group, a silyloxy group, a phosphonyl group, an amino group, a phosphonyloxy group, an acyl group, an acyloxy group, a sulfonyloxy group, an ester group, etc.

Of compounds represented by formula (II), compounds wherein $R_2$ is an alkyl group, and $R_3$ and $R_6$ each are a hydrogen atom, an alkyl group, an alkoxy group or an alkylthio group are preferred.

The compounds represented by formula (II) are synthesized by a method disclosed in U.S. Pat. No. 4,360,589.

The compounds represented by formula (III) are as follows.

The alkyl group represented by $R_{11}$, $R_{12}$, $R_{13}$, and $R_{14}$ include a Straight, branched or cyclic alkyl group (e.g., methyl, ethyl, isopropyl, tert-butyl, octyl, decyl, hexadecyl, octadecyl, cyclohexyl, benzyl).

$R_{15}$ and $R_{16}$ represent a hydrogen atom or an alkyl group such as a straight, branched or cyclic alkyl group (e.g., methyl, ethyl, propyl, isopropyl, butyl, tert-butyl, octyl, decyl).

The alkyl group represented by $R_{11}$ to $R_{16}$ may be further substituted by a substituent. The substituent includes, for example, an aryl group, an alkenyl group, an alkynyl group, an alkoxy group, an alkenoxy group, an aryloxy group, an alkylthio group, an alkenylthio group, an arylthio group, a heterocyclic group, a heterocycloxy group, heterocyclothio group, a hydroxy group, a halogen atom, a nitro group, a cyano group, a mono- or di-alkylamino group, an acylamino group, a sulfonamido group, an imido group, a carbamoyl group, a sulfamoyl group, a ureido group, a urethane group, a sulfo group, a carboxy group, a sulfonyl group, a sulfinyl group, a silyl group, a silyloxy group, a phosphonyl group, an amino group, a phosphonyloxy group, an acyl group, an acyloxy group, a sulfonyloxy group, an ester group.

The compounds represented by formula (III) are prepared by a method or the same thereof which is disclosed in British Patent 788,794, West German Patent 1,965,017, J. Amer. Chem. Soc., 74, 3410 (1952), ibid. 75, 5579 (1953), etc.

The compounds represented by formulas (II) and (III) improve a light fastness at areas of low density.

These compounds are represented by the following formulas (V), (VI), (VII), (VIII) and (IX).

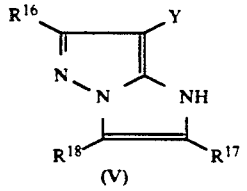

(V)

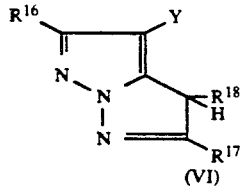

(VI)

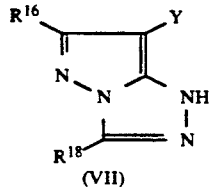

(VII)

-continued

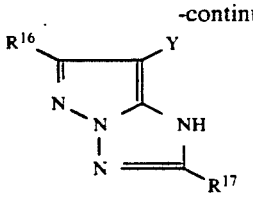

(VIII)

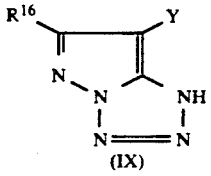

(IX)

The substituent groups of the formulas (V) to (IX) are as follows:

$R_{16}$, $R_{17}$ and $R_{18}$, which may be the same or different are each an aliphatic group, an aromatic group or a heterocyclic group. These groups may be optionally substituted by one or more groups selected from the group consisting of an alkyl group, an aryl group, a heterocyclic group, an alkoxy group (e.g., methoxy, 2-methoxy-ethoxy), an aryloxy group (e.g., 2,4-di-tertamylphenoxy, 2-chlorophenoxy, 4-cyanophenoxy), an alkenyloxy group (e.g., 2-propenyloxy), an acyl group (e.g., acetyl, benzoyl), an ester group (e.g., butoxycarbonyl, phenoxycarbonyl, acetoxy, benzoyloxy, butoxysulfonyl, toluene-sulfonyloxy), an amido group (e.g., acetylamino, methanesulfonamido, dipropylsulfamoylamino), a carbamoyl group (e.g., dimethylcarbamoyl, ethylcarbamoyl), a sulfamoyl group (e.g., butylsulfamoyl), an imido group (e.g., succinimido, hydantoinyl), a ureido group (e.g., phenylureido, dimethylureido), an aliphatic or aromatic sulfonyl group (e.g., methanesulfonyl, phenylsulfonyl), an aliphatic or aromatic thio group (e.g., ethylthio, phenylthio), hydroxyl group, cyano group, carboxyl group, nitro group, sulfo group, or a halogen atom. Further $R_{16}$, $R_{17}$ and $R_{18}$ may be RO—, $$\mathrm{RC(=O)-},\quad \mathrm{RCO(=O)-},$$

$$\mathrm{RS-},\ \mathrm{RSO-},\ \mathrm{RSO_2-},\ \mathrm{RSO_2NH-},$$

$$\mathrm{RC(=O)NH-},$$

$$\mathrm{RNH-},$$

$$\mathrm{ROC(=O)NH-},$$

hydrogen, a halogen atom, cyano group or an imido group (wherein R is an alkyl group, an aryl group or a heterocyclic group).

Furthermore, $R_{16}$, $R_{17}$ and $R_{18}$ may be a carbamoyl group, a sulfamoyl group, a ureido group or a sulfamoylamino group. The nitrogen atom of these groups may be substituted by a substituent group described above for $R_{16}$ to $R_{18}$. Among the substituent groups, preferred are an alkyl group, a branched alkyl group, an aryl group, an alkoxy group, an aryloxy group and a ureido group.

Y has the same definition as in formula (I). When Y is a group which is eliminated by a coupling reaction with the oxidation product of a developing agent (hereinafter referred to as a "coupling-off" group), the coupling-off group is a group which joins the coupling active carbon atom to an aliphatic group, an aromatic group, a heterocyclic group, an aliphatic, aromatic or heterocyclic sulfonyl group or an aliphatic, aromatic or heterocyclic carbonyl group through oxygen, nitrogen or sulfur atom, a halogen atom, or an aromatic azo group. The aliphatic, aromatic and heterocyclic groups of these coupling elimination groups may be substituted by one or more substituent groups as defined for $R_{16}$ to $R_{18}$.

Typical examples of the coupling-off groups include a halogen atom (e.g., fluorine, chlorine, bromine), an alkoxy group (e.g., ethoxy, dodecyloxy, methoxyethoxy, methoxyethylcarbamoyl, carboxypropyloxy, methylsulfonylethoxy), an aryloxy group (e.g., 4-chlorophenoxy, 4-methoxyphenoxy, 4-carboxyphenoxy), an acyloxy (e.g., acetoxy, tetradecanoyloxy, benzoyloxy), an aliphatic or aromatic sulfonyloxy group (e.g., methanesulfonyloxy, toluenesulfonyloxy), an acylamino group (e.g., dichloroacetylamino, heptafluorobutyrylamino), an aliphatic or aromatic sulfonamido group (e.g., methanesulfonamido, p-toluenesulfonamido), an alkoxycarbonyloxy group (e.g., ethoxycarbonyloxy, benzyloxycarbonyloxy), an aryloxycarbonyloxy group (e.g., phenoxycarbonyloxy), an aliphatic, aromatic or heterocyclic thio group (e.g., ethylthio, phenylthio, tetrazolyl), a carbamoylamino group (e.g., N-methylcarbamoylamino, N-phenylcarbamoylamino), a five-membered or six-membered nitrogen-containing heterocyclic group (e.g., imidazolyl, pyrazolyl, triazolyl, tetrazolyl, 1,2-dihydro-2-oxo-1-pyridyl), an imido group (e.g., succinimido, hydantoinyl) and an aromatic azo group (e.g., phenylazo). The coupling-off groups of the present invention may contain photographic useful groups, such as a restrainer, development accelerator or desilverization accelerator. Halogen atoms and the arylthio group are particularly preferred coupling-off groups.

Of couplers represented by formula (I), couplers represented by formula (V), (VII) and (VIII) are preferred, couplers represented by formula (VII) and (VIII) are more preferred and couplers of formula (VIII) is most preferred.

Further, at least one of $R_{16}$, $R_{17}$ and $R_{18}$ in the couplers of formula (V), (VII) and (VIII) is preferably a branched alkyl group.

Of compounds represented by formula (II), compounds wherein $R_2$ is an alkyl group, $R_4$ and $R_5$ are a hydrogen atom or methyl group, $R_3$, $R_6$ and $R_7$ is a hydrogen atom are preferred and further compounds wherein $R_4$ and $R_5$ are methyl group are more preferred.

Of compounds represented by formula (III), compounds wherein $R_{11}$ to $R_{14}$ each are an alkyl group, X is a group of

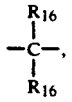

wherein $R_{15}$ is a hydrogen atom and $R_{16}$ is a hydrogen atom or an alkyl group, are more preferred.

Preferred examples of the couplers of formula (I), the compounds of formula (II) and the compounds of formula (III) include the following compounds, but the present invention is not to be construed as being limited thereto.

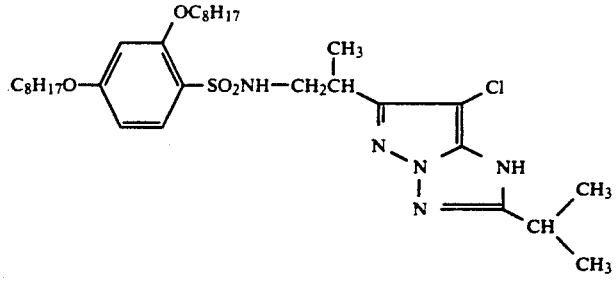

(I-1)

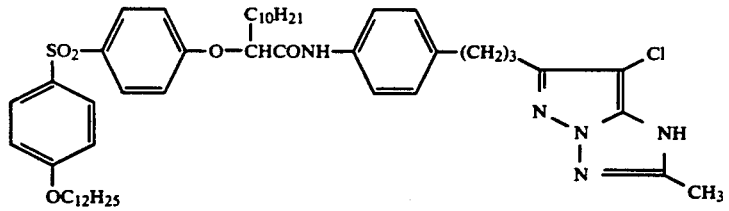

(I-2)

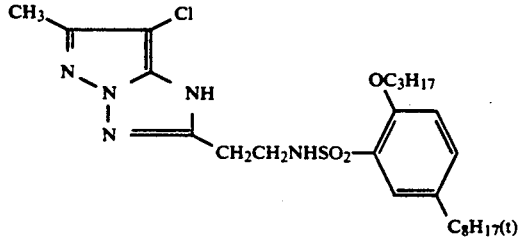

(I-3)

-continued
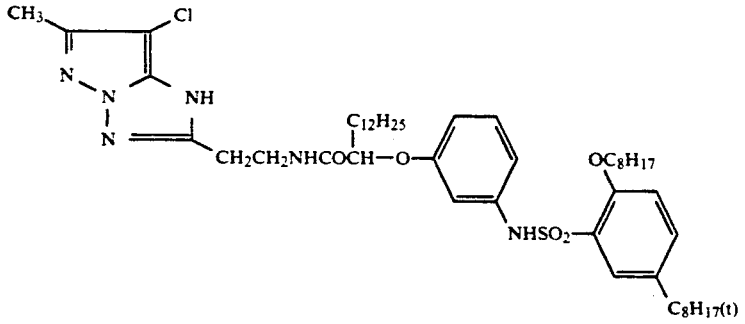
(I-4)
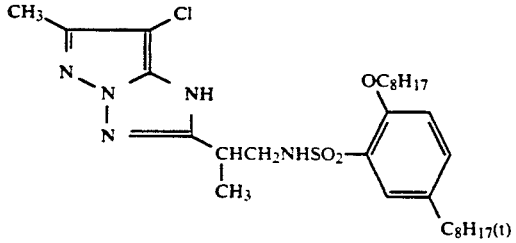
(I-5)
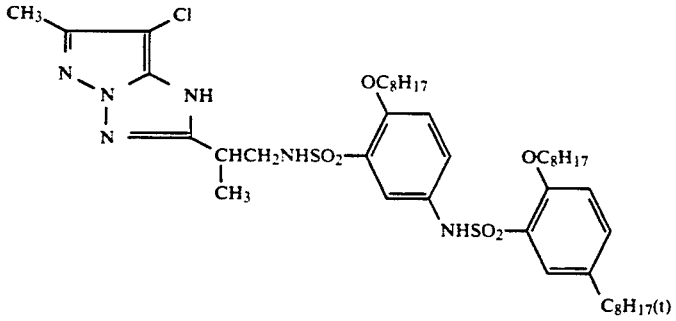
(I-6)
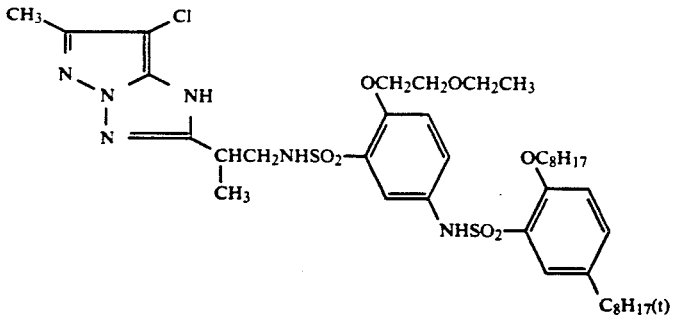
(I-7)
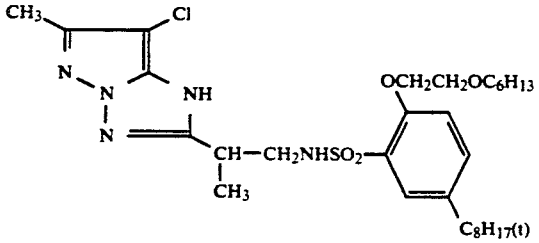
(I-8)

-continued
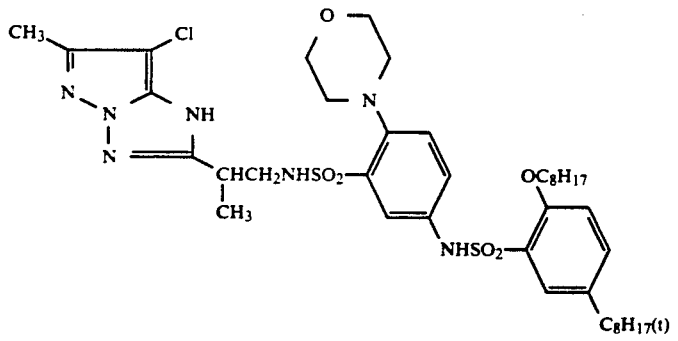
(I-9)
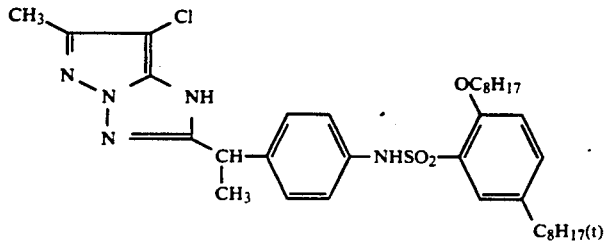
(I-10)
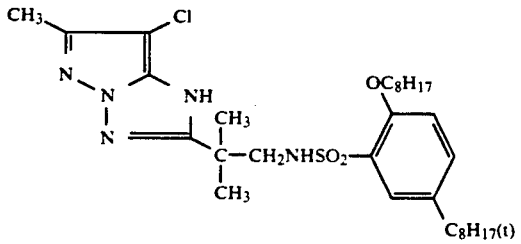
(I-11)
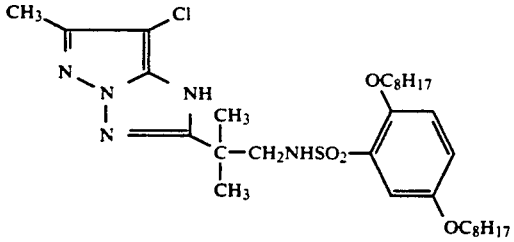
(I-12)
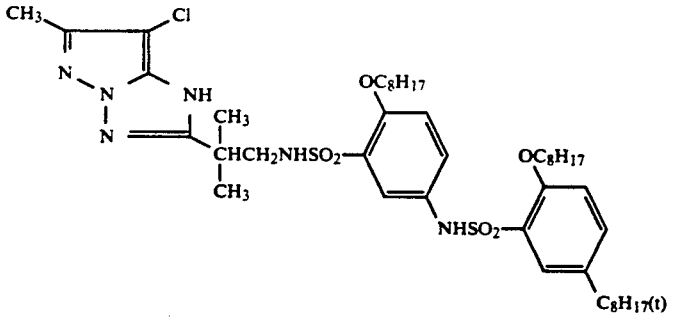
(I-13)
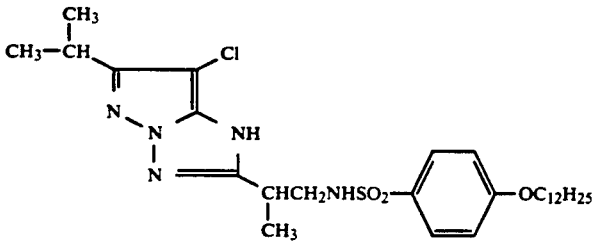
(I-14)

-continued
(I-15)
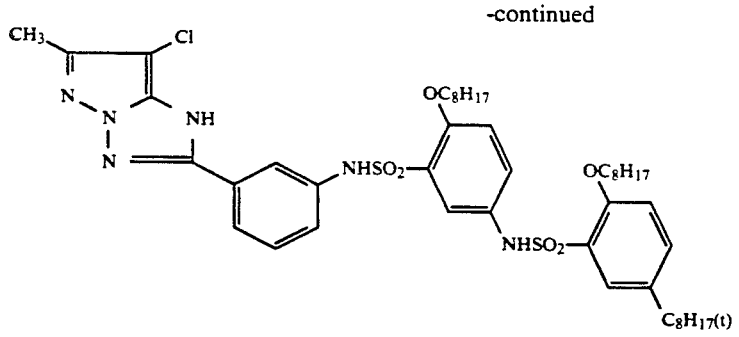
(I-16)
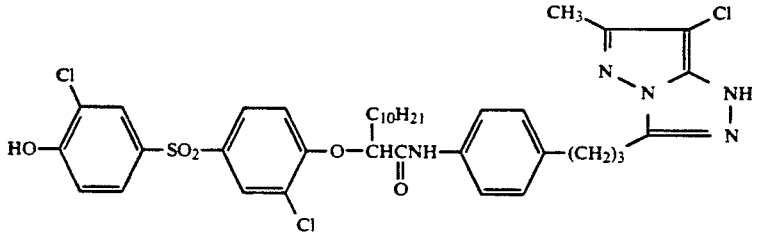
(I-17)
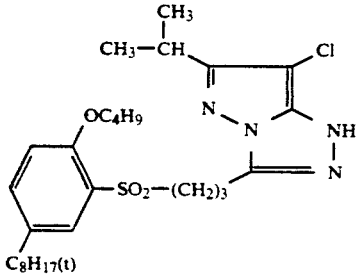
(I-18)
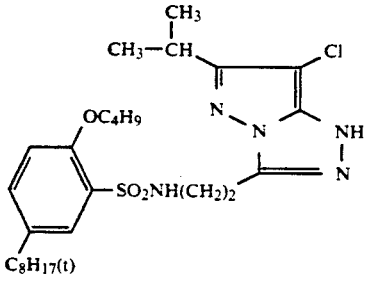
(I-19)
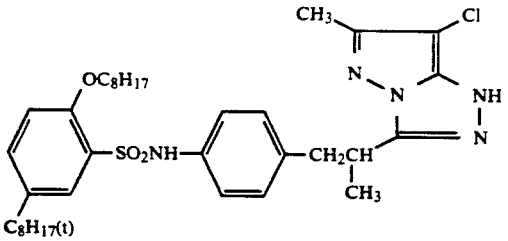
(I-20)
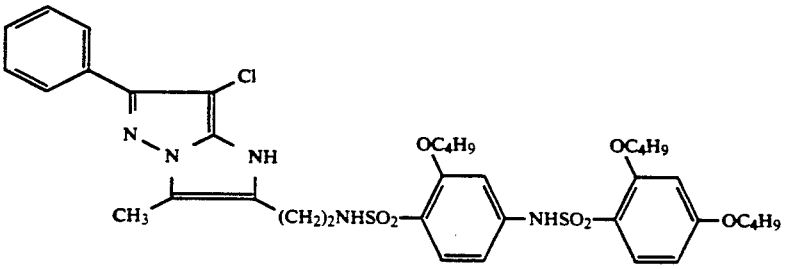

-continued
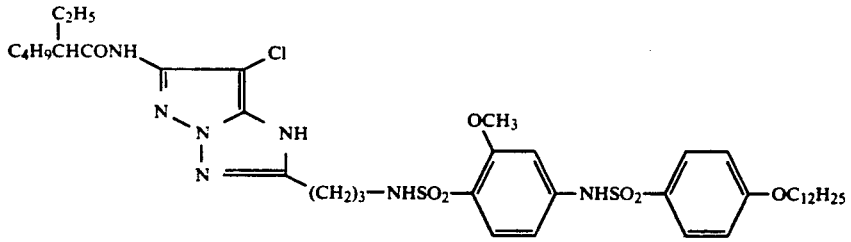
(I-21)
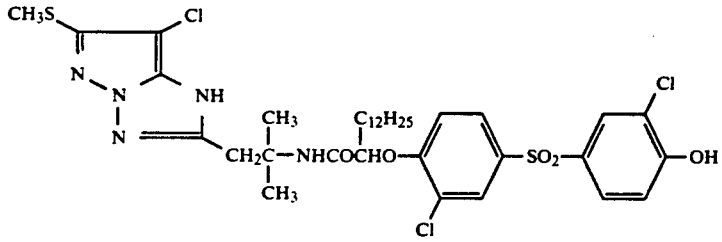
(I-22)
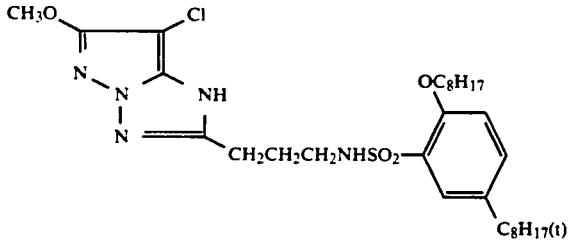
(I-23)
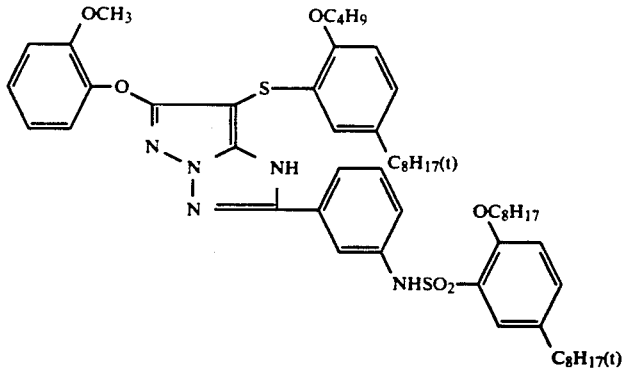
(I-24)
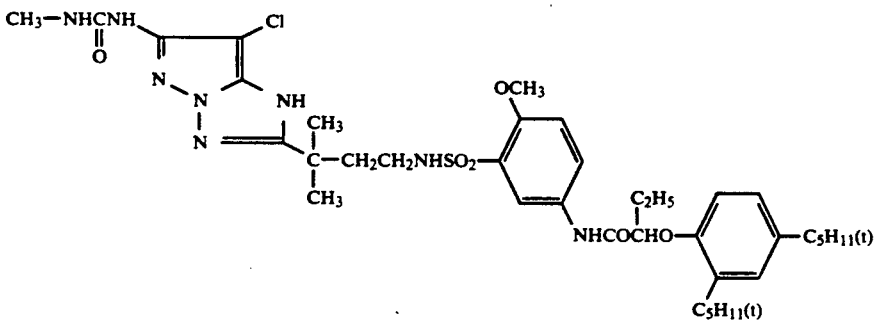
(I-25)

-continued
(I-26)
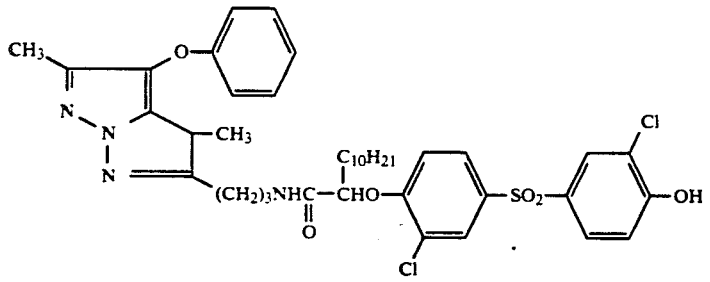
(I-27)
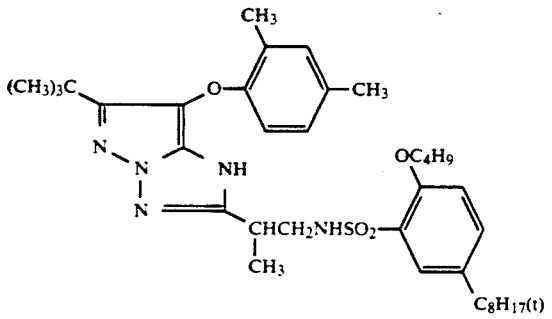
(I-28)
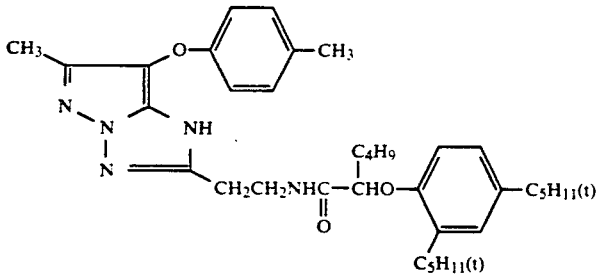
(I-29)
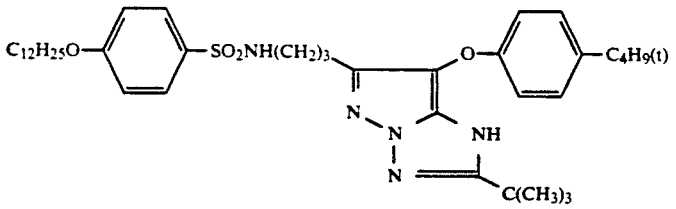
(I-30)
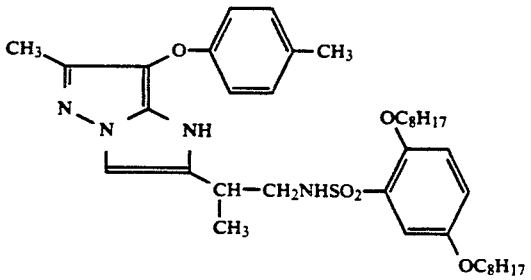

-continued
(I-31)
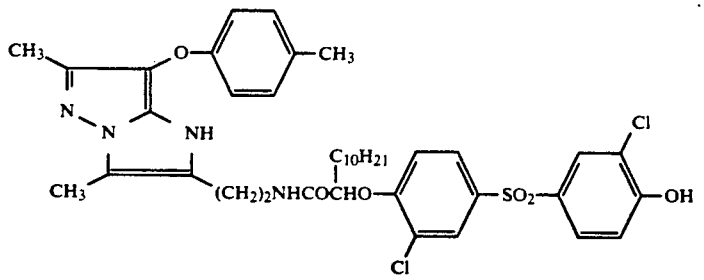
(I-32)
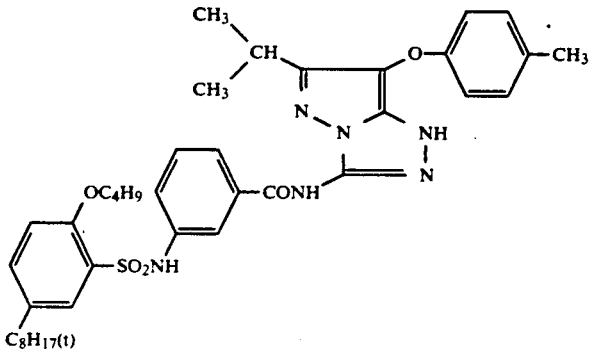
(I-33)
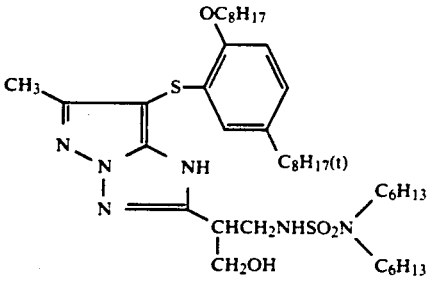
(I-34)
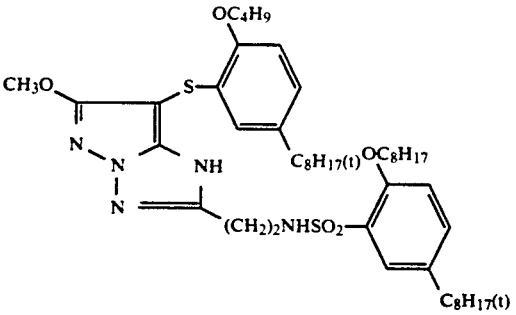
(I-35)
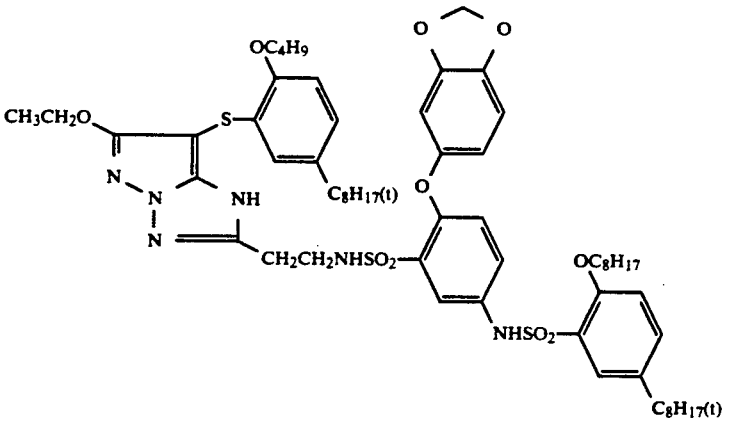

-continued
(I-36)
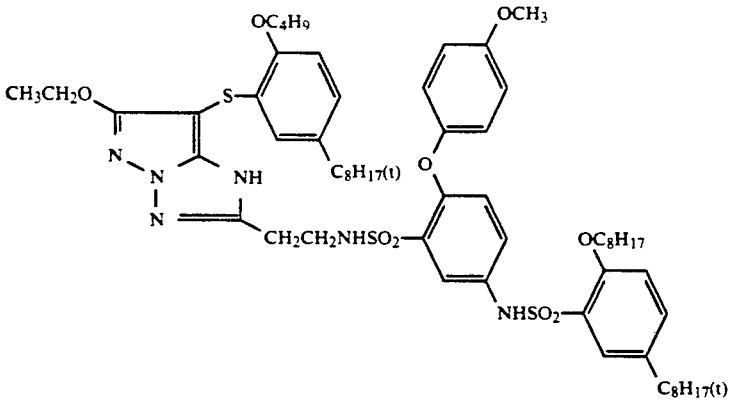
(I-37)
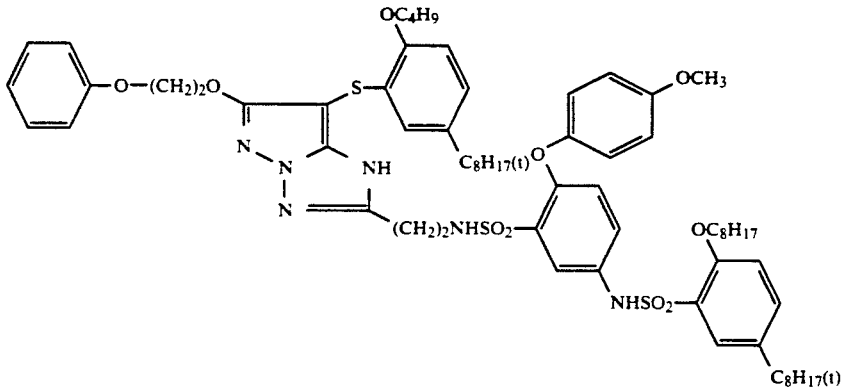
(I-38)
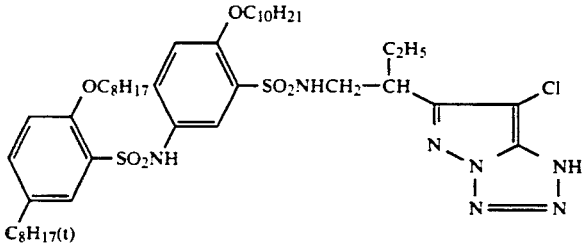
(I-39)
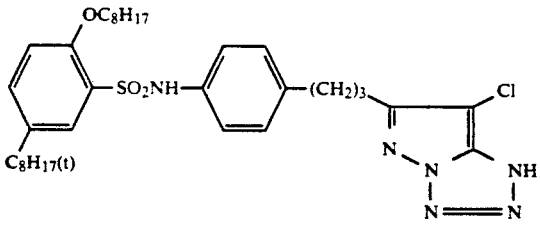
(I-40)
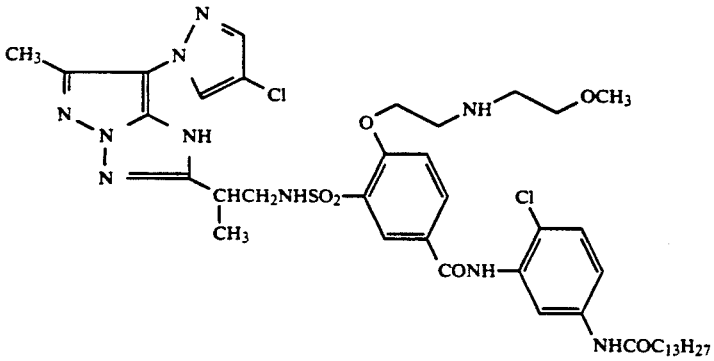

-continued
(I-41)
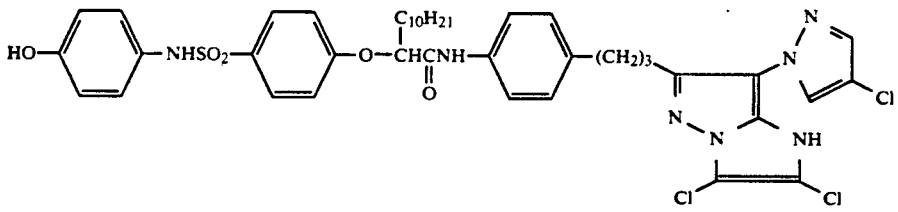
(I-42)
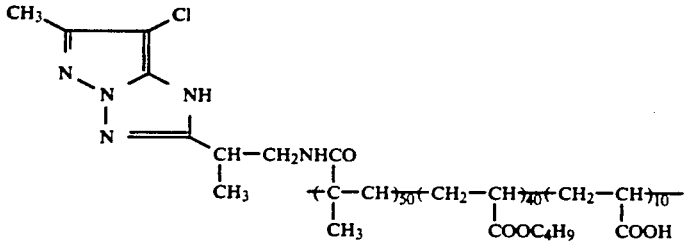
(I-43)
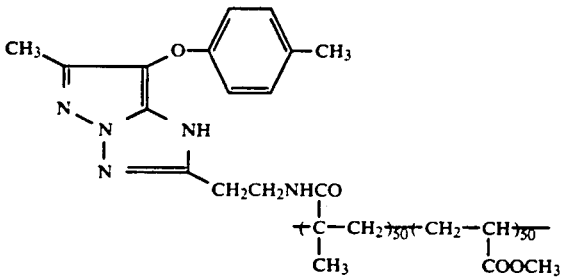
(I-44)
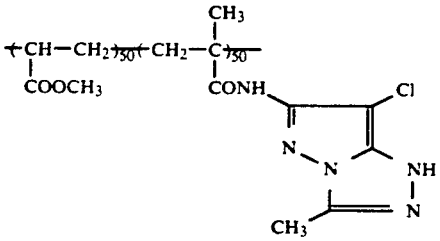
(I-45)
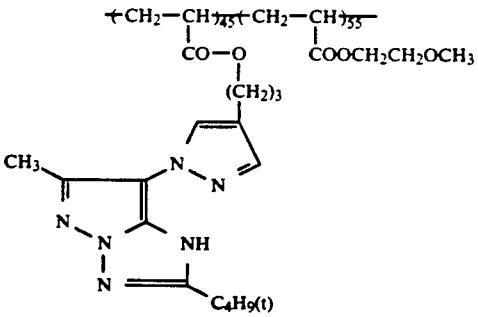
(I-46)
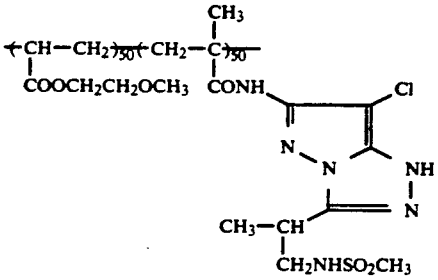

-continued
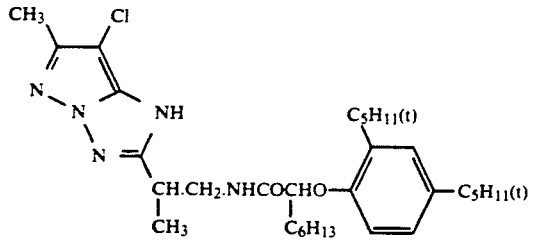
(I-47)
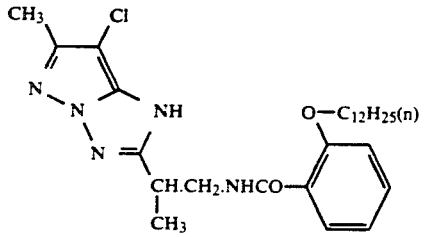
(I-48)
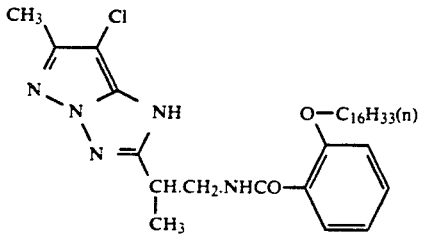
(I-49)
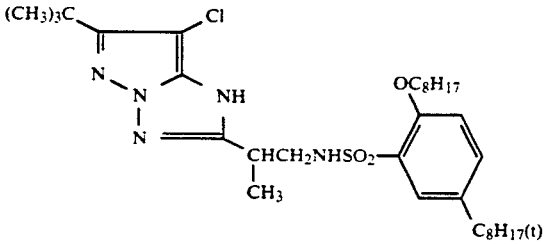
(I-50)
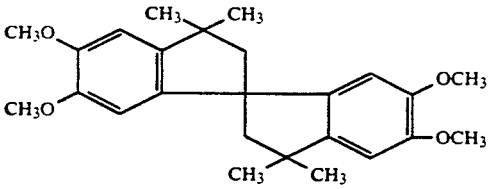
(II-1)
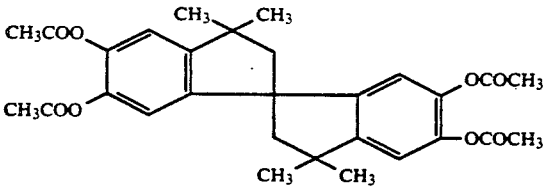
(II-2)
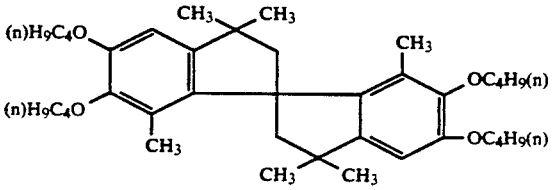
(II-3)

-continued
(II-4)
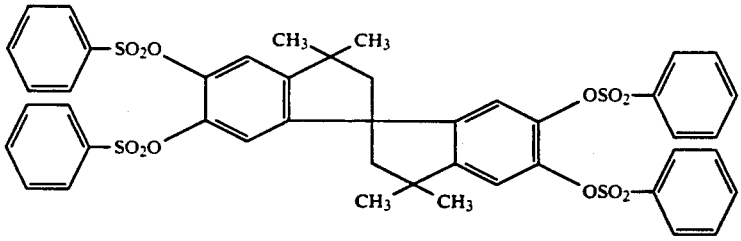
(II-5)
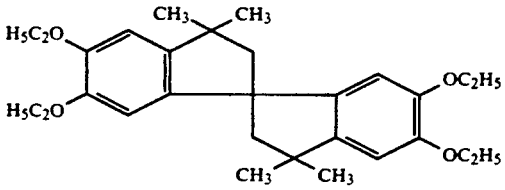
(II-6)
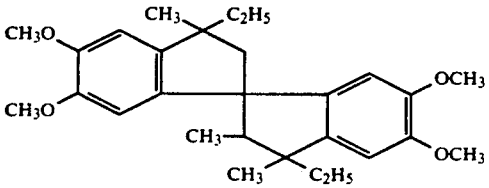
(II-7)
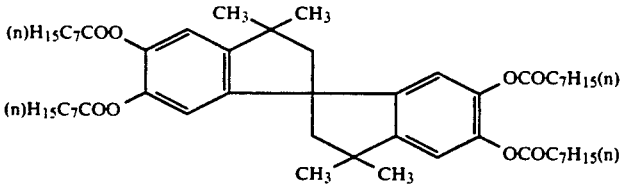
(II-8)
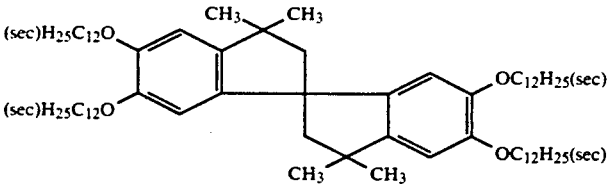
(II-9)
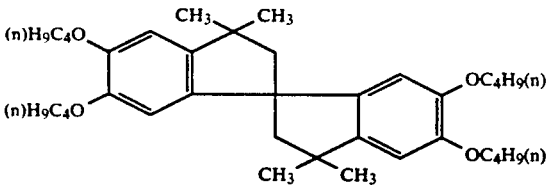
(II-10)
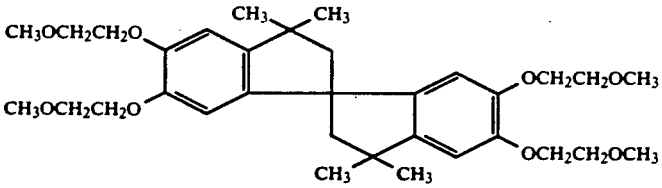
(II-11)
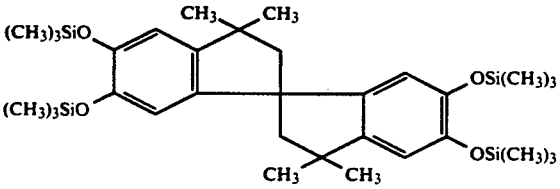

-continued
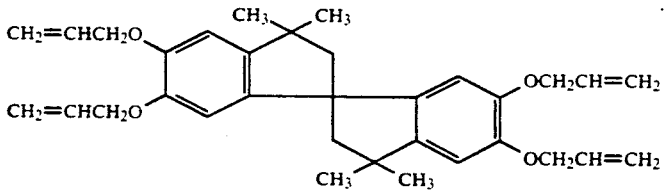
(II-12)
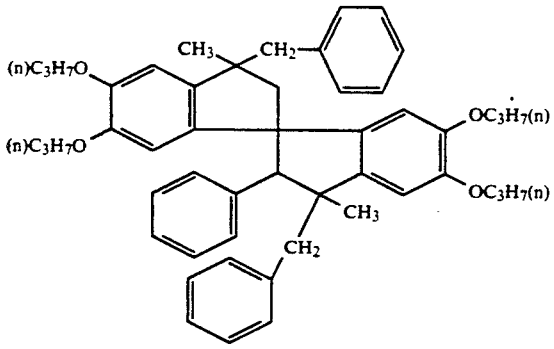
(II-13)
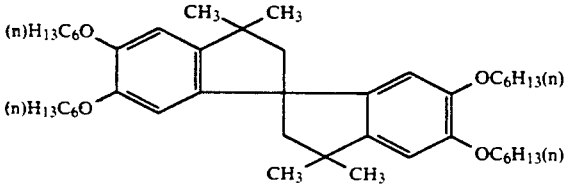
(II-14)
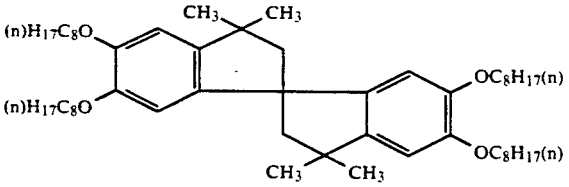
(II-15)
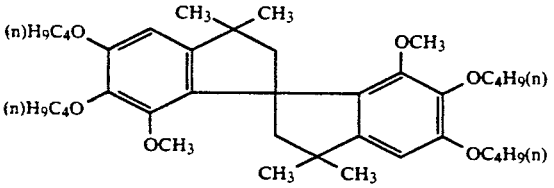
(II-16)
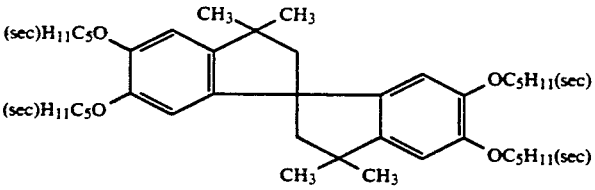
(II-17)
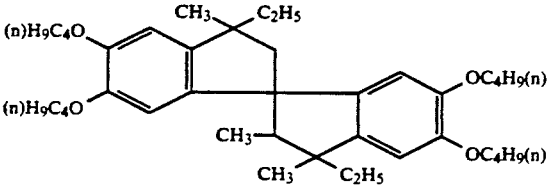
(II-18)

-continued
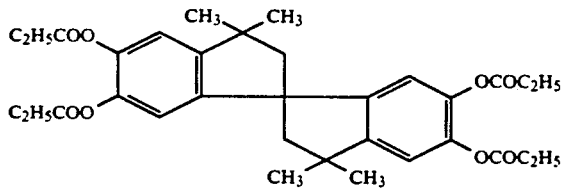
(II-19)
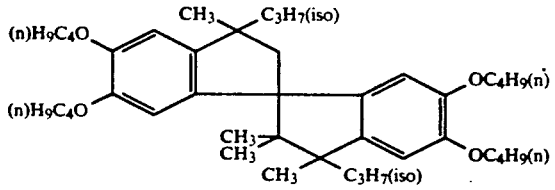
(II-20)
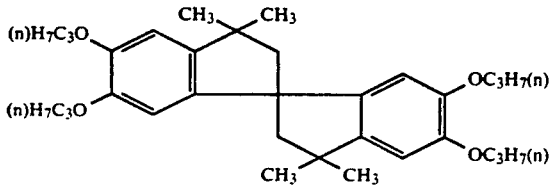
(II-21)
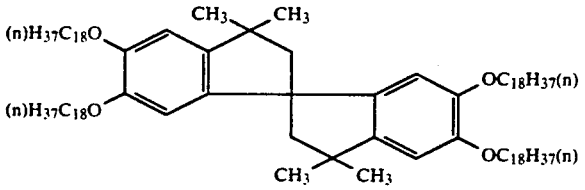
(II-22)
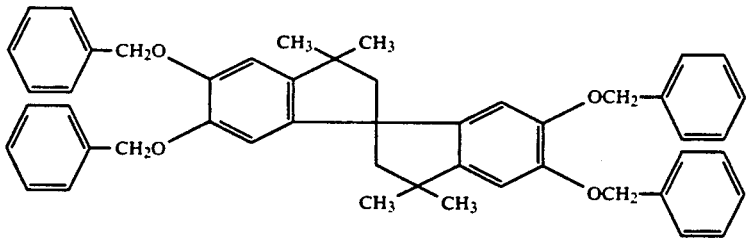
(II-23)
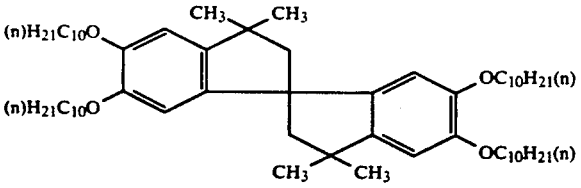
(II-24)
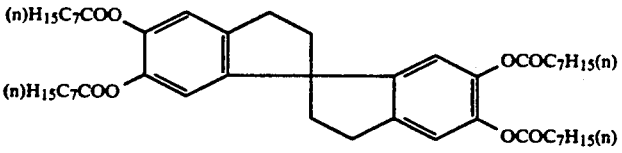
(II-25)
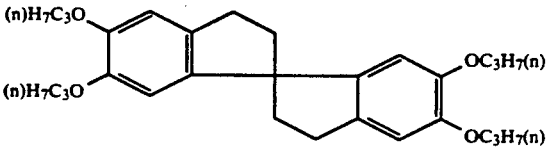
(II-26)

-continued
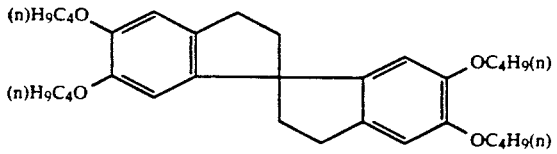
(II-27)
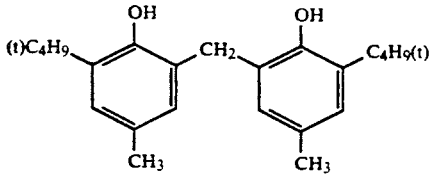
(III-1)
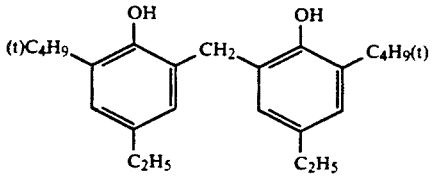
(III-2)
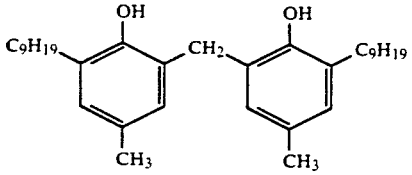
(III-3)
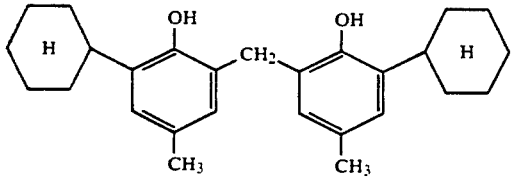
(III-4)
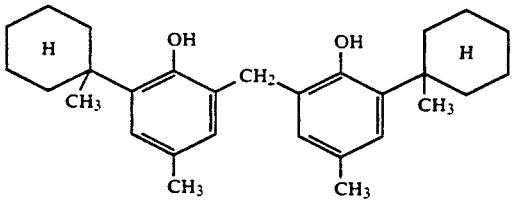
(III-5)
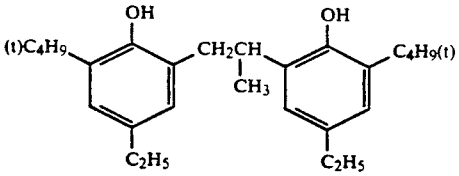
(III-6)
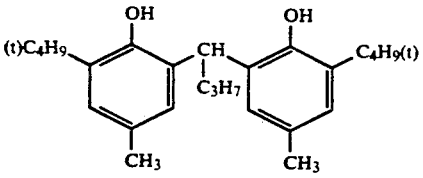
(III-7)
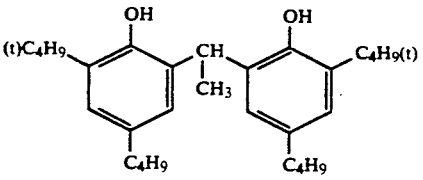
(III-8)

-continued
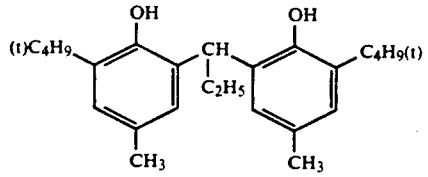
(III-9)
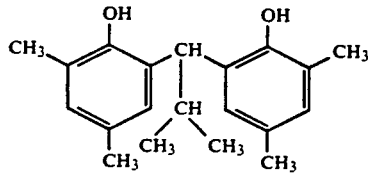
(III-10)
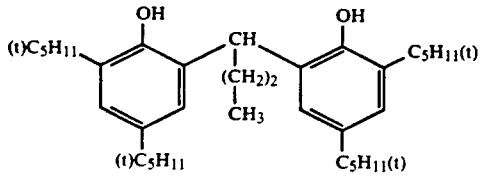
(III-11)
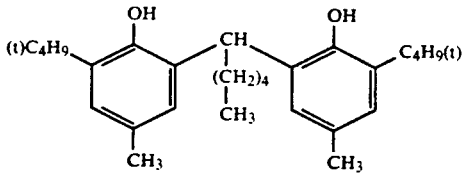
(III-12)
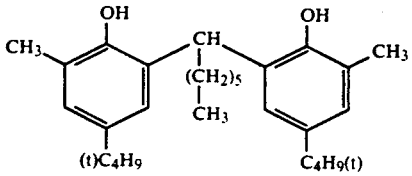
(III-13)
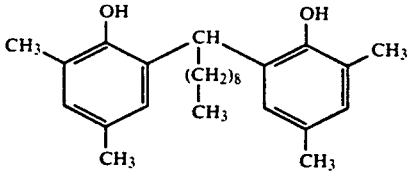
(III-14)
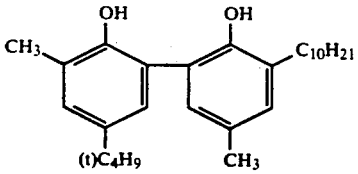
(III-15)
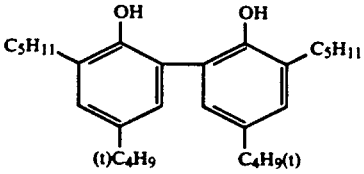
(III-16)
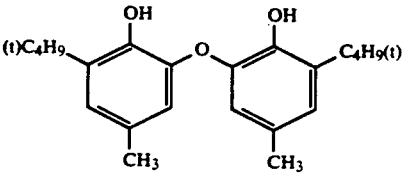
(III-17)

-continued

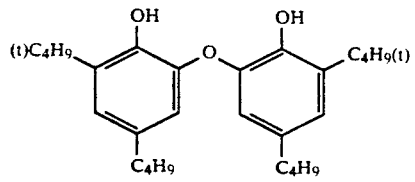

(III-18)

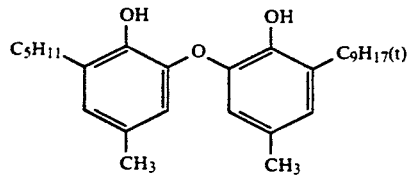

(III-19)

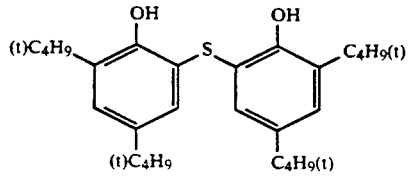

(III-20)

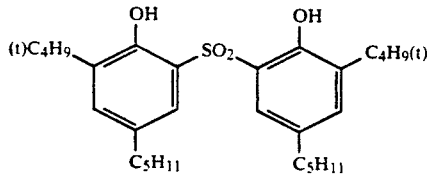

(III-21)

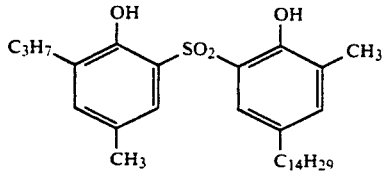

(III-22)

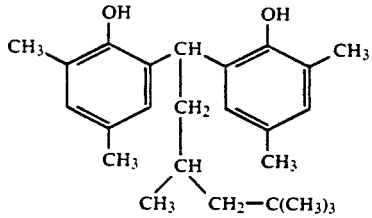

(III-23)

The couplers represented by formula (I) are used in an amount of $1\times10^{-2}$ to 1 mol, preferably $1\times10^{-1}$ to $5\times10^{-1}$ mol per mol of silver halide. If desired, the couplers of the present invention may be used together with, preferably 50 mol % or less of other magenta couplers.

The compounds represented by formula (II) are used in an amount of 10 to 500 mol %, preferably 25 to 200 mol % based on the amount of the coupler of the present invention.

The compounds represented by formula (III) are used in an amount of 1 to 200 mol % based on the amount of the coupler of the present invention. Preferably, these compounds are co-emulsified together with the magenta coupler.

The couplers and compounds represented by formulas (I), (II) and (III) are preferably incorporated in a green sensitive silver halide emulsion layer. However, the couplers and compounds may be incorporated into any light-sensitive silver halide emulsion layer as well as in the green sensitive layer, when the color light-sensitive material has an infrared sensitive layer.

The color photographic materials of the present invention have at least one blue-sensitive silver halide emulsion layer, at least one green-sensitive silver halide emulsion layer and at least one red-sensitive silver halide emulsion layer provided on a support. Generally, color photographic paper has these emulsion layers coated in the above-described order provided on a support. If desired, these emulsion layers may be coated in a different order. Further, an infrared-sensitive silver halide emulsion layer may be used in place of at least one of the emulsion layers. Color reproduction by the subtractive color process can be attained by incorporating silver halide emulsions having sensitivity to respective wavelength ranges and dyes complementary to light to be exposed, that is, color couplers (color couplers forming a yellow dye corresponding to blue light, forming a magenta dye corresponding to green light and forming a cyan dye corresponding to red light) in these sensitive emulsion layers. If desired, a structure may be used where the sensitive layers and the developed hue of the couplers do not correspond to each other as described above.

It is preferred that silver halide emulsions containing silver chloride or silver chlorobromide containing substantially no silver iodide are used in the present invention. The term "containing substantially no silver iodide" as used herein means that the content of silver iodide is not higher than 1 mol %, preferably not higher than 0.2 mol %. The emulsions may contain grains which have the same halogen composition or are different in halogen composition. When emulsions containing grains having the same halogen composition are used, the properties of each grain can be easily homogenized. Useful grain structures include uniform structure type grains where the halogen composition is uniform throughout the whole grain; laminated structure type grains where the halogen composition is different between a core in the interior the silver halide grain and a shell surrounding the core (one layer or more layers); and grain having a structure where areas having a different halogen composition exist in a non-laminar form in the interior of the grain or on the surface thereof (when the areas are on the surface of the grain, areas having different halogen compositions are joined to each other on the edge, corner or plane of grain). To impart high sensitivity, it is preferred that the latter two types rather than the uniform structure type is used. The latter two types are also preferred from the viewpoint of preventing pressure fog from being generated. When silver halide grains have the above-described structure, the boundary between the areas having a different halogen composition may be distinct or an indefinite boundary where a mixed crystal due to a difference in halogen composition is formed. Alternatively, the boundary may be continuously changed.

With regard to the halogen compositions of the silver chlorobromide emulsions, any suitable silver bromide/silver chloride ratio can be used without limitation. The ratio can be widely varied according to purpose, but a silver chloride content of at least 2 mol % is preferred.

Preferably, silver halide emulsions having a high silver chloride content, that is, high silver chloride emulsions are used in photographic materials for rapid processing. The high silver chloride emulsions have a silver chloride content of preferably at least 90 mol %, more preferably at least 95 mol %.

It is preferred that the high silver chloride emulsions a structure in which silver bromide localized layers exist in a laminar or non-laminar form in the interiors of silver halide grains and/or on the surfaces thereof. The localized phases have a halogen composition such that the silver bromide content thereof is preferably at least 10%, more preferably higher than 20 mol %. These localized layers may exist in the interiors of grains or on the edges, corners or planes of the surfaces thereof. In a preferred embodiment, the localized layers are formed on the corners of grain by epitaxial growth.

Even when high silver halide emulsions having a silver chloride content of at least 90 mol % are used, the uniform structure type grains having a narrow halogen composition distribution are preferred for the purpose of preventing sensitivity from being lowered when pressure is applied to the photographic materials.

The silver chloride content of the silver halide emulsion can be increased for the purpose of reducing the replenishment rate of developing solutions. In this case, almost pure silver halide emulsions having a silver chloride content of 98 to 100 mol % are preferred.

The silver halide grains contained in the silver halide emulsions of the present invention have a mean grain size (the diameter of a circle equal to the projected area of a grain is the grain size and the arithmetic mean of grain sizes is determined and taken as the mean grain size) of preferably 0.1 to 2 μm.

The grain size distribution of grains is such that a coefficient of variation (a value obtained by dividing the standard deviation of grain size distribution by the mean grain size) is not higher than 20%, preferably not higher than 15%. This monodisperse emulsion is preferred. Monodisperse emulsions may be blended in the same layer or coated in a multi-layer form for the purpose of obtaining wide latitude.

The silver halide grains of the present emulsions may have regular crystalline form such as cube, tetradecahedron or octahedron, irregular crystal-line form such as sphere or tube or a composite form of these crystalline forms. A mixture of grains having various crystalline forms can be used, but it is preferred that grains have a crystal form distribution such that at least 50%, preferably 70%, more preferably 90% thereof is composed of grains having regular crystalline forms.

The silver halide emulsion of the present invention may contain tabular (plate form) grains having an aspect ratio (a ratio of diameter in terms of a circle to thickness) of at least 5, preferably at least 8 account for at least 50% of the entire projected area of grains.

The silver chlorobromide emulsions of the present invention can be prepared according to the methods described in P. Glafkides, *Chimie et Phisique Photographique* (Paul Montel, 1967); G. F. Duffin, *Photograhic Emulsion Chemistry* (Focal Press, 1966); and V. L. Zelikman et al., *Making and Coating Photographic Emulsion* (Focal Press, 1964). The silver halide emulsion can be prepared by any of an acid process, neutral process or ammonia process. In the preparation thereof, a soluble silver salt and a soluble halogen salt can be reacted in accordance with single jet process, double jet process or a combination thereof. A reverse mixing method in which grains are formed in the presence of an excess silver ion concentration, can be used. There can also be used controlled double jet process in which the pAg value in a liquid phase, in which silver halide grains are formed, is kept constant. According to this process, there can be obtained a silver halide emulsion in which crystal form is regular and grain size is approximately uniform.

Various polyvalent metal impurities can be introduced into the silver halide emulsion of the present invention during the formation of grains or physical ripening. Examples of compounds used therefor include salts of cadmium, zinc, lead, copper and thallium and salts of group VIII metals such as iron, ruthenium, rhodium, palladium, osmium, iridium and platinum and complex salts thereof. The amounts of these compounds to be added widely vary according to purpose, but they are preferably used in an amount of $10^{-9}$ to $10^{-2}$ mol per mol of silver halide.

The silver halide emulsions of the present invention are generally subjected to chemical sensitization and spectral sensitization.

Examples of chemical sensitization include sulfur sensitization (wherein unstable sulfur compounds are added), noble metal sensitization (typically gold sensitization) and reduction sensitization. These sensitization methods may be used either alone or in combination of two or more of them. Preferred compounds for use in chemical sensitization are described in JP-A-62-215272 (pages 18~22).

Spectral sensitization is conducted to impart spectral sensitivity in the desired wavelength region of light to the emulsion of each layer in the photographic material of present invention. It is preferred to add dyes absorbing light in the wave region corresponding to spectral sensitivity intended in the present invention, that is, spectral sensitizing dyes. Examples of the spectral sensitizing dyes are described in, for example, F. M. Harmer, *Heterocyclic Compounds—Cyanine dyes and Related Compounds* (John Wiley & Sons, New York, London, 1964). Examples of preferred compounds are described in JP-A-62-215272 (pages 22~38).

The silver halide emulsions of the present invention may contain various compounds or precursors for the purpose of preventing the photographic materials from being fogged during the preparation or storage thereof or during the processing thereof or for the purpose of stabilizing photographic performance. Preferred examples of the compounds include those described in JP-A-62-215272 (pages 39~72).

The emulsions of the present invention may be any of surface latent image type emulsion where a latent image is predominantly formed on the surface of the grain and internal latent image type emulsion where a latent image is predominantly formed in the interior of the grain.

The color photographic materials of the present invention typically contain yellow couplers forming a yellow color, magenta couplers forming a magenta color and cyan couplers forming a cyan color, each forming a color by coupling with the oxidation product of aromatic amine developing agents.

Cyan couplers, magenta couplers and yellow couplers which can be preferably used in the present invention are compounds represented by the following general formulas (C-I), (C-II), (M-I) and (Y).

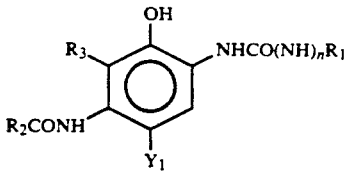

(C-I)

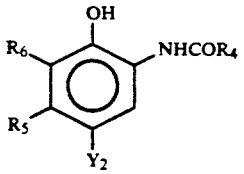

(C-II)

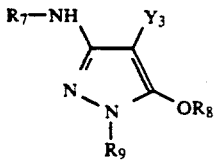

(M-I)

-continued

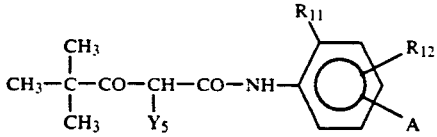

(Y)

In formulas (C-I) and (C-II), $R_1$, $R_2$ and $R_4$ which may be the same or different, each represent a substituted or unsubstituted aliphatic, aromatic or heterocyclic group; $R_3$, $R_5$ and $R_6$ which may be the same or different, are each hydrogen, a halogen atom, an aliphatic group, an aromatic group or an acylamino group; $R_3$ and $R_2$ may be a non-metallic atomic group required for the formation of a five-membered or six-membered nitrogen-containing ring; $Y_1$ and $Y_2$ are each hydrogen or a group which is eliminated by the coupling reaction with the oxidation product of a developing agent; and n is 0 or 1.

In formula (C-II), $R_5$ is preferably an aliphatic group such as methyl, ethyl, propyl, butyl, pentadecyl, tert-butyl, cyclohexyl, cyclohexylmethyl, phenylthio methyl, dodecyloxyphenylthiomethyl, butaneamidomethyl and methoxymethyl.

Preferred examples of the cyan couplers of formulas (C-I) and (C-II) include the following compounds.

In formula (C-I), $R_1$ is preferably an aryl group or a heterocyclic group and more preferably an aryl group which is substituted by one or more of a halogen atom, an alkyl group, an alkoxy group, an aryloxy group, an acylamino group, an acyl group, a carbamoyl group, a sulfonamido group, a sulfamoyl group, sulfonyl group, sulfamido group, oxycarbonyl group and cyano group.

In formula (C-I), $R_2$ is preferably a substituted or unsubstituted alkyl group or a substituted or unsubstituted aryl group and particularly preferably a substituted aryloxy-substituted alkyl group, and $R_3$ is preferably hydrogen when $R_3$ and $R_2$ are not linked to form a ring.

In formula (C-II), $R_4$ is preferably a substituted or unsubstituted alkyl group or a substituted or unsubstituted aryl group and particularly preferably a substituted aryloxy-substituted alkyl group.

In formula (C-II), $R_5$ is preferably an alkyl group having from 2 to 15 carbon atoms or methyl group having a substituent group having at least one carbon atom. Preferred substituent groups are an arylthio group, an alkylthio group, an acylamino group, an aryloxy group and an alkyloxy group.

In formula (C-II), $R_5$ is more preferably an alkyl group having from 2 to 15 carbon atoms and particularly preferably an alkyl group having from 2 to 4 carbon atoms.

In the formula (C-II), $R_6$ is preferably hydrogen or a halogen atom and more preferably chlorine or fluorine. In formulas (C-I) and (C-II), $Y_1$ and $Y_2$ are each preferably hydrogen, a halogen atom, an alkoxy group, an aryloxy group, an acyloxy group or sulfonamido group.

In the formula (M-I), $R_7$ and $R_9$ are each an aryl group; $R_8$ is hydrogen, an aliphatic or aromatic acyl group or an aliphatic or aromatic sulfonyl group; and $Y_3$ is hydrogen- or a coupling-off group. The aryl group (preferably phenyl group) of $R_7$ and $R_8$ may be substituted by one or more of those described above in the definition of the substituent groups of $R_1$. When the aryl group is substituted by two or more substituent groups, they may be the same or different groups. $R_8$ is preferably hydrogen or an aliphatic acyl or sulfonyl group and particularly preferably hydrogen. $Y_3$ is preferably a group which is eliminated by any of sulfur, oxygen and nitrogen atoms. For example, the sulfur atom elimination type coupling-off group described in U.S. Pat. No. 4,351,897 and W088/04795 is particularly preferred.

In formula (Y), $R_{11}$ is a halogen atom, an alkoxy group, trifluoromethyl group or an aryl group; $R_{12}$ is hydrogen, a halogen atom or an alkoxy group; A is $-NHCOR_{13}$, $-NHSO_2-R_{13}$, $$-SO_2\underset{\underset{R_{14}}{|}}{N}-R_{13},$$

$-COOR_{13}$ or $-SO_2NH-R_{13}$; $R_{13}$ and $R_{14}$ are each an alkyl group, an aryl group or an acyl group; and $Y_5$ is a coupling-off group. $R_{12}$, $R_{13}$ and $R_{14}$ may be substituted by groups described above in the definition of the substituent groups of $R_1$. $Y_5$ is preferably a coupling-off which is eliminated by an oxygen or nitrogen atom and particularly preferably a nitrogen-atom elimination type.

Examples of the couplers represented by the formulas (C-I), (C-II), M-I) and (Y) include the following compounds, but the present invention is not to be construed as being limited thereto.

(C-1)

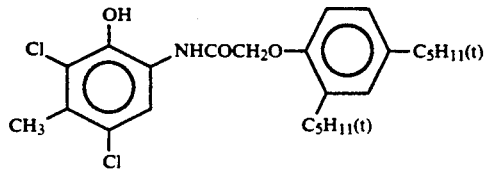

(C-2)

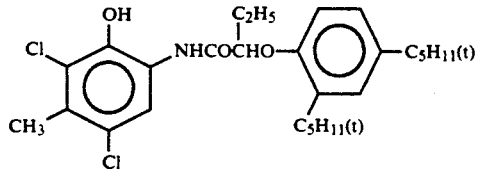

(C-3)

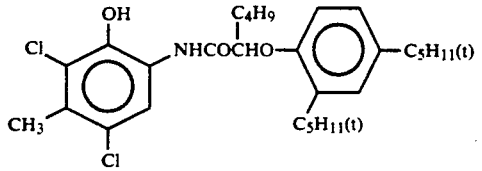

(C-4)

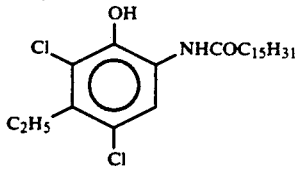

(C-5)

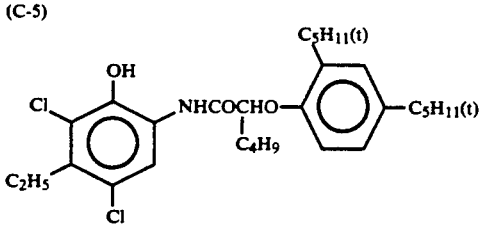

(C-6)

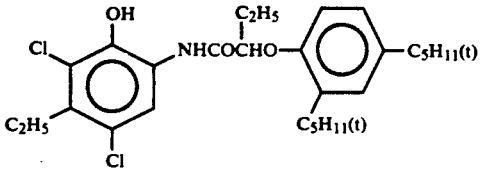

-continued
(C-7)
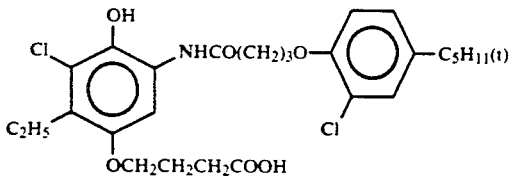
(C-8)
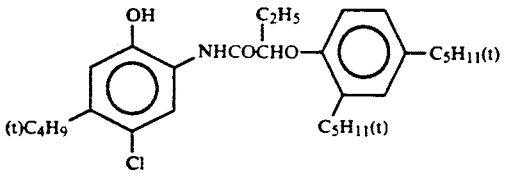
(C-9)
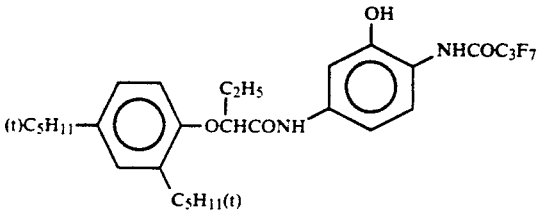
(C-10)
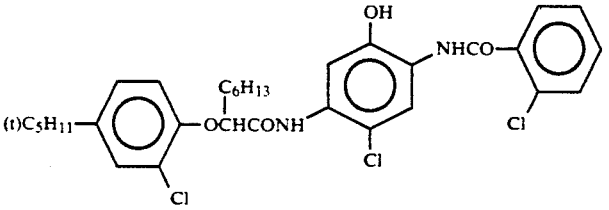
(C-11)
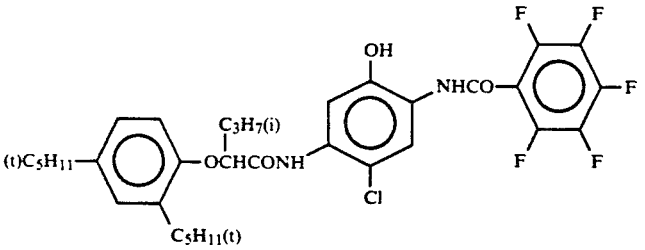
(C-12)
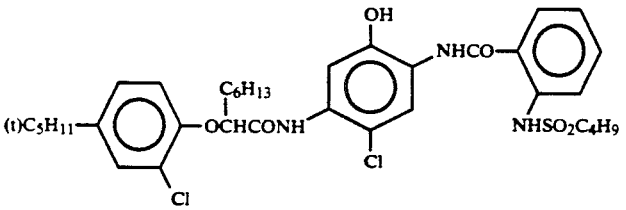
(C-13)
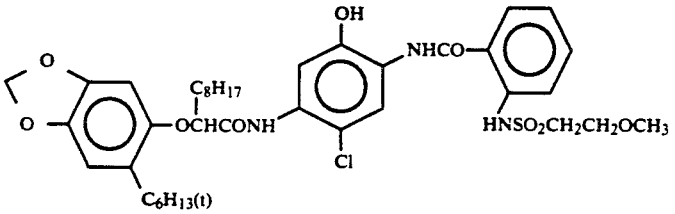

-continued
(C-14)
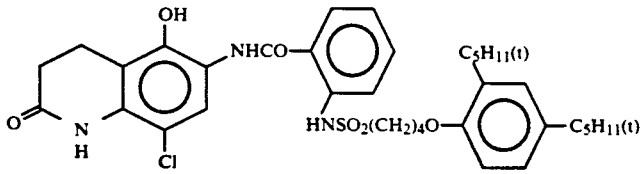
(C-15)
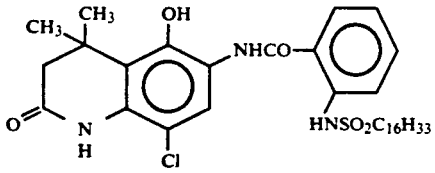
(C-16)
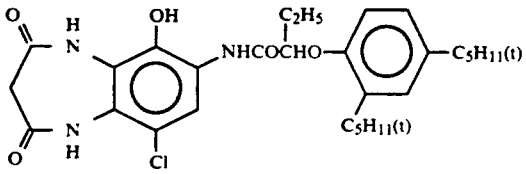
(C-17)
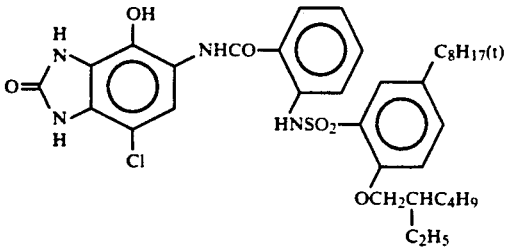
(C-18)
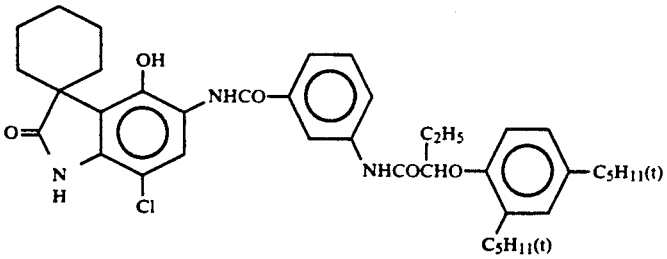
(C-19)
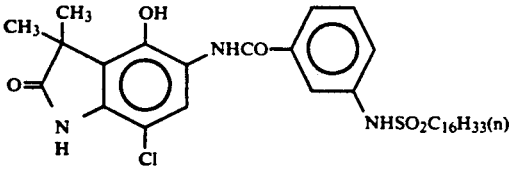
(C-20)
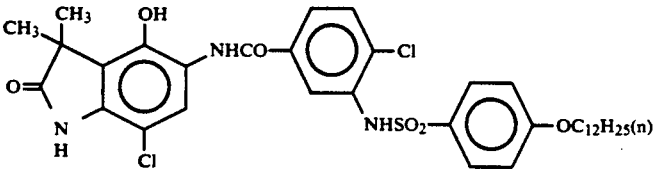

-continued
(C-21)
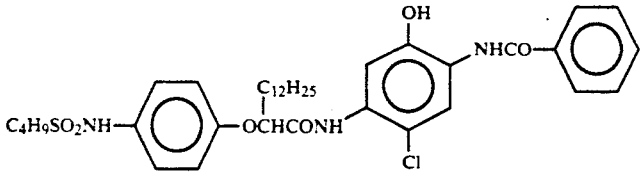
(C-22)
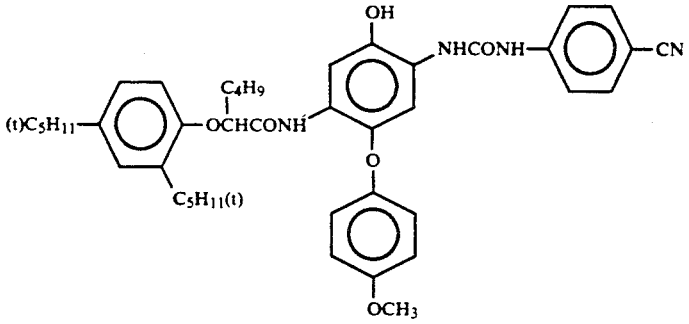
(M-1)
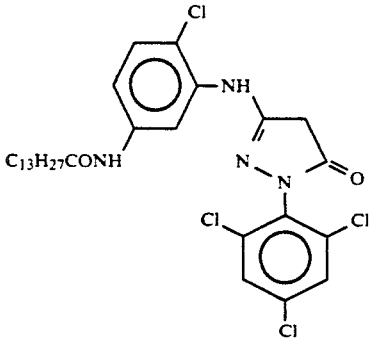
(M-2)
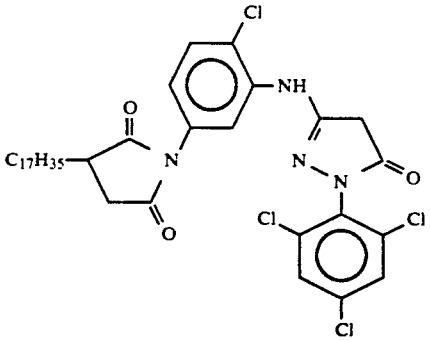
(M-3)
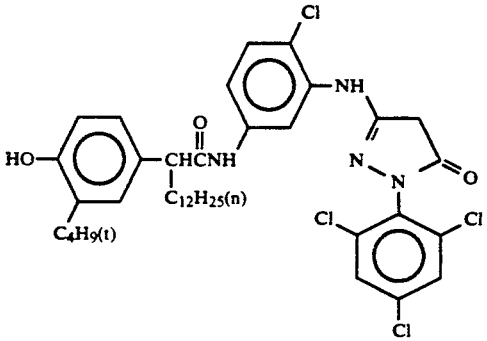

-continued
(M-4)
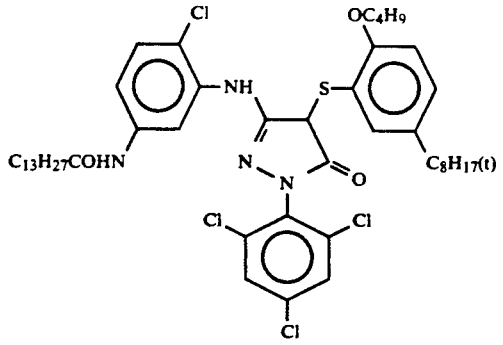
(M-5)
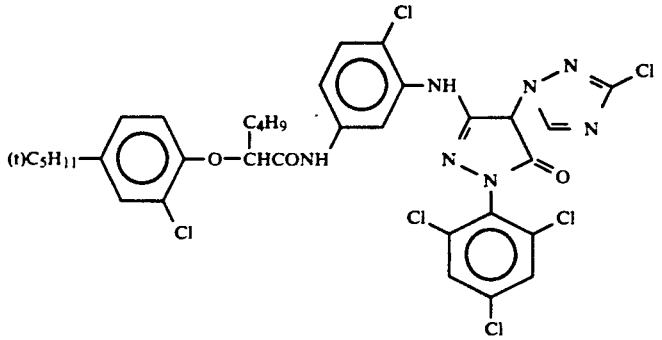
(M-6)
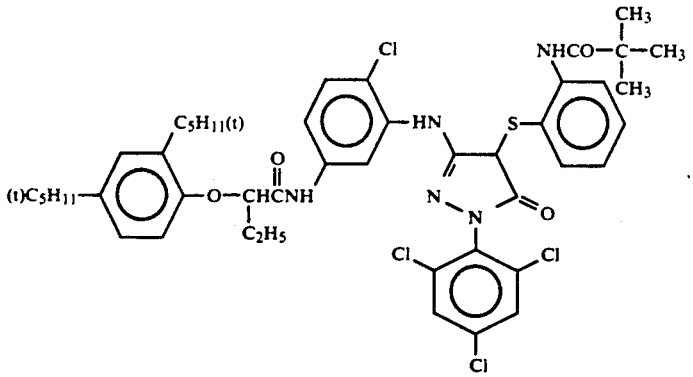
(M-7)
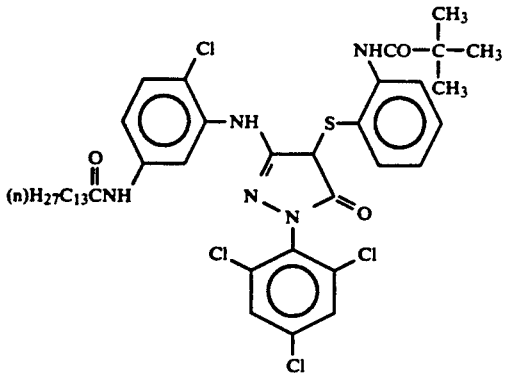
(M-8)

-continued
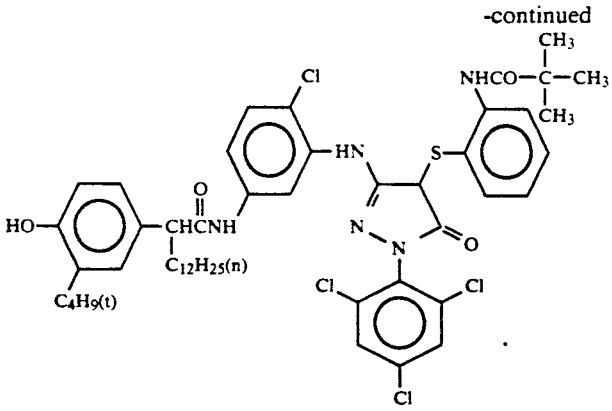
(Y-1)
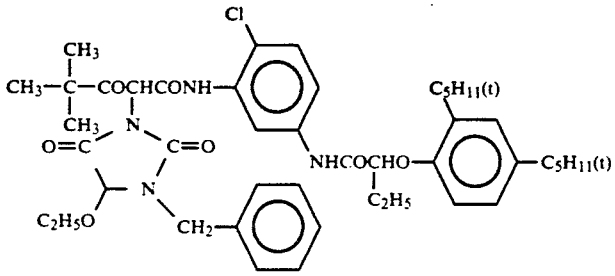
(Y-2)
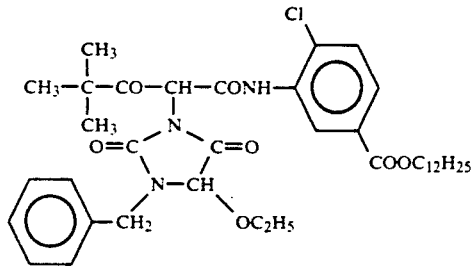
(Y-3)
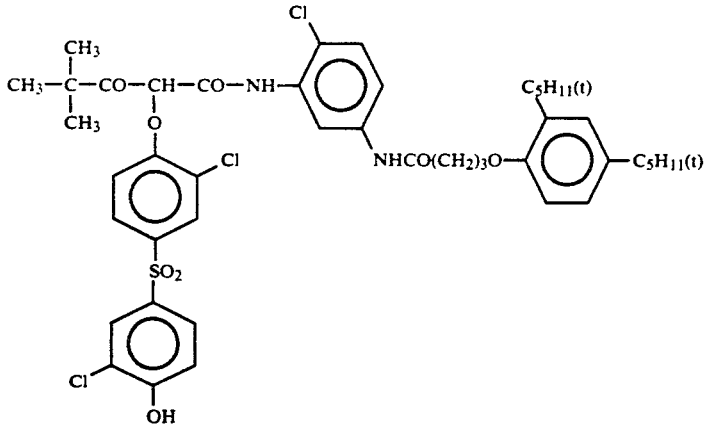
(Y-5)
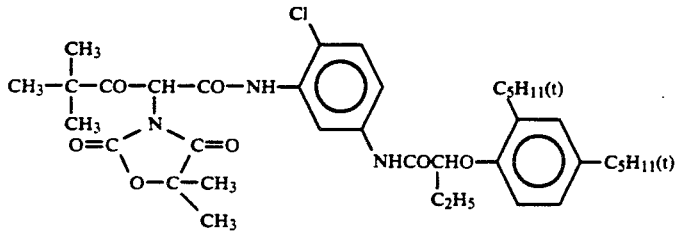

-continued (Y-5)

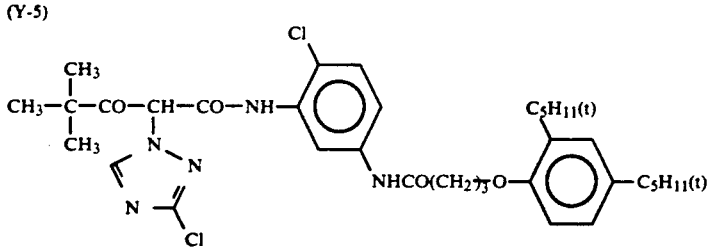

(Y-6)

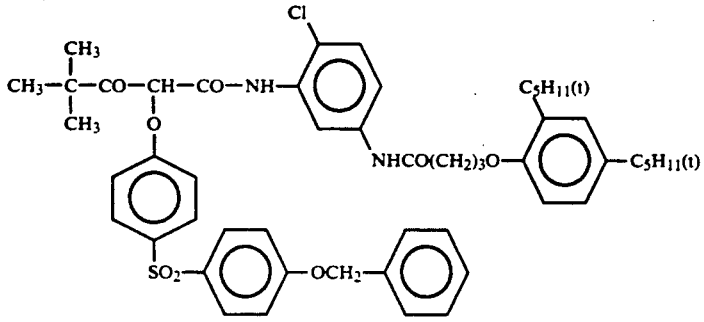

(Y-7)

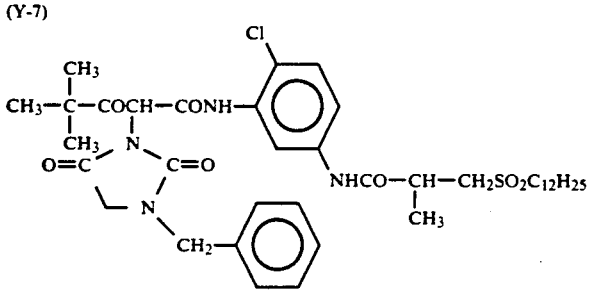

(Y-8)

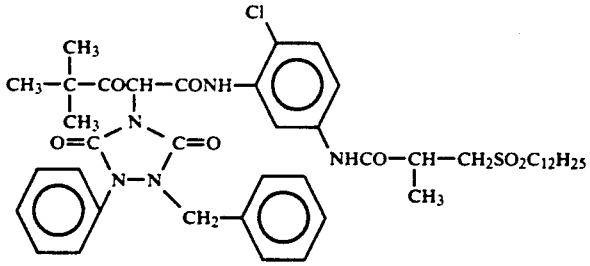

(Y-9)

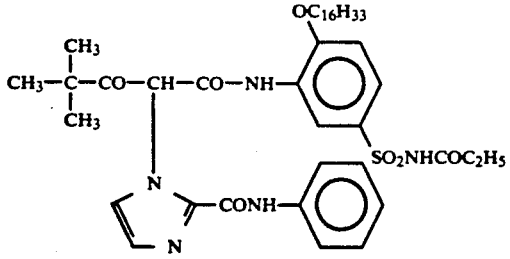

According to the invention, from 0.1 to 1.0 mol, preferably 0.1 to 0.5 mol (per mol of silver halide) of the each of the above couplers of the formulas (C-I) to (Y) is incorporated in the silver halide emulsion layers.

The couplers can be added to the light-sensitive layers by any conventional methods. Generally, a conventional oil-in-water dispersion method can be used as oil protected method in which a coupler is dissolved in a solvent and the resulting solution is emulsified and dispersed in an aqueous gelatin solution containing a surfactant. Alternatively, water or an aqueous gelation solution is added to a coupler solution containing a surfactant and phase reversal is conducted to form an oil-in-water dispersion. Alkali-soluble couplers can be dispersed by means of the Fischer dispersion method. Low-boiling organic solvent is removed from the coupler dispersion by means of distillation, noodle water washing with Nutsche or ultrafiltration, and the residue may be mixed with the photographic emulsion.

High-boiling organic solvents having a dielectric constant (25° C.) of 2 to 20 and refractive index (25° C.) of 1.5 to 1.7 and/or water-insoluble high-molecular compounds are preferred as dispersion media for the couplers. The high-boiling organic solvent is used in an amount of from 10 mol % to 500 mol % and, preferably, from 20 mol % to 300 mol % based on an amount of coupler.

Preferably, high-boiling organic solvents represented by the formulas (A) to (E) are used.

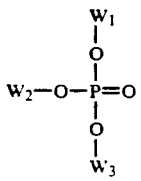
(A)

$W_1—COO—W_2$ (B)

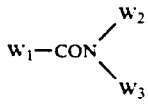
(C)

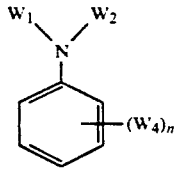
(D)

$W_1—O—W_2$ (E)

In the above formulas, $W_1$, $W_2$ and $W_3$ are each a substituted or unsubstituted alkyl, cycloalkyl, alkenyl, aryl or heterocyclic group; $W_4$ is W;, $OW_1$, or $SW_1$; and n is an integer of from 1 to 5. When n is 2 or greater, $W_4$ may be the same or different. In formula (E), $W_1$ and $W_2$ may be linked to form a condensed ring.

In addition to the solvents represented by formulas (A) to (E), water-immiscible compounds having a melting point of not higher than 100° C. and a boiling point of not lower than 140° C. can be used as high-boiling organic solvents in the present invention, so long as they are good solvents for the couplers. The melting points of the high-boiling organic solvents are preferably not higher than 80° C., and the boiling points thereof are preferably not lower than 160° C., more preferably not lower than 170° C.

The high-boiling organic solvents are described in more detail in JP-A-62-215272 (pages 137~144).

The couplers may be impregnated with latex polymer (e.g., described in U.S. Pat. No. 4,203,716) in the presence or absence of high-boiling organic solvents, or dissolved in a water-insoluble, but organic solvent-soluble polymer and can be emulsified in an aqueous solution of hydrophilic colloid. Preferably, the homopolymers or copolymers described in WO 88/00723 (pages 12 to 30) are used. Particularly, acrylamide polymers are preferred from the viewpoint of dye image stability.

The photographic materials of the present invention may contain hydroquinone derivatives, aminophenol derivatives, gallic acid derivatives and ascorbic acid derivatives as color fogging inhibitors (antifogging agents).

The photographic materials of the present invention may contain various anti-fading agents. Examples of organic anti-fading agents for cyan, magenta and/or yellow images include hydroquinones, 6-hydroxychromans, 5-hydroxycoumarans, spiro-chromans, hindered phenols such as bisphenols and p-alkoxyphenols, gallic acid derivatives, methylenedioxybenzenes, aminophenols, hindered amines and ethers or ester derivatives obtained by silylating or alkylating the phenolic hydroxyl group of the above-described compounds. Further, metal complexes such as (bissalicyl-aldoximato)-nickel complex and (bis-N,N-dialkyldithiocarbamato)-nickel can also be used.

Examples of the organic anti-fading agents include hydroquinones described in U.S. Pat. Nos. 2,360,290, 2,418,613, 2,700,453, 2,701,197, 2,728,659, 2,732,300, 2,735,765, 3,982,944 and 4,430,425, U.K., Patent 1,363,921, U.S. Pat. Nos. 2,710,801 and 2,866,028; 6-hydroxychromans, 5-hydroxycoumarans and spirochromans described in U.S. Pat. Nos. 3,432,300, 3,573,050, 3,574,627, 3,698,909 and 3,764,337 and JP-A-52-152225; spiro-indanes described in U.S. Pat. No. 4,360,589; p-alkoxyphenols described in U.S. Pat. No. 2,735,765, U.K. Patent 2,066,975, JP-A-59-10539 and JP-B-57-19765; hindered phenols described in U.S. Pat. Nos. 3,700,455 and 4,228,235, JP-A-52-72224 and JP-B-52-6623; gallic acid derivatives, methylenedioxybenzenes and aminophenols described in U.S. Pat Nos. 3,457,079 and 4,332,886 and JP-B-56-21144; hindered amines described in U.S. Pat. Nos. 3,336,135 and 4,268,593, U.K. Patents 1,322,889, 1,354,313 and 1,410,846, JP-B-51-1420, JP-A-58-114036, JP-A-59-53846 and JP-A-59-78344; and metal complexes described in U.S. Pat. Nos. 4,050,938 and 4,241,155 and U.K. Patent 2,027,731 (A). These compounds are used in an amount of generally 5 to 100% by weight based on the amount of the corresponding coupler. These compounds are co-emulsified with the couplers and added to the emulsion layers.

It is preferred that an ultraviolet light absorbing agent is introduced into both layers adjacent to the cyan color forming layer to prevent the cyan color image from being deteriorated by heat and particularly light.

Examples of the ultraviolet light absorbing agents include aryl group-substituted benzotriazole compounds described in U.S. Pat. No. 3,533,794; 4-thiazolidone compounds described in U.S. Pat. Nos. 3,314,794 and 3,352,681; benzophenone compounds described in JP-A-46-2784; cinnamic ester compounds described in U.S. Pat. Nos. 3,705,805 and 3,707,395; butadiene compounds described in U.S. Pat. No. 4,045,229; and benzoxidol compounds described in U.S. Pat. Nos. 3,406,070, 3,677,672 and 4,271,307. If desired, ultraviolet absorbing couplers (e.g., α-naphthol cyan color forming couplers) and ultraviolet light absorbing polymers may be used. These ultraviolet light absorbers may be incorporated in specific layers.

Among them, the aryl group-substituted benztriazole compounds are preferred.

It is preferred that the following compounds are used together with the couplers, particularly pyrazoloazole couplers.

It is preferred hat at least one of compounds (F) and compound (G) are used, alone or in combination, to prevent stain from being formed by the reaction of the coupler with a color developing agent left in film during storage after processing or its oxidation product or to prevent other side effects. Compound (F) is chemically bonded to aromatic amine developing agents left after color development to form a compound which is chemically inert and substantially colorless. Compound (G) is chemically bonded to the oxidation product of the aromatic amine color developing agents left after color development to form a compound which is chemically inert and substantially colorless.

Preferred compounds (F) have a second-order reaction constant $K_2$ (in trioctyl phosphate at 80° C.) (in terms of the reaction of p-anisidine) of 1.0 to $1\times10^{-5}$ l/mol·sec as measured by the method described in JP-A-63-158545.

When the value of $K_2$ exceeds the range defined above, there is a possibility that the compounds themselves will become unstable and be decomposed by the reaction with gelatin or water, while when the value of $K_2$ is smaller than the range defined above, there is a possibility that the reaction of the compound with the aromatic amine developing agent left will be retarded and as a result, the side effects of the residual aromatic amine developing agent will not be prevented.

Among the compounds (F), compounds represented by the following formula (F-I) or (F-II) are preferred.

$$R_1-(A)_n-X \qquad \text{(F-I)}$$

$$R_2-\underset{\underset{B}{|}}{C}=Y \qquad \text{(F-II)}$$

In the above formulas, $R_1$ and $R_2$ are each an aliphatic group, an aromatic group or a heterocyclic group; n is 0 or 1; A is a group which forms a chemical bond by a reaction with the aromatic amine developing agent; X is a group which is eliminated by the reaction with the aromatic amine developing agent; B is hydrogen, an aliphatic group, an aromatic group, a heterocyclic group, an acyl group or a sulfonyl group; Y is a group which accelerates the addition of the aromatic amine developing agent to the compound of formula (F-II); and $R_1$ and X or Y and $R_2$ or Y and B may be linked to form a ring structure.

Typical reactions of chemically bonding these compounds to the residual aromatic amine developing agent are a substitution reaction and an addition reaction.

Among the compounds (G) which are chemically bonded to the oxidation product of the aromatic amine developing agents left after color development to form a compound which is chemically inert and substantially colorless, compounds represented by the following formula (G-I) are preferred.

$$R-Z \qquad \text{(G-I)}$$

In formula (G-I), R is an aliphatic group, an aromatic group or a heterocyclic group; and Z is a nucleophilic group or a group which is decomposed in the photographic material to release a nucleophilic group ("nucleophilic group precursor"). In preferred compounds of formula (G-I) Z is a group having a Pearson's nucleophilic $^nCH_3I$ value [R. G. Pearson, et al., J. Am. Chem. Soc., 90, 319 (1968)] of 5 or larger or a group derived therefrom.

Preferred examples of the compounds of formula (G I) are described in European Published Patent Application No. 255722, JP-A-62-143048, JP-A-62-229145, Japanese Patent Application Nos. 63-136724 and 62-214681, and EP-A-298321 and EP-A-277589.

Combinations of compounds (G) with compounds (F) are described in detail in EP-A-277589.

The hydrophilic colloid layers of the photographic materials of the present invention may contain water-soluble dyes or dyes which are made water-soluble by photographic processing as filter dyes or for the purpose of preventing irradiation or halation. Examples of the dyes include oxonol dyes, hemioxonol dyes, styryl dyes, merocyanine dyes, cyanine dyes and azo dyes. Among them, oxonol dyes, hemioxonol dyes and merocyanine dyes are preferred.

Gelatin is preferred as a binder or protective colloid for the emulsion layers of the photographic materials of the present invention. In addition thereto, hydrophilic colloid alone or in combination with gelatin can be used.

Any of lime-processed gelatin and acid-processed gelatin can be used. The preparation of gelatin is described in more detail in Arthur, Weiss, *The Macromelecular Chemistry of Gelatin* (Academic Press 1964).

Any of transparent films such as cellulose nitrate film and polyethylene terephthalate film and reflection type support can be used as supports in the present invention. For the purpose of the present invention, the reflection type support is preferable.

The term "reflection type support" as used herein refers to supports which enhance reflection properties to make a dye image formed on the silver halide emulsion layer clear. Examples of the reflection type support include supports coated with a hydrophobic resin containing a light reflecting material such as titanium oxide, zinc oxide, calcium carbonate or calcium sulfate dispersed therein and supports composed of a hydrophobic resin containing a light reflecting material dispersed therein. Typical examples of the supports include baryta paper, polyethylene coated paper, polypropylene synthetic paper, transparent supports coated with a reflecting layer or containing a reflection material, glass sheet, polyester film such as polyethylene terephthalate film and cellulose triacetate, polyamide films, polycarbonate films, polystyrene films and vinyl chloride resins. These supports can be properly chosen according to the purpose of use.

Other examples of reflection type supports include supports having a metallic surface which has specular reflection properties or second kind diffusion reflection properties. Metallic surfaces having a spectral reflectance of not lower than 0.5 in the visible wave range are preferred. It is also preferred that metallic surfaces are roughened or diffusion reflection properties are imparted to metallic surfaces by using a metallic powder. Examples of metals include aluminum, tin, silver, magnesium and alloys thereof. The metallic surfaces may be the surfaces of metallic sheets obtained by rolling, metallizing or plating and the surfaces of metallic foils or metallic films. Among them, the surfaces obtained by metallizing other substrates are preferred. It is preferred to provide a water-resistant resin layer, particularly a thermoplastic resin layer on the metallic surfaces. It is also preferred that an antistatic layer is provided on the opposite side of the support to the metallic surface thereof. These supports are described in more detail in JP-A-61-210346, JP-A-63 24247, JP-A-63-24251 and JP-A-63-24255. These supports can be properly chose according to the purpose of use.

Preferred reflecting materials include a white pigment thoroughly kneaded in the presence of a surfactant, or the surfaces of pigment particles may be treated with a dihydric to tetrahydric alcohol.

The occupied area ratio (%) of fine particles of white pigment per unit area can be determined by dividing the observed area into adjoining unit area of 6 $\mu m \times 6$ $\mu m$ and measuring the occupied area ratio (%) (Ri) of the fine particles projected on the unit area. A coefficient of variation of the occupied area ratio (%) can be determined from a ratio ($s/\overline{R}$) of standard deviation s of Ri to the mean value ($\overline{R}$) of Ri. The number (n) of divided unit areas is preferably not smaller than 6. Accordingly, a coefficient of variation $s/\overline{R}$ can be determined by the following formula.

$$\sqrt{\frac{\sum_{i=1}^{n}(Ri-R)^2}{n-1}} \Big/ \frac{\sum_{i=1}^{n} Ri}{n}$$

In the present invention, a coefficient of variation of the occupied area ratio (%) of the fine pigment particles is preferably not higher than 0.15, particularly not higher than 0.12. When the value is not higher than 0.08, it is considered that the dispersion of the particles is substantially uniform.

The color developing solutions which can be used in the present invention are preferably aqueous alkaline solutions mainly composed of aromatic primary amine color developing agents. Aminophenol compounds are useful as the color developing agents and p-phenylenediamine compounds are preferred as the color developing agents. Typical examples thereof include 3-methyl-4-amino-N,N-diethylaniline, 3-methyl-4-amino-N-ethyl-N-$\beta$-hydroxyethylaniline, 3-methyl-4-amino-N-ethyl-N-$\beta$-methanesulfonamidoethylaniline, 3-methyl-4-amino-N-ethyl-N-$\beta$-methoxyethylaniline and salts thereof such as sulfate, hydrochloride and p-toluenesulfonate.

These compounds may be used either alone or in combination of two or more of them.

Generally, the color developing solutions contain pH buffering agents such as alkali metal carbonates and phosphates, restrainers such as bromides, iodides, benzimidazoles, benzothiazoles and mercapto compounds and anti-fogging agents. If desired, the color developing solutions may optionally contain preservatives such as hydroxylamine, diethylhydroxylamine, hydrazine such as N,N-biscarboxymethylhydrazine, sulfites, phenylsemicarbazides, triethanolamine, and catecholsulfonic acids; organic solvents such as ethylene glycol and diethylene glycol; development accelerators such as benzyl alcohol, polyethylene glycol, quaternary ammonium salts and amines; color forming couplers, and competitive couplers; auxiliary developing agents such as 1-phenyl-3-pyrazolidone; tackifiers; and chelating agents such as polyaminocarboxylic acids, polyaminophosphonic acids, alkylphosphonic acids and phosphonocarboxylic acids, for example, ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid and ethylenediamine-di(o-hydroxyphenylacetic acid) and salts thereof.

Generally, when reversal processing is to be conducted, black-and-white development and reversal processing are first carried out and color development is then carried out. Black-and-white developing solutions may contain conventional developing agents such as dihydroxybenzenes (e.g., hydroquinones), 3-pyrazolidones (e.g., 1-phenyl-3-pyrazolidone) and aminophenols (e.g., N-methyl-p-aminophenol). These developing agents may be used either alone or in combination of two or more of them.

The pH of the color developing solutions and the black-and-white developing solutions is generally in the range of 9 to 12. The replenishment rate of these developing solutions varies depending on the types of the color photographic materials, but is usually not more than 3 l per $m^2$ of the photographic material. The replenishment rate can be reduced to 500 ml or less when the concentration of bromide ion in the replenisher is reduced. When the replenishment is to be reduced, it is desirable that the contact area of the layer to be processed, with air is reduced to prevent the solution from being evaporated or oxidized by air.

The contact are of the photographic processing solution with air in the processing tank can be represented by aperture ratio defined below.

$$\text{Aperture ratio} = \frac{\text{Contact area (cm}^2\text{) of processing solution with air}}{\text{Volume (cm}^3\text{) of processing solution}}$$

The aperture ratio is preferably not higher than 0.1, more preferably 0.001 to 0.05.

The aperture ratio can be reduced by providing a covering material such as a floating cover on the surface of the photographic processing solution in the processing tank. Other examples of methods for reducing the aperture ratio include a method using a movable cover described in Japanese Patent Application No. 62-241342, and a slit developing method described in JP-A-63-216050.

It is preferred that the reduction of the aperture ratio is applied to not only color development and black-and-white development stages, but also subsequent stages such as bleaching, bleaching-fixing, fixing, rinsing, and stabilization stages. The replenishment rate can be reduced by inhibiting the accumulation of bromide ion in the developing solution.

Color development time is generally two to five minutes, but processing time can be shortened by using the color developing agents at a high concentration under high temperature and pH conditions.

After color development, the photographic emulsion layer is generally bleached. Bleaching may be carried out simultaneously with fixing (bleaching-fixing treatment) and they are separately carried out. After bleaching, a bleaching-fixing treatment may be conducted to expedite processing. Processing may be conducted by using a bleaching-fixing bath composed of two consecutive baths. Fixing may be conducted before the bleaching-fixing treatment. After the bleaching-fixing treatment, bleaching may be conducted as desired. Examples of bleaching agents include compounds of polyvalent metals such as iron(III). Typical examples of the bleaching agents include organic complex salts of iron(III) such as complex salts of polyaminocarboxylic acids (e.g., ethylenediaminetetraacetic acid, diethylenetriaminepentaacetic acetic acid, cyclohexanediaminetetraacetic acid, methyliminodiacetic acid, 1,3-diaminopropanetetraacetic acid, and glycol ether diaminetetraacetic acid), citric acid, tartaric acid, and malic acid. Among them, ion(III) complex salts of polyaminocarboxylic acids such as (ethylenediaminetetraacetonato)iron(III) complex are preferred from the viewpoints of rapid processing and prevention of environmental pollution. Further, iron(III) complex salts of polyaminocarboxylic acids are useful for bleaching solutions and bleaching-fixing solutions. The pH of the bleaching solutions containing the iron(III) complex salts of the polyaminocarboxylic acids and the bleaching-fixing solutions containing iron(III) complex salts is generally in the range of 4.0 to 8. A lower pH may be used to expedite processing.

If desired, the bleaching solution, the bleaching-fixing solution and the previous bath thereof may contain bleaching accelerators. Examples of the bleaching accelerators include compounds having mercapto group or disulfide group described in U.S. Pat. No. 3,893,858, West German Patent 1,290,812, JP-A-53-95630, and *Research Disclosure* No. 17129 (July 1978); thiazolidine derivatives described in JP-A-50-140129; thiourea derivatives described in U.S. Pat. No. 3,706,561; iodides described in JP-A-58-16235; polyoxyethylene compounds described in West German Patent 2,748,430; polyamine compounds described in JP-B-45-8836; and bromide ions. Among them, the compounds having a mercapto group or disulfide group are preferred from the viewpoint of high accelerating effect. Particularly, the compounds described in U.S. Pat. No. 3,893,858, West German Patent 1,290,812 and JP-A-53-95630 are preferred. Further, the compounds described in U.S. Pat. No. 4,552,834 are preferred. These bleaching accelerators may be incorporated in the photographic materials. These bleaching accelerators are particularly effective in conducting the bleaching-fixing of color photographic materials for photographing.

Examples of fixing agents include thiosulfates, thiocyanates, thioether compounds, thioureas and various iodides. The thiosulfates are widely used fixing agents. Particularly, ammonium thiosulfate is most widely used. Sulfites, bisulfites, sulfinic acids such as p-toluenesulfinic acid and carbonyl bisulfite adducts are preferred as preservatives for the bleaching-fixing solutions.

Usually, the silver halide color photographic materials of the present invention are subjected to washing and/or stabilization after desilvering. The amount of rinsing water in the washing stage widely varies depending on the characteristics (e.g., depending on materials used such as couplers) of the photographic materials, use, the temperature of rinsing water, the number of rinsing tanks (the number of stages), replenishing system (countercurrent, direct flow) and other conditions. The relation ship between the amount of water and the number of rinsing tanks in the multi-stage countercurrent system can be determined by the method described in *Journal of the Society of Motion Picture and Television Engineers*, Vol. 64, p.248-253 (May 1955).

According to the multi-stage countercurrent system described in the above article, the amount of rinsing water can be greatly reduced. However, the residence time of water in the tanks is prolonged and as a result, bacteria are grown and the resulting suspended matter is deposited on the photographic material. A method for reducing calcium ion and magnesium ion concentration; described in JP-A-62-288838 can be effectively used for the color photographic materials of the present invention to solve this problem. Further, isothiazolone compounds, thiabendazole compounds, chlorine-containing germicides such as sodium chlorinated isocyanurate and benztriazole described in JP-A-57-8542 and germicides described in *Chemistry of Germicidal Antifungal Agent*, written by Hiroshi Horiguchi, *Sterilization, Disinfection, Antifungal Technique*, edited by Sanitary Technique Society and Antibacterial and *Antifungal Cyclopedie*, edited by Nippon Antibacterial Antifungal Society, can be used.

The pH of rinsing water in the treatment of the photographic materials of the present invention is in the range of 4 to 9, preferably 5 to 8. The temperature of the rinsing water and washing time vary depending on the characteristics of the photographic materials and use, but the temperature and time of washing are generally 15° to 45° C. for 20 seconds to 10 minutes, preferably 25° to 40° C. for 30 seconds to 5 minutes. The photographic materials of the present invention may be processed directly with stabilizing solutions in place of rinsing water. Such stabilizing treatment can be carried out by conventional methods described in JP-A-57-8543, JP-A-58-14834 and JP-A-60-220345.

A stabilizing treatment subsequent to the rinsing may be conducted. The stabilizing treatment may be used as the final bath for the color photographic materials for photographing. An example include a stabilizing bath containing formalin and a surfactant. The stabilizing bath may contain various chelating agents antifungal agents.

Overflow solution from the replenishment of rinsing water and/or stabilizing can be reused in other stages such as desilvering stage.

The color developing agents may be incorporated in the silver halide color photographic materials of the present invention for the purpose of simplifying and expediting processing. It is preferred that precursors for the color developing agents are used for the incorporation thereof in the photographic materials. Examples of the precursors include indoaniline compounds described in U.S. Pat. No. 3,342,597; Schiff base silver compounds described in U.S. Pat. No. 3,342,599 *Research Disclosure* No. 14850 and ibid., No. 15159; aldol compounds described in *Research Disclosure* No. 13924; metal complex salts described in U.S. Pat. No. 3,719,492; and urethane compounds described in JP-A-53-135628.

If desired, 1-phenyl-3-pyrazolidones may be incorporated in the silver halide color photographic materials of the present invention for the purpose of accelerating color development. Typical examples of the compounds include those described in JP-A-56-64339, JP-A-57-144547 and JP-A-58-115438.

In the present invention, various processing solutions are used at a temperature of 10° to 50° C. Generally, a temperature of 33° to 38° C. is used. However, a higher temperature can be used to accelerate processing and to shorten processing time, while a lower temperature can be used to improve image quality and to improve the stability of the processing solutions. If desired, treatments using cobalt intensification or hydrogen peroxide intensification described in West German Patent 2,226,770 and U.S. Pat. No. 3,674,499 may be carried out to save silver.

The present invention is now illustrated in greater detail with reference to the following examples, but the present invention is not to be construed as being limiting thereto. Unless otherwise indicated, all parts, percent and ratios are by weight.

EXAMPLE 1

Both side of a paper support were laminated with polyethylene. The resulting support was coated with the following layers to prepare a multi-layer color photographic paper having the following layer structure. Coating solutions were prepared in the following manner.

Preparation of coating solution for first layer 19.1 g of yellow coupler (ExY), 4.4 g of dye image stabilizer (Cpd-1) and 1.8 g of dye image stabilizer (Cpd-7) were dissolved in 27.2 cc of ethyl acetate, 4.1 g of solvent (Solv-3) and 4.1 g of solvent (Solv-6). The resulting solution was emulsified and dispersed in 185 cc of a 10% aqueous gelatin solution containing 8 cc of 10% sodium dodecylbenzenesulfonate. Separately, $5.0\times10^{-4}$ mol (per mol of silver) of the following blue-sensitive sensitizing dye was added to a silver chlorobromide emulsion [a 1:3 (by Ag mol) mixture of an emulsion (silver bromide: 80.0 mol %, cube, mean grain size: 0.85 μm, coefficient of variation: 0.08) and an emulsion (silver bromide: 80.0%, cube, mean grain size: 0.62 μm, coefficient of variation: 0.07)] which was previously sulfur-sensitized. The resulting emulsion and the above emulsified dispersion were mixed and dissolved. A coating solution for the first layer was prepared so as to give the following composition. Coating solutions for the second layer to the seventh layer were prepared in the same way as the coating solution for the first layer. The sodium salt of 1-oxy-3,5-dichloro-s-triazine was used as the hardening agent for gelatin in each layer.

The following spectral sensitizing dyes were used for the following layers.

Blue-sensitive emulsion layer

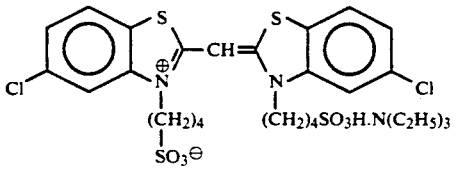

($5.0\times10^{-4}$ mol per mol of silver halide)

Green-sensitive layer

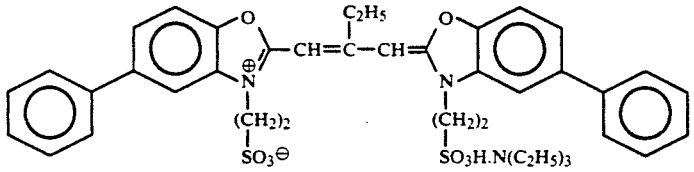

($4.0\times10^{-4}$ mol per mol of silver halide)

and

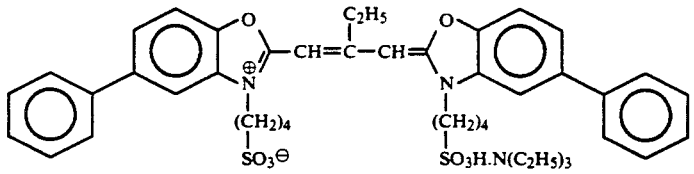

($7.0\times10^{-5}$ mol per mol of silver halide)

Red sensitive emulsion layer

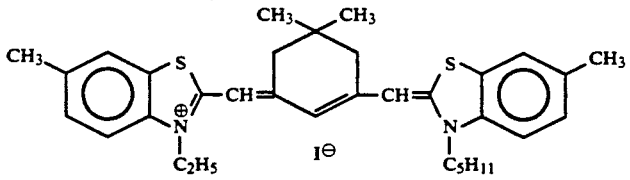

($0.9\times10^{-4}$ mol per mol of silver halide)

$2.6\times10^{-3}$ mol of the following compound per mol of silver halide was added to the red-sensitive emulsion layer.

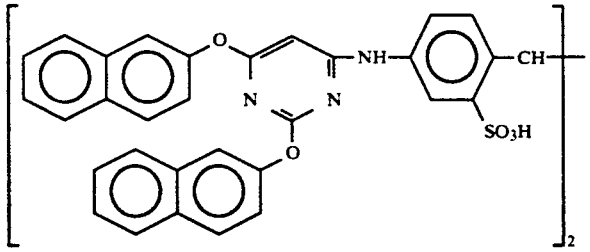

$4.0\times10^{-6}$ mol, $3.0\times10^{-5}$ mol and $1.0\times10^{-5}$ mol of 1-(5-methylureidophenyl)-5-mercaptotetrazole per mol of silver halide and $8\times10^{-3}$ mol, $2\times10^{-2}$ mol and $2\times10^{-2}$ mol of 2-methyl-5-t-octylhydroquinone per mol of silver halide were added to the blue-sensitive emulsion layer, the green-sensitive emulsion layer and the red-sensitive emulsion layer, respectively.

$1.2\times10^{-2}$ mol and $1.1\times10^{-2}$ mol of 4-hydroxy-6-methyl-1,3,3a,7-tetrazaindene per mol of silver halide were added to the blue-sensitive emulsion layer and the green-sensitive emulsion layer, respectively.

The following dyes were added to emulsion layers to prevent irradiation.

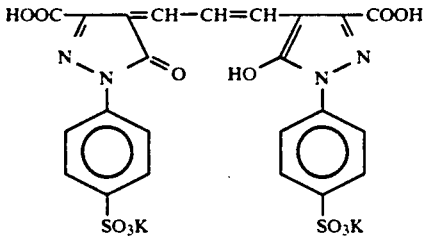

and

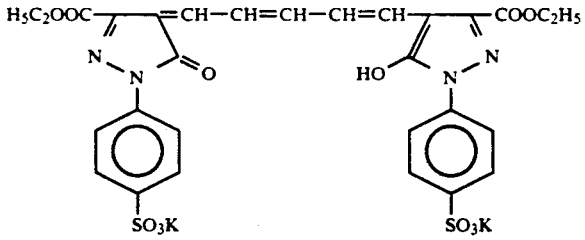

Layer Structure

Each layer had the following composition. Numerals represent coating weight (g/m²). The amounts of the silver halide emulsions are represented by coating weight in terms of silver.

Support

Polyethylene-laminated paper [polyethylene on the side of the first layer contains white pigment ($TiO_2$) and bluish dye(ultramarine)].

| | |
|---|---|
| First Layer (blue-sensitive layer) | |
| The above silver chlorobromide emulsion (AgBr: 80 mol %) | 0.26 |
| Gelatin | 1.83 |
| Yellow coupler (ExY) | 0.83 |
| Dye image stabilizer (Cpd-1) | 0.19 |
| Dye image stabilizer (Cpd-7) | 0.08 |
| Solvent (Solv-3) | 0.18 |

-continued

| | |
|---|---|
| Solvent (Solv-6) | 0.18 |
| Second layer (color mixing inhibiting layer) | |
| Gelatin | 0.99 |
| Color mixing inhibitor (Cpd-5) | 0.08 |
| Solvent (Solv-1) | 0.16 |
| Solvent (Solv-4) | 0.08 |
| Third layer (green-sensitive layer) | |
| Silver chlorobromide emulsion [a 1:1 (by Ag mol) mixture of emulsion (AgBr: 90 mol %, cubic, mean grain size: 0.47 μm, coefficient of variation: 0.12) and emulsion (AgBr: 90 mol %, cubic, mean grain size: 0.36 μm, coefficient of variation: 0.09)] | 0.16 |
| Gelatin | 1.79 |
| Magenta coupler (I-7) | 0.32 |
| Dye image stabilizer (II-21) | 0.20 |
| Dye image stabilizer (Cpd-4) | 0.01 |
| Dye image stabilizer (Cpd-8) | 0.03 |
| Dye image stabilizer (Cpd-9) | 0.04 |
| Solvent (Solv-2) | 0.65 |
| Fourth layer (ultraviolet light absorbing layer) | |
| Gelatin | 1.58 |
| Ultraviolet light absorber (UV-1) | 0.47 |
| Color mixing inhibitor (Cpd-5) | 0.05 |
| Solvent (Solv-5) | 0.24 |
| Fifth layer (red-sensitive layer) | |
| Silver chlorobromide emulsion [a 1:2 (by Ag mol) mixture of emulsion (AgBr: 70 mol %, cubic, mean grain size: 0.49 μm, coefficient of variation: 0.08) and emulsion (AgBr: 70 mol %, cubic, mean grain size: 0.34 μm, coefficient of variation: 0.10)] | 0.23 |
| Gelatin | 1.34 |
| Cyan coupler (ExC) | 0.30 |
| Dye image stabilizer (Cpd-6) | 0.17 |

-continued

| | |
|---|---|
| Dye image stabilizer (Cpd-7) | 0.40 |
| Solvent (Solv-6) | 0.20 |
| Sixth layer (ultraviolet light absorbing layer) | |
| Gelatin | 0.53 |
| Ultraviolet light absorber (UV-1) | 0.16 |
| Color mixing inhibitor (Cpd-5) | 0.02 |
| Solvent (Solv-5) | 0.08 |

-continued

| | |
|---|---|
| Seventh layer (protective layer) | |
| Gelatin | 1.33 |
| Acrylic-modified copolymer of polyvinyl alcohol (a degree of modification: 17%) | 0.17 |
| Liquid paraffin | 0.03 |

The following compounds were used:

(Cpd-1) Dye image stabilizer

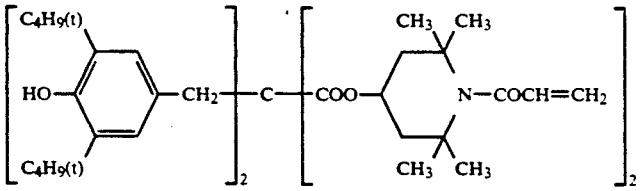

(Cpd-4) Dye image stabilizer

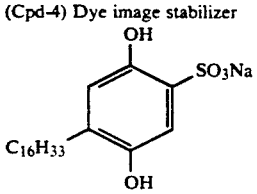

(Cpd-5) Color mixing inhibitor

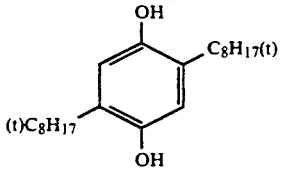

(Cpd-6) Dye image stabilizer

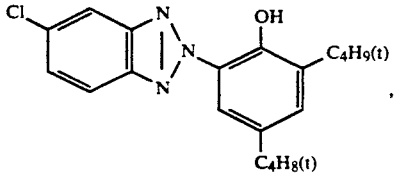

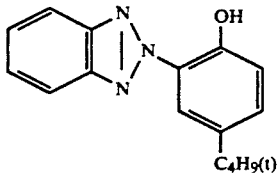

and

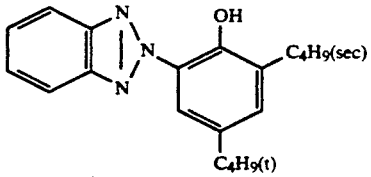

2:4:4 mixture (by weight)

(Cpd-7) Dye image stabilizer

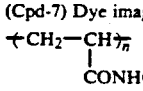

(Average molecular weight: 80,000)

(Cpd-8) Dye image stabilizer

-continued
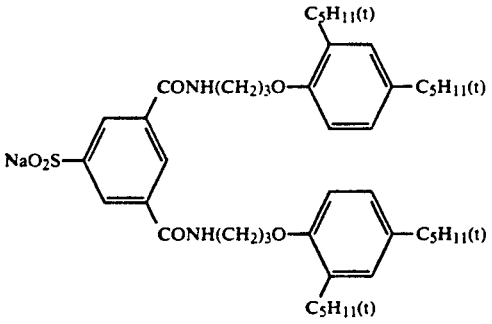
(Cpd-9) Dye image stabilizer
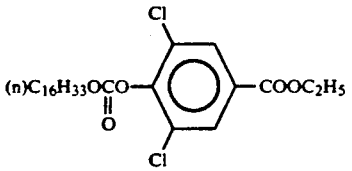
(UV-1) Ultraviolet light absorber
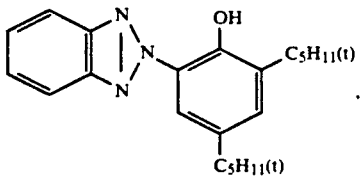
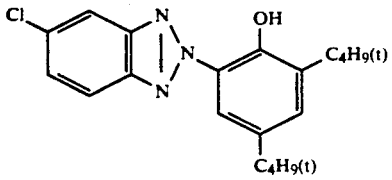
and
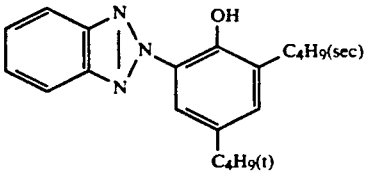
4:2:4 mixture (by weight)
(Solv-1) Solvent
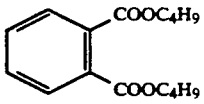
(Solv-2) Solvent
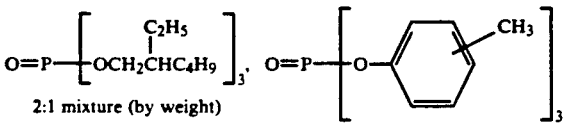
2:1 mixture (by weight)
(Solv-3) Solvent
$O{=}P{+}O{-}C_9H_{19}\text{-(iso)}]_3$
(Solv-4) Solvent -continued

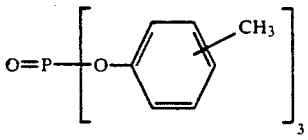

(Solv-5) Solvent

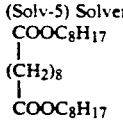

(Solv-6) Solvent

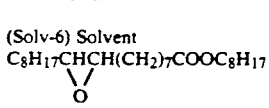

Yellow Coupler (ExY)

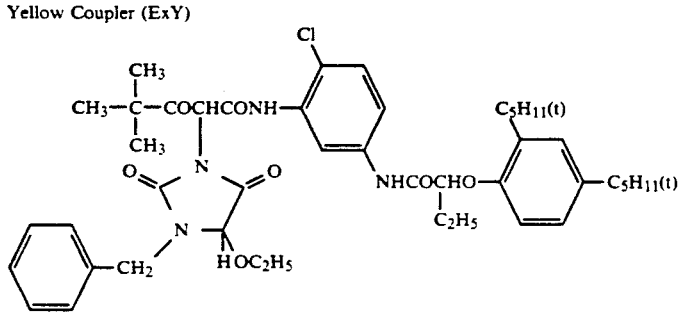

Cyan Coupler (ExC)

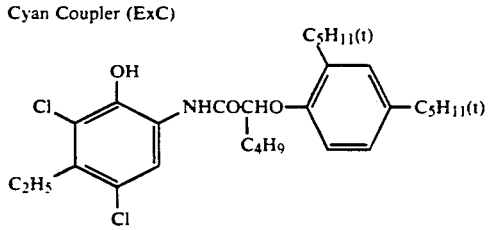

and

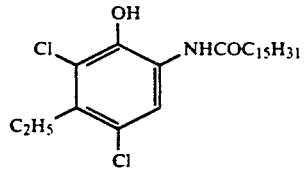

in a molar ratio of 1:1.

In this way, a multi-layer color photographic material (A) was prepared. Samples (B) to (O) were prepared in the same manner as in the preparation of the material (A) except that the following compounds given in Table 1 were used in the third layer.

TABLE 1

| | Third layer (green-sensitive layer) | | | |
|---|---|---|---|---|
| Sample No. | Formula (I) | Formula (II) | Formula (III) | [Added amount based on the amount of coupler of formula (I)] |
| A | I-7 | II-21 | — | — |
| B | M-4 | II-21 | — | — |
| C | I-7 | — | — | — |
| D | I-7 | — | III-1 | (100 mol %) |
| E | I-7 | — | III-10 | (100 mol %) |
| F | I-7 | II-21 | III-1 | (20 mol %) |
| G | I-7 | II-21 | III-1 | (50 mol %) |
| H | I-7 | II-21 | III-10 | (20 mol %) |
| I | I-7 | II-21 | III-10 | (50 mol %) |

TABLE 1-continued

| | Third layer (green-sensitive layer) | | | |
|---|---|---|---|---|
| Sample No. | Formula (I) | Formula (II) | Formula (III) | [Added amount based on the amount of coupler of formula (I)] |
| J | I-7 | II-21 | III-23 | (20 mol %) |
| K | I-7 | II-9 | III-23 | (20 mol %) |
| L | I-7 | II-26 | III-23 | (20 mol %) |
| M | I-47 | II-21 | III-10 | (20 mol %) |
| N | I-47 | II-21 | III-10 | (50 mol %) |
| O | I-7 | II-21 | (HQ) | (20 mol %) |

The sample (O) was prepared by using the following comparative compound (HQ) in place of the compound having the formula (III).

Comparative compound (HQ)

-continued

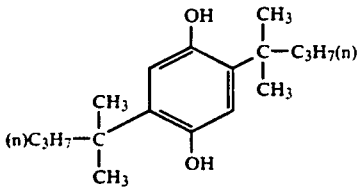

Each sample was gradation-exposed through a tricolor separation filter for sensitometry by using a sensitometer (FWH type, color temperature of light source: 3200° K., manufactured by Fuji Photo Film Co., Ltd.). Exposure time was 0.1 seconds and exposure was carried out so as to give an exposure amount of 250 CMS.

The exposed samples were processed in the following processing stages by using the following processing solutions and an automatic processor.

| Processing stage | Temperature (°C.) | Time |
|---|---|---|
| Color Development | 37 | 3 min. 30 sec. |
| Bleaching-Fixing | 33 | 1 min. 30 sec. |
| Rinsing | 24 to 34 | 3 min. |
| Drying | 70 to 80 | 1 min. |

Each processing solution had the following composition.

| | |
|---|---|
| Color developing solution: | |
| Water | 800 ml |
| Diethylenediaminepentaacetic acid | 1.0 g |
| Nitrilotriacetic acid | 2.0 g |
| Benzyl alcohol | 15 ml |
| Diethylene glycol | 10 ml |
| Sodium sulfite | 2.0 g |
| Potassium bromide | 1.0 g |
| Potassium carbonate | 30 g |
| N-Ethyl-N-(β-methanesulfonamidoethyl)-3-methyl-4-aminoaniline sulfate | 4.5 g |
| Hydroxylamine sulfate | 3.0 g |
| Fluorescent brightener (WHITEX 4B, a product of Sumitomo Chemical Co., Ltd.) | 1.0 g |
| Add water | 1000 ml |
| pH (25° C.) | 10.25 |
| Bleaching-fixing solution | |
| Water | 400 ml |
| Ammonium thiosulfate (70%) | 150 ml |
| Sodium sulfite | 18 g |
| Ethylenediaminetetraacetic acid iron(III) ammonium | 55 g |
| Disodium ethylenediamine-tetraacetate | 5 g |
| Add water | 1000 ml |
| pH (25° C.) | 6.70 |

The dye image (color image) of each of the thus-processed samples was subjected to a fastness test to light.

Fastness test to light

Each sample was irradiated with light for 21 days by using a xenon fade meter (100,000 lux). Dye image fastness and stain formation were evaluated.

Dye image fastness is represented by the residual dye ratio at an initial density of 2.0, 1.0 and 0.5. The results are shown in Table 2.

TABLE 2

| Sample No. | Magenta dye image fastness D = 2.0 | D = 1.0 | D = 0.5 | Stain (DB) | Remarks |
|---|---|---|---|---|---|
| A | 66(%) | 55(%) | 35(%) | 0.08 | Comp. Ex. |
| B | 54 | 35 | 23 | 0.20 | Comp. Ex. |
| C | 10 | 11 | 11 | 0.08 | Comp. Ex. |
| D | 9 | 10 | 11 | 0.09 | Comp. Ex. |
| E | 12 | 13 | 14 | 0.09 | Comp. Ex. |
| F | 65 | 57 | 55 | 0.08 | Invention |
| G | 45 | 52 | 56 | 0.08 | Invention |
| H | 67 | 60 | 63 | 0.08 | Invention |
| I | 77 | 65 | 70 | 0.08 | Invention |
| J | 66 | 62 | 65 | 0.08 | Invention |
| K | 65 | 61 | 64 | 0.08 | Invention |
| L | 67 | 63 | 65 | 0.08 | Invention |
| M | 64 | 58 | 59 | 0.08 | Invention |
| N | 75 | 64 | 69 | 0.08 | Invention |
| O | 35 | 30 | 20 | 0.08 | Comp. Ex. |

| | D = 2.0 | D = 1.0 | D = 0.5 |
|---|---|---|---|
| Yellow | 80(%) | 65(%) | 58(%) |
| Cyan | 75 | 67 | 63 |

Spectral absorption data for the dye image of each of the samples, A, B, G and L were as follows:

| Sample No. | D (540 nm) | D (435 nm) |
|---|---|---|
| A | 1.00 | 0.16 |
| B | 1.00 | 0.35 |
| G | 1.00 | 0.15 |
| L | 1.00 | 0.16 |

It is apparent from Table 2 that the samples containing the coupler having the formula (I) and the compound having the formula (II) according to the present invention scarecely caused secondary absorption in the yellow region, were excellent in color reproducibility and had greatly improved properties with regard to dye image fastness and the formation of stain by light, but had greatly reduced in density in low density region with respect to balance with yellow and cyan, and were not fully satisfying in these respects. The samples (D) and (E) wherein only the compound having the formula (III) according to the present invention is added to the coupler of formula (I), provided little improvement.

However, it is clear from samples (F) to (N) according to the present invention that when the compound of formula (II) and the compound of formula (III) are used in combination, fastness to light is highly balanced over a wide range from low density region to high density regions, and a good color balance between magenta, yellow and cyan was obtained. This effect is unique to the present invention, as can be seen from sample (0), wherein the comparative compound (HQ) was used in place of the compound of formula (III).

Further, it is clear from sample (G) that high density region is greatly deteriorated when the compound of formula (III-1) (where both substituent groups at the ortho-position to the hydroxyl group are tert-alkyl groups), is used in an amount of more than 30 mol %. It is not preferred that the compound of formula (III-1) where both substituent groups at the ortho-position to the hydroxyl group are tert-alkyl groups, is used in an amount of more than 30 mol %.

EXAMPLE 2

Both sides of a paper support were laminated with polyethylene. The resulting support was coated with the following layers to prepare a multi-layer color photographic paper having the following layer structure. Coating solutions were prepared in the following manner.

Preparation of coating solution for first layer 19.1 g of yellow coupler (ExY), 4.4 g of dye image stabilizer (Cpd-1) and 0.7 g of dye image stabilizer (Cpd-7) were dissolved in 27.2 cc of ethyl acetate and 8.2 g of solvent (Solv-3). The resulting solution was emulsified and dispersed in 185 cc of a 10% aqueous gelatin solution containing 8 cc of 10% sodium dodecylbenzenesulfonate. Separately, a silver chlorobromide emulsion [a 3:7 (by Ag mol) mixture of an emulsion (cubic, mean grain size: 0.88 μm, coefficient of variation in grain size distribution: 0.08) and an emulsion (cubic, mean grain size: 0.7 μm, coefficient of variation: 0.10), 0.2 mol % of silver bromide being localized on the surfaces of grains of both emulsions] was sulfur-sensitized. Before sulfur sensitization, $2.0\times10^{-4}$ mol (per mol of silver) of each of the following blue-sensitive sensitizing dyes was added to the larger-grain size emulsion, and $2.5\times10^{-4}$ mol (per mol of silver) of each of the following blue-sensitive sensitizing dyes was added to the smaller-gain size emulsion. The sulfur-sensitized emulsion and the above emulsified dispersion were mixed and dissolved. A coating solution for the first layer was prepared so as to give the following composition. In the same way as in the preparation of the coating solution for the first layer, coating solutions for the second layer to the seventh layer were prepared. The sodium salt of 1-oxy-3,5-dichloro-s-triazine was used as the hardening agent for each layer.

The following spectral sensitizing dyes for the following layers were used.

Blue-sensitive emulsion layer

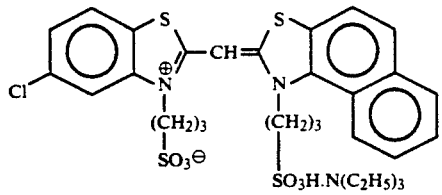

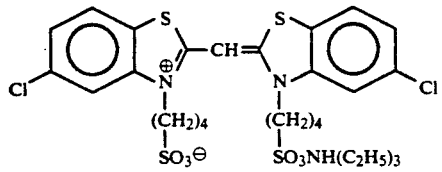

($2.0\times10^{-4}$ mol (per mol of silver halide) of each of the dyes was added to the larger-grain size emulsion. $2.5\times10^{-4}$ mol (per mol of silver halide) of each of the dyes was added to the smaller-grain size emulsion.)

Green-sensitive emulsion layer

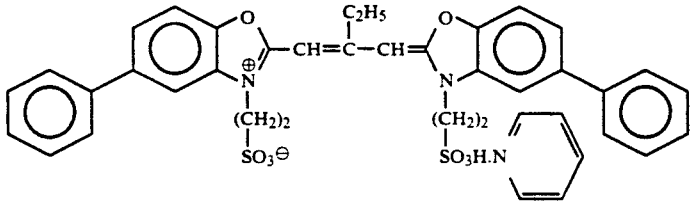

($4.0\times10^{-4}$ mol of the dye was added to the larger-grain size emulsion and $5.6\times10^{-4}$ mol of the dye was added to smaller-grain size emulsion, each amount being per mol of silver halide) and

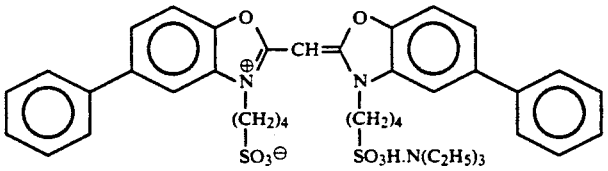

($7.0\times10^{-5}$ mol of the dye was added t larger-grain size emulsion and $1.0\times10^{-5}$ mol of the dye was added to smaller-grain size emulsion, each amount being per mol of silver halide.)

Red-sensitive emulsion layer

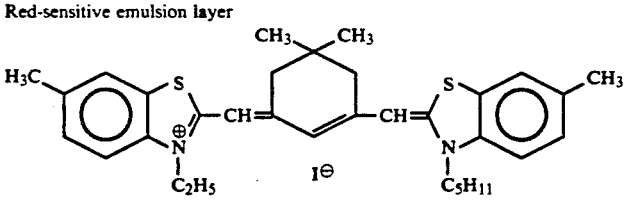

($0.9\times10^{-4}$ mol of the dye was added to larger-grain size emulsion and $1.1\times10^{-4}$ mol of the dye was added to smaller-grain size emulsion, each amount being per mol of silver halide.)

$2.6\times10^{-3}$ mol of the following compound per mol of silver halide was added to the red-sensitive emulsion layer.

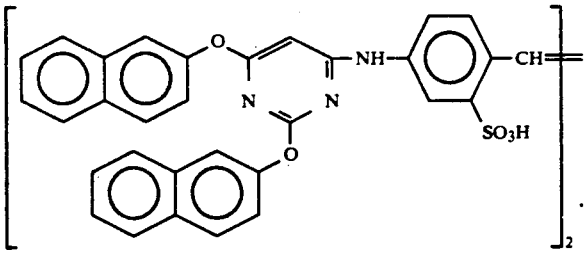

$8.5\times10^{-5}$ mol, $7.7\times10^{-4}$ mol and $2.5\times10^{-4}$ mol of 1-(5-methylureidophenyl)-5-mercaptotetrazole per mol of silver halide was added the the blue-sensitive emulsion, the green-sensitive emulsion and the red-sensitive emulsion, respectively.

The following dyes were added to the emulsions to prevent irradiation.

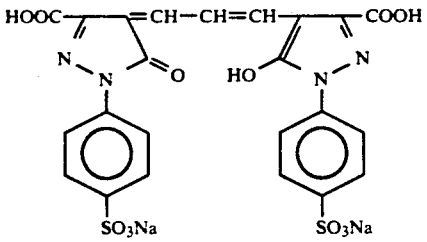

and

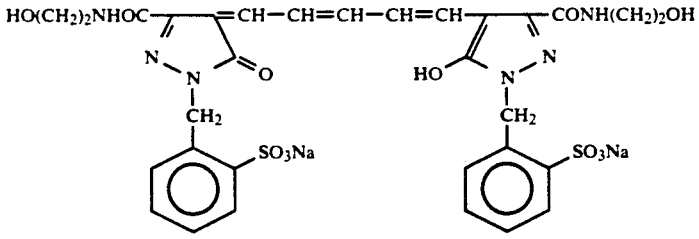

Layer structure

Each layer had the following composition. Numerals represent coating weight (g/m$^2$). The amounts of the silver halide emulsions are represented by coating weight in terms of silver.

Polyethylene-laminated support

[Polyethylene on the side of the first layer contains white pigment ($TiO_2$) and bluish dye (ultramarine)]

| | |
|---|---|
| First layer (blue-sensitive layer) | |
| The above silver chlorobromide emulsion | 0.30 |
| Gelatin | 1.86 |
| Yellow coupler (ExY) | 0.82 |
| Dye image stabilizer (Cpd-1) | 0.19 |
| Solvent (Solv-3) | 0.35 |
| Dye image stabilizer (Cpd-7) | 0.06 |
| Second layer (Color mixing inhibiting layer) | |
| Gelatin | 0.99 |
| Color mixing inhibitor (Cpd-5) | 0.08 |
| Solvent (Solv-1) | 0.16 |
| Solvent (Solv-4) | 0.08 |
| Third layer (green-sensitive layer) | |
| Silver chlorobromide emulsion [a 1:3 (by Ag mol) mixture of emulsion (cubic, mean grain size: 0.55 μm, coefficient of variation in grain size distribution: 0.10) and emulsion (cubic, mean grain size: 0.39 μm, coefficient of variation: 0.08), 0.86 mol % of AgBr being localized on the surfaces of grains of each emulsion] | 0.12 |
| Gelatin | 1.24 |
| Magenta coupler (I-7) | 0.20 |

-continued

| | |
|---|---|
| Dye image stabilizer (Cpd-2) | 0.03 |
| Dye image stabilizer (II-21) | 0.15 |
| Dye image stabilizer (Cpd-4) | 0.02 |
| Solvent (Solv-2) | 0.40 |
| Fourth layer (color mixing inhibiting layer) | |
| Gelatin | 1.58 |
| Ultraviolet light absorber (UV-1) | 0.47 |
| Color mixing inhibitor (Cpd-5) | 0.05 |
| Solvent (Solv-5) | 0.24 |
| Fifth layer (red-sensitive layer) | |
| Silver chlorobromide emulsion [a 1:4 (by Ag mol) mixture of emulsion (cubic, mean grain size: 0.58 μm, coefficient of variation in grain size distribution: 0.09) and emulsion (cubic, mean grain size: 0.45 μm, coefficient of variation: 0.11), 0.6 mol % of AgBr being partially localized on the surfaces of grains of each emulsion] | 0.23 |
| Gelatin | 1.34 |
| Cyan coupler (ExC) | 0.32 |
| Dye image stabilizer (Cpd-6) | 0.17 |
| Dye image stabilizer (Cpd-7) | 0.40 |
| Dye image stabilizer (Cpd-8) | 0.04 |
| Solvent (Solv-6) | 0.15 |
| Sixth layer (ultraviolet light absorbing layer) | |
| Gelatin | 0.53 |
| Ultraviolet light absorber (UV-1) | 0.16 |
| Color mixing inhibitor (Cpd-5) | 0.02 |
| Solvent (Solv-5) | 0.08 |
| Seventh layer (protective layer) | |
| Gelatin | 1.33 |
| Acrylic-modified copolymer of polyvinyl alcohol (a degree of modification: 17%) | 0.17 |
| Liquid paraffin | 0.03 |

(ExY) Yellow coupler

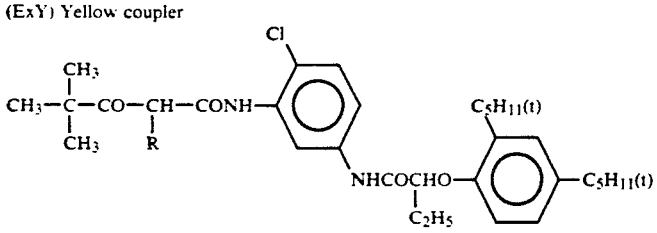

A 1:1 (by mol) mixture of

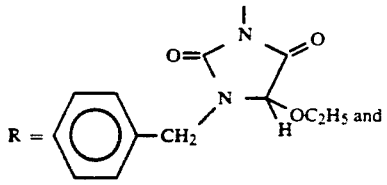

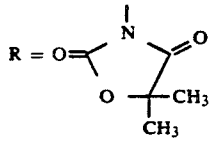

(ExC) Cyan coupler

A 2:4:4 (by weight) mixture of

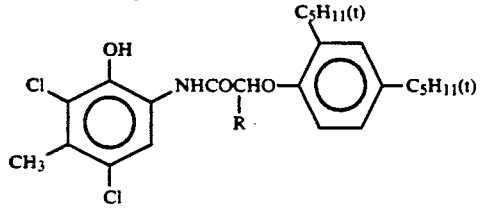

R = $C_2H_5$ and $C_4H_9$ and

-continued
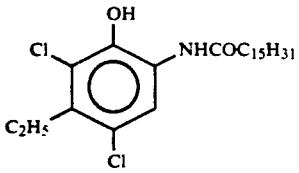
(Cpd-1) Dye image stabilizer
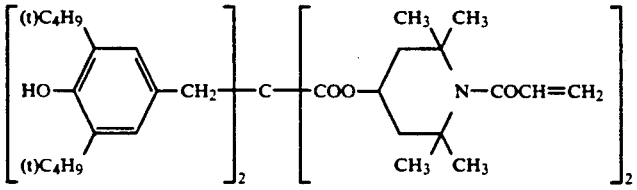
(Cpd-2) Dye image stabilizer
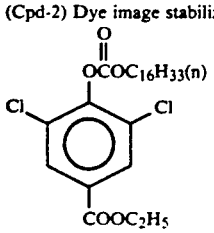
(Cpd-4) Dye image stabilizer
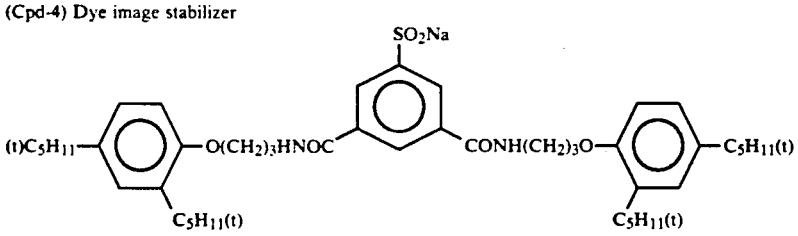
(Cpd-5) Color mixing inhibitor
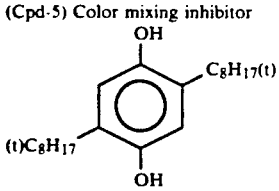
(Cpd-6) Dye image stabilizer
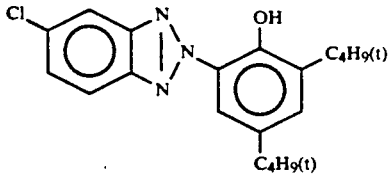
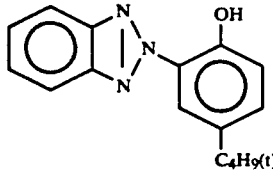
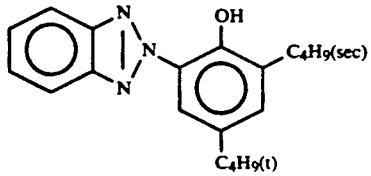
2:4:4 mixture (by weight)
(Cpd-7) Dye image stabilizer
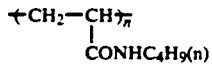
Average MW 60,000

-continued (Cpd-8) Dye image stabilizer

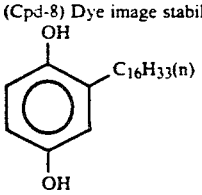

(UV-1) Ultraviolet light absorber

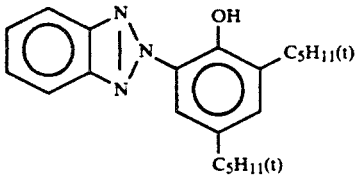

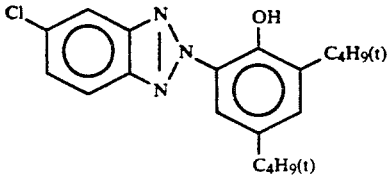

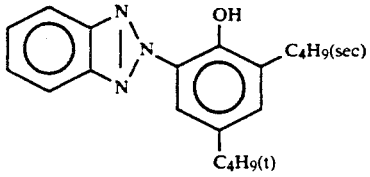

4:2:4 mixture (by weight)

(Solv-1) Solvent

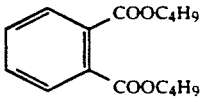

(Solv-2) Solvent

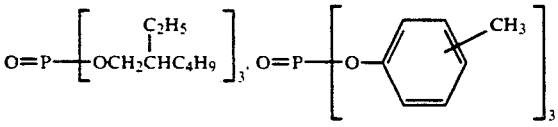

2:1 mixture (by volume)

(Solv-3) Solvent $O{=}P{+}O{-}C_9H_{19}(iso)]_3$ (Solv-4) Solvent

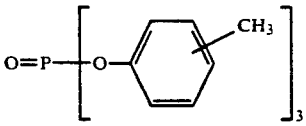

(Solv-5) Solvent $COOC_8H_{17}$
|
$(CH_2)_8$
|
$COOC_8H_{17}$ (Solv-6) Solvent

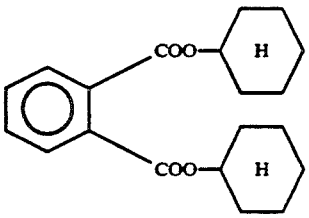

In this way, a multi-layer color photographic material (201) was prepared. Samples (202) to (217) were prepared in the same manner as in the preparation of the material (201) except that the compound given in Table 3 were used in the third layer.

TABLE 3

| Sample No. | Third layer (green-sensitive layer) Formula (I) | Formula (II) | Formula (III) | [Added amount based on the amount of coupler of formula (I)] |
|---|---|---|---|---|
| 201 | I-7 | II-21 | — | — |
| 202 | I-7 | II-21 | III-1 | (20 mol %) |
| 203 | I-7 | II-21 | III-4 | (20 mol %) |
| 204 | I-7 | II-21 | III-7 | (20 mol %) |
| 205 | I-7 | II-21 | III-7 | (50 mol %) |
| 206 | I-7 | II-21 | III-10 | (20 mol %) |
| 207 | I-7 | II-21 | III-10 | (50 mol %) |
| 208 | I-7 | II-21 | III-13 | (20 mol %) |
| 209 | I-7 | II-21 | III-17 | (20 mol %) |
| 210 | I-7 | II-21 | III-20 | (20 mol %) |
| 211 | I-7 | II-21 | III-22 | (20 mol %) |
| 212 | I-7 | II-21 | III-23 | (20 mol %) |
| 213 | I-8 | II-21 | III-10 | (20 mol %) |
| 214 | I-47 | II-21 | III-23 | (20 mol %) |
| 215 | I-7 | II-1 | III-10 | (20 mol %) |
| 216 | I-7 | II-11 | III-10 | (20 mol %) |
| 217 | I-7 | II-23 | III-10 | (20 mol %) |

Each sample was exposed according to the method described in Example 1. The exposed samples were subjected to running test in the following processing stages by using a paper processor until the color developing solution in an amount of twice as much as the capacity of the tank was replenished.

| Processing Stage | Temperature | Time | Replenisher* | Tank capacity |
|---|---|---|---|---|
| Color development | 35° C. | 45 sec | 161 ml | 17 l |
| Bleaching-fixing | 30-35° C. | 45 sec | 215 ml | 17 l |
| Rinse ① | 30-35° C. | 20 sec | — | 10 l |
| Rinse ② | 30-35° C. | 20 sec | — | 10 l |
| Rinse ③ | 30-35° C. | 20 sec | 350 ml | 10 l |
| Drying | 70-80° C. | 60 sec | | |

*Replenishment rate being per $m^2$ of photographic material
(Three tank countercurrent system of rinse ③ → ① was used.)

Each processing solution had the following composition.

| Color developing solution | Tank solution | Replenisher |
|---|---|---|
| Water | 800 ml | 800 ml |
| Ethylenediamine-N,N,N,N-tetramethylene phosphonic acid | 1.5 g | 2.0 g |
| Potassium bromide | 0.015 g | — |
| Triethanolamine | 8.0 g | 12.0 g |
| Sodium chloride | 1.4 g | — |
| Potassium carbonate | 25 g | 25 g |
| N-Ethyl-N-(β-methanesulfonamidoethyl)-3-methyl-4-aminoaniline sulfate | 5.0 g | 7.0 g |
| N,N-Bis(carboxymethyl) hydrazine | 5.5 g | 7.0 g |
| Fluorescent brightener (WHITEX 4B, a product of Sumitomo Chemical Co., Ltd.) | 1.0 g | 2.0 g |
| Add water | 1000 ml | 1000 ml |
| pH (25° C.) | 10.05 | 10.45 |

Bleaching-fixing solution (tank solution and replenisher being the same)

| | |
|---|---|
| Water | 400 ml |
| Ammonium thiosulfate (70%) | 100 ml |
| Sodium sulfite | 17 g |
| Ethylenediaminetetraacetic acid iron(III) ammonium | 55 g |
| Disodium ethlenediaminetetraacetate | 5 g |
| Ammonium bromide | 40 g |
| Add water | 1000 ml |

-continued

| | |
|---|---|
| pH (25° C.) | 6.0 |

Rinsing water (tank solution and replenisher being the same)

Ion-exchanged water (the content of each of calcium and magnesium being reduced to 3 ppm or lower).

The dye image of each of the thus-processed samples was subjected to a fastness test to light.

Fastness test to light

Each samples was irradiated with light for 21 days by using xenon fade meter (100,000 lux). Dye image fastness and stain formation were evaluated. Dye image fastness is represented by the residual dye ratio at an initial density of 2.0, 1.0 and 0.5. The results are shown in Table 4.

TABLE 4

| Sample No. | Magenta dye image fastness D = 2.0 | D = 1.0 | D = 0.5 | Stain (DB) | Remarks |
|---|---|---|---|---|---|
| 201 | 62(%) | 54(%) | 35(%) | 0.08 | Comp. Ex. |
| 202 | 60 | 55 | 52 | 0.09 | Invention |
| 203 | 64 | 57 | 55 | 0.08 | Invention |
| 204 | 60 | 55 | 52 | 0.08 | Invention |
| 205 | 43 | 51 | 53 | 0.09 | Invention |
| 206 | 65 | 58 | 59 | 0.08 | Invention |
| 207 | 72 | 64 | 66 | 0.08 | Invention |
| 208 | 67 | 59 | 59 | 0.08 | Invention |
| 209 | 60 | 55 | 52 | 0.08 | Invention |
| 210 | 59 | 53 | 50 | 0.08 | Invention |
| 211 | 62 | 55 | 54 | 0.08 | Invention |
| 212 | 67 | 60 | 61 | 0.08 | Invention |
| 213 | 64 | 58 | 59 | 0.08 | Invention |
| 214 | 61 | 57 | 58 | 0.08 | Invention |
| 215 | 60 | 56 | 56 | 0.08 | Invention |
| 216 | 64 | 57 | 58 | 0.08 | Invention |
| 217 | 62 | 55 | 55 | 0.08 | Invention |

Yellow and cyan dye image fastness was as follows:

| | D = 2.0 | D = 1.0 | D = 0.5 |
|---|---|---|---|
| Yellow | 75(%) | 62(%) | 53(%) |
| Cyan | 70 | 64 | 56 |

It is apparent from Table 4 that the samples of the present invention had improved fastness to light as in Example 1 and improved effects on the color balance between magenta, yellow and cyan were obtained.

EXAMPLE 3

Both sides of a paper support were laminated with polyethylene. The surfaces of the resulting support was subjected to corona discharge treatment. The support was then coated with the following layers to prepare a multi-layer photographic paper having the following layer structure. Coating solutions were prepared in the following manner.

Preparation of coating solution for first layer 60.0 g of yellow coupler (ExY) and 28.0 g of anti-fading agent (Cpd-1) were dissolved in 150 cc of ethyl acetate, 1.0 cc of solvent (Solv-3) and 3.0 cc of solvent (Solv-4). The resulting solution was added to 450 cc of a 10% aqueous gelatin solution containing sodium dodecylbenzenesulfonate. The mixture was dispersed by means of an ultrasonic homogenizer. The dispersion was mixed with 420 g of a silver chlorobromide emulsion (silver bromide 0.7 mol %) containing the following blue-sensitive sensitizing dye. The mixture was dissolved to prepare a coating solution for the first layer. In the same way as the coating solution for the first layer, coating solutions for the second layer to the seventh layer were prepared. As the hardening agent for gelation, 1,2-bis(vinylsulfonyl)ethane was used for each layer.

The following spectral sensitizing dyes were used for the following layers.

Blue-sensitive emulsion layer:

Anhydro-5,5'-dichloro-3,3'-disulfoethylthiacyanine hydroxide

Green-sensitive emulsion layer:

Anhydro-9-ethyl-5,5'-diphenyl-3,3'-di-sulfoethyloxacarbocyanine hydroxide

Red-sensitive emulsion layer:

3,3'-Diethyl-5-methoxy-9,11-neopentylthiadicarbocyanine iodide

The following stabilizers were used for each emulsion layer.

A 7:2:1 (by molar ratio) of mixture of the following A, B and C.

A: 1-(2-acetamino-phenyl-5-mercaptotetrazole

B: 1-phenyl-5-mercaptotetrazole

C: 1-(p-methoxyphenyl)-5-mercaptotetrazole

The following compounds were used as irradiation preventing dyes.

[3-Carboxy-5-hydroxy-4-(3-(3-carboxy-5-oxo-1-(2,5-bisulfonatophenyl)-2-pyrazoline-4-ylidene)-1-propenyl)-1-pyrazolyl]benzene-2,5-disulfonate disodium salt.

N,N'-(4,8-Dihydroxy-9,10-dioxo-3,7-disulfonatoanthracene-1,5-diyl)bis(aminomethanesulfonate)tetrasodium salt.

[3-Cyano-5-hydroxy-4-(3-(3-cyano-5-oxo-1-(4-sulfonatophenyl)-2-pyrazoline-4-ylidene)-1-pentanyl)-1-pyrazolyl]benzene-4-sulfonate sodium salt.

Layer structure

Each layer had the following composition. Numerals represent coating weight (g/m$^2$). The amounts of the silver halide emulsions are represented by coating weight in terms of silver.

Support

Paper support thick (both sides thereof being laminated with polyethylene and the surfaces being treated with corona discharge)

| | |
|---|---|
| First layer (blue-sensitive layer) | |
| The above silver chlorobromide emulsion (AgBr: 0.7 mol %, cubic, grain size: 0.9 μm) | 0.29 |
| Gelatin | 1.80 |
| Yellow coupler (ExY) | 0.60 |
| Anti-fading agent (Cpd-1) | 0.28 |
| Solvent (Solv-3) | 0.01 |
| Solvent (Solv-4) | 0.03 |
| Second layer (Color mixing inhibiting layer) | |
| Gelatin | 0.80 |
| Color mixing inhibitor (Cpd-2) | 0.055 |
| Solvent (Solv-1) | 0.03 |
| Solvent (Solv-2) | 0.015 |
| Third layer (green-sensitive layer) | |
| Silver chlorobromide emulsion (AgBr: 0.7 mol %, cubic, grain size: 0.45 μm) | 0.18 |
| Gelatin | 1.86 |
| Magenta coupler (ExM) | 0.27 |
| Anti-fading agent (Cpd-3) | 0.17 |
| Anti-fading agent (Cpd-4) | 0.10 |

-continued

| | |
|---|---|
| Solvent (Solv-1) | 0.20 |
| Solvent (Solv-2) | 0.03 |
| Fourth layer (color mixing inhibiting layer) | |
| Gelatin | 1.70 |
| Color mixing inhibitor (Cpd-2) | 0.065 |
| Ultraviolet light absorber (UV-1) | 0.45 |
| Ultraviolet light absorber (UV-2) | 0.23 |
| Solvent (Solv-1) | 0.05 |
| Solvent (Solv-2) | 0.05 |
| Fifth layer (red-sensitive layer) | |
| Silver chlorobromide emulsion (AgBr: 4 mol %, cubic, grain size: 0.5 μm) | 0.21 |
| Gelatin | 1.80 |
| Cyan coupler (ExC-1) | 0.26 |
| Cyan coupler (ExC-2) | 0.12 |
| Anti-fading agent (Cpd-1) | 0.20 |
| Solvent (Solv-1) | 0.16 |
| Solvent (Solv-2) | 0.09 |
| Color forming accelerator (Cpd-5) | 0.15 |
| Sixth layer (ultraviolet light absorbing layer) | |
| Gelatin | 0.70 |
| Ultraviolet light absorber (UV-1) | 0.26 |
| Ultraviolet light absorber (UV-2) | 0.07 |
| Solvent (Solv-1) | 0.30 |
| Solvent (Solv-2) | 0.09 |
| Seventh layer (protective layer) | |
| Gelatin | 1.07 |

The compounds used were as follows:

(ExY) yellow coupler

α-Pivalyl-α-(3-benzyl-1-hydantoinyl)-2-chloro-5-[β-(dodecylsulfonyl)butylamido]acetanilide (ExM) Magenta coupler 7-Chloro-6-isopropyl-3-[3-[(2-butoxy-5-tertoctyl)-benzenesulfonyl]propyl]-1H-pyrazolo[5,1C]-1,2,4-triazole (ExC-1) Cyan coupler 2-Pentafluorobenzamido-4-chloro-5-[2-(2,4-ditert-amylphenoxy)-3-methylbutylamidophenol (ExC-2) Cyan coupler 2,4-Dichloro-3-methyl-6-[α-(2,4-di-tert-amylphenoxy)butylamido]phenol (Cpd-1) Anti-fading agent $$\left(CH_2-\underset{\underset{CONHC_4H_9(n)}{|}}{CH}\right)_n \quad \text{Average MW 80,000}$$

(Cpd-2) Color mixing inhibitor 2,5-Di-tert-octylhydroquinone (Cpd-3) Anti-fading agent 7,7'-Dihydroxy-4,4,4',4'-tetra-methyl-2,2'-spiro-chroman (Cpd-4) Anti-fading agent N-(4-Dodecyloxyphenyl)-morpholine (Cpd-5) Color forming accelerator p-(p-Toluenesulfonamido)phenyl-dodecane (Solv-1) Solvent Di(2-ethylhexyl) phthalate (Solv-2) Solvent Dibutyl phthalate (Solv-3) Solvent Di(i-nonyl) phthalate (Solv-4) Solvent N,N-Diethylcarbonamido-methoxy-2,4-di-t-amylbenzene (UV-1) Ultraviolet light absorber 2-(2-Hydroxy-3,5-di-tert-amylphenyl)benzotriazole (UV-2) Ultraviolet light absorber 2-(2-Hydroxy-3,5-di-tert-butylphenyl)benzotriazole In this way, a multi-layer color photographic material (301) was prepared. Samples (302) to (310) were prepared in the same manner as in the preparation of the material (301) except that the compounds given in Table 5 were used in the third layer.

TABLE 5

| Sample No. | Third layer (green-sensitive layer) Cpd-3 | Cpd-4 | formula (II) | formula (III) |
|---|---|---|---|---|
| 301 | 0.17 | 0.10 | — | — |
| 302 | — | — | — | — |
| 303 | — | — | II-21 (100 mol %) | — |
| 304 | — | — | II-21 (100 mol %) | III-1 (20 mol %) |
| 305 | — | — | II-21 (100 mol %) | III-1 (50 mol %) |
| 306 | — | — | II-21 (100 mol %) | III-10 (20 mol %) |
| 307 | — | — | II-21 (100 mol %) | III-10 (50 mol %) |
| 308 | — | — | II-21 (100 mol %) | III-23 (20 mol %) |
| 309 | — | — | II-21 (100 mol %) | III-23 (50 mol %) |
| 310 | — | 0.10 | II-21 (100 mol %) | III-23 (20 mol %) |

In the columns of the compounds of formulas (II) and (III), parenthesized numerals in mol % under compound No. represent the amounts of added compounds based on the amount of the coupler.

These samples were exposed according to the method described in Example 1. Separately, different photographic materials were imagewise exposed. The resulting samples were subjected to a running test in the following processing stages by using a paper processor until the color developing solution in an amount of twice as much as the capacity of tank was replenished. The samples were then processed to obtain dye image.

| Processing Stage | Temperature | Time | Replenisher* | Tank capacity |
|---|---|---|---|---|
| Color development | 35° C. | 45 sec | 161 ml | 17 l |
| Bleaching-fixing | 30–36° C. | 45 sec | 215 ml | 17 l |
| Stabilization ① | 30–37° C. | 20 sec | — | 10 l |
| Stabilization ② | 30–37° C. | 20 sec | — | 10 l |
| Stabilization ③ | 30–37° C. | 20 sec | — | 10 l |
| Stabilization ④ | 30–37° C. | 30 sec | 248 ml | 10 l |
| Drying | 70–85° C. | 60 sec | | |

*Replenishment rate being per $m^2$ of photographic material (Four tank countercurrent system of stabilization ④ → ① was used.)

Each processing solution had the following composition.

| Color developing solution | Tank solution | Replenisher |
|---|---|---|
| Water | 800 ml | 800 ml |
| Ethylenediaminetetraacetic acid | 2.0 g | 2.0 g |
| 5,6-Dihydroxybenzene-1,2,4-trisulfonic acid | 0.3 g | 0.3 g |
| Triethanolamine | 8.0 g | 8.0 g |
| Sodium chloride | 1.4 g | — |
| Potassium carbonate | 25 g | 25 g |
| N-Ethyl-N-(β-methanesulfonamidoethyl)-3-methyl-4-aminoaniline sulfate | 5.0 g | 7.0 g |
| Diethylhydroxylamine | 4.2 g | 6.0 g |
| Fluorescent brightener (4,4'-diamino stilbene type) | 2.0 g | 2.5 g |
| Add water | 1000 ml | 1000 ml |
| pH (25° C.) | 10.05 | 10.45 |

| Bleaching-fixing solution (tank solution and replenisher being the same) | |
|---|---|
| Water | 400 ml |
| Ammonium thiosulfate (70%) | 100 ml |
| Sodium sulfite | 17 g |
| Ethylenediaminetetraacetic acid iron (III) ammonium | 55 g |
| Disodium ethylenediaminetetraacetate | 5 g |
| Glacial acetic acid | 9 g |
| Add water | 1000 ml |
| pH (25° C.) | 5.40 |

| Stabilizing solution (tank solution and replenisher being the same) | |
|---|---|
| Formalin (37%) | 0.1% |
| Formalin-sulfurous acid adduct | 0.7% |
| 5-Chloro-2-methyl-4-isothiazoline-3-one | 0.02 g |
| 2-Methyl-4-isothiazoline-3-one | 0.01 g |
| Copper sulfate | 0.005 g |
| Add water | 1000 ml |
| pH (25° C.) | 4.0 |

The dye image of each of the thus processed samples was subjected to a fastness test to light.

Fastness test to light

Each sample was irradiated with light for 12 days by using xenon fade meter (100,000 lx). Dye image fastness and stain formation were evaluated. Dye images fastness is represented by residual dye ratio at an initial density of 2.0, 1.0 and 0.5. The results are shown in Table 6.

TABLE 6

| Sample No. | Magenta dye image fastness D = 2.0 | D = 1.0 | D = 0.5 | Stain (DB) | Remarks |
|---|---|---|---|---|---|
| 301 | 55(%) | 46(%) | 39(%) | 0.10 | Comp. Ex. |
| 302 | 10 | 13 | 17 | 0.10 | Comp. Ex. |
| 303 | 80 | 58 | 44 | 0.10 | Comp. Ex. |
| 304 | 80 | 70 | 62 | 0.09 | Invention |
| 305 | 72 | 71 | 68 | 0.09 | Invention |
| 306 | 84 | 74 | 70 | 0.09 | Invention |
| 307 | 86 | 79 | 76 | 0.09 | Invention |
| 308 | 84 | 76 | 72 | 0.09 | Invention |
| 309 | 86 | 80 | 77 | 0.09 | Invention |
| 310 | 82 | 74 | 70 | 0.08 | Invention |

It is apparent from Table 6 that the samples of the present invention had greatly improved fastness to light as in Example 1, and improved effects on a color balance between magenta, yellow and cyan was obtained.

EXAMPLE 4

A paper support (both sides thereof being laminated with polyethylene) was multi-coated with the following first layer to twelfth layer to prepare a color photographic material. Polyethylene on the side of the first layer contained titanium white as a white pigment and a very small amount of ultramarine as a bluish dye.

Composition of sensitive layers

The following components in the following coating weight (g/m$^2$) were used. The amounts of silver halide are represented by coating weight in terms of silver.

| | |
|---|---|
| First layer (gelatin layer) | |
| Gelatin | 1.30 |
| Second layer (antihalation layer) | |
| Black colloidal layer | 0.10 |
| Gelatin | 0.70 |
| Third layer (low-sensitivity red-sensitive layer) | |
| Silver chloroiodobromide EM1 (silver chloride: 1 mol %, silver iodide: 4 mol %, mean grain size: 0.3 μm, size distribution: 10%, cubic, core iodine type core shell) spectrally-sensitized with red sensitizing dyes (ExS-1,2,3) | 0.06 |
| Silver iodobromide EM2 [silver chloride: 5 mol %, mean grain size: 0.45 μm, size distribution: 20%, tabular (aspect ratio: 5)] spectrally-sensitized with red sensitizing dyes (ExS-1,2,3) | 0.10 |
| Gelatin | 1.00 |
| Cyan coupler (ExC-1) | 0.14 |
| Cyan coupler (ExC-2) | 0.07 |
| Anti-fading agent (Cpd-2,3,4,9 in equal amounts) | 0.12 |
| Dispersion medium (Cpd-5) for coupler | 0.03 |
| Solvent (Solv-1,2,3) for coupler | 0.06 |
| Fourth layer (high-sensitivity red-sensitive layer) | |
| Silver iodobromide EM3 [silver iodide: 6 mol %, mean grain size: 0.75 μm, size distribution: 25%, tabular (aspect ratio: 8, core iodide type)] spectrally-sensitized with red sensitizing dyes (ExS-1,2,3) | 0.15 |
| Gelatin | 1.00 |
| Cyan coupler (ExC.-1) | 0.20 |
| Cyan coupler (ExC.-2) | 0.10 |
| Anti-fading agent (Cpd-2,3,4,9 in equal amounts) | 0.15 |
| Dispersion medium (Cpd-5) for coupler | 0.03 |
| Solvent (Solv-1,2,3) for coupler | 0.10 |
| Fifth layer (intermediate layer) | |
| Magenta collidal silver | 0.02 |
| Gelatin | 1.00 |
| Anti-fading agent (Cpd-6,7) | 0.08 |
| Solvent (Solv-4,5) for anti-fading agent | 0.16 |
| Polymer latex (Cpd-8) | 0.10 |
| Sixth layer (low-sensitivity green-sensitive layer) | |
| Silver chloroiodobromide EM4 (silver chloride: 1 mol %, silver iodide: 2.5 mol %, mean grain size: 0.28 μm, grain size distribution: 12%, cubic, core iodide type core shell) spectrally-sensitized with green sensitizing dye (ExS-3) | |
| Emulsion A spectral-sensitized with green sensitizing dye (ExS-3) | 0.04 |
| Silver iodobromide EM5 [silver iodide: 2.8 mol %, mean grain size: 0.45 μm, grain size distribution: 12%, tabular (aspect ratio: 5)] spectrally-sensitized with green sensitizing dye (ExS-3) | 0.06 |
| Gelatin | 0.80 |
| Magenta coupler (ExM-1) | 0.10 |
| Stain inhibitor (Cpd-10) | 0.01 |
| Stain inhibitor (Cpd-11) | 0.001 |

-continued

| | |
|---|---|
| Stain inhibitor (Cpd-12) | 0.01 |
| Dispersion medium (Cpd-5) for coupler | 0.05 |
| Solvent (Solv-4,6) for coupler | 0.15 |
| Seventh layer (high-sensitivity green-sensitive layer) | |
| Silver iodobromide EM6 [silver iodide: 3.5 mol %, mean grain size: 0.9 μm, grain size distribution: 23%, tabular (aspect ratio: 9, uniform iodide type)] spectrally-sensitized with green sensitizing dye (ExS-3) | 0.10 |
| Gelatin | 0.80 |
| Magenta coupler (ExM-1) | 0.10 |
| Stain inhibitor (Cpd-10) | 0.01 |
| Stain inhibitor (Cpd-11) | 0.001 |
| Stain inhibitor (Cpd-12) | 0.01 |
| Dispersion medium (Cpd-5) for coupler | 0.05 |
| Solvent (Solv-4,6) for coupler | 0.15 |
| Eighth layer (yellow filter layer) | |
| Yellow colloidal silver | 0.20 |
| Gelatin | 1.00 |
| Anti-fading agent (Cpd-7) | 0.06 |
| Solvent (Solv-4,5) for anti-fading agent | 0.15 |
| Polymer latex (Cpd-8) | 0.10 |
| Ninth layer (low sensitivity blue-sensitive layer) | |
| Silver chloroiodobromide EM7 (silver chloride: 2 mol %, silver iodide: 2.5 mol %, mean grain size: 0.35 μm, grain size distribution: 8%, cubic, core iodide type core/shell) spectrally-sensitized with blue sensitizing dyes (ExS-5,6) | 0.07 |
| Silver iodobromide EM8 [silver iodobromide: 2.5 mol %, mean grain size: 0.45 μm, grain size distribution: 16%, tabular (aspect ratio: 6)] spectrally-sensitized with blue sensitizing dyes (ExS-5,6) | 0.10 |
| Gelatin | 0.50 |
| Yellow coupler (ExY-1) | 0.20 |
| Stain inhibitor (Cpd-11) | 0.001 |
| Anti-fading agent (Cpd-6) | 0.10 |
| Dispersion medium (Cpd-5) for coupler | 0.05 |
| Solvent (Solv-2) for coupler | 0.05 |
| Tenth layer (high-sensitivity blue-sensitive layer) | |
| Silver iodobromide EM9 [silver iodide: 2.5 mol %, mean grain size: 1.2 μm, grain size distribution: 21%, tabular (aspect ratio: 14)] spectrally-sensitized with blue sensitizing dyes (ExS-5,6) | 0.25 |
| Gelatin | 1.00 |
| Yellow coupler (ExY-1) | 0.40 |
| Stain inhibitor (Cpd-11) | 0.002 |
| Anti-fading agent (Cpd-6) | 0.10 |
| Dispersion medium (Cpd-5) for coupler | 0.15 |
| Solvent (Solv-2) for solvent | 0.10 |
| Eleventh layer (ultraviolet light absorbing layer) | |
| Gelatin | 1.50 |
| Ultraviolet light absorber (Cpd-1,3,13) | 1.00 |
| Color mixing inhibitor (Cpd-6,14) | 0.06 |
| Dispersion medium (Cpd-5) | |
| Solvent (Solv-1,2) for ultraviolet light absorber | 0.15 |
| Irradiation-preventing dye (Cpd-15,16) | 0.02 |
| Irradiation-preventing dye (Cpd-17,18) | 0.02 |
| Twelfth layer (protective layer) | |
| Fine grains of silver chlorobromide (silver chloride: 97 mol %, mean grain size: 0.2 μm) | 0.07 |
| Modilied POVA1 | 0.02 |
| Gelatin | 1.50 |
| Hardener (H-1) for gelatin | 0.17 |

Further, Alkanol XC (Du Pont) and sodium alkylbenzenesulfonate as emulsion dispersion aids, succinic ester and Magefac F-120 (a product of Dainippon Ink & Chemical Inc.) as coating aids were used for each layer. Compounds (Cpd-19, 20, 21) as stabilizers were used for silver halide or colloidal silver-containing layers. The following compounds were used in this example.

ExS-1
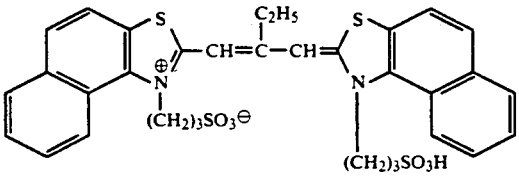
ExS-2
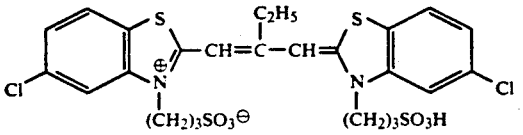
ExS-3
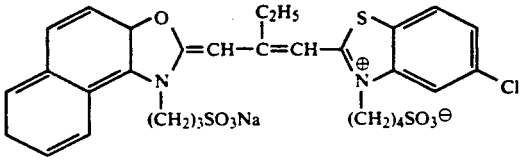
ExS-4
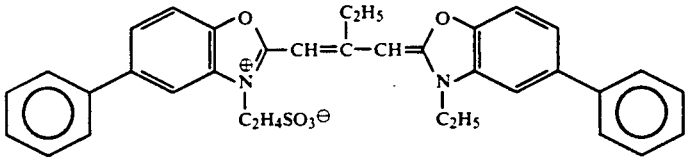
ExS-5
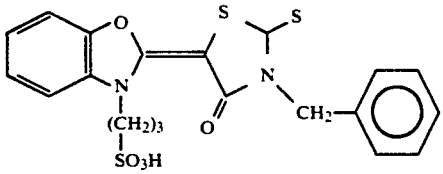
Cpd-1
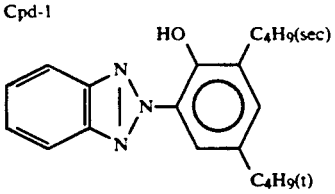
Cpd-2
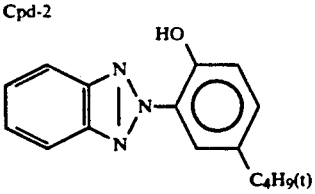
Cpd-3
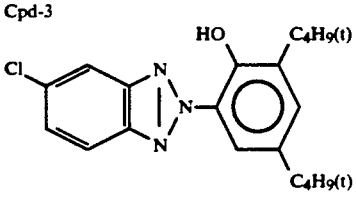
Cpd-4

-continued
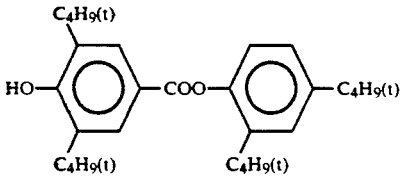
Cpd-5
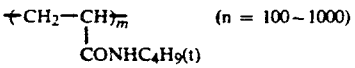
(n = 100~1000)
Cpd-6
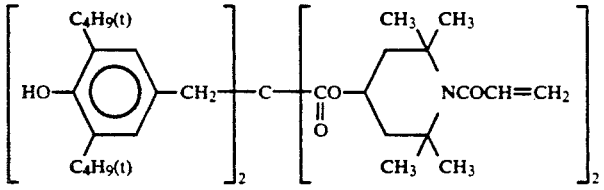
Cpd-7
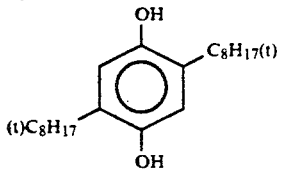
Cpd-8
Polyethylacrylate
Cpd-10
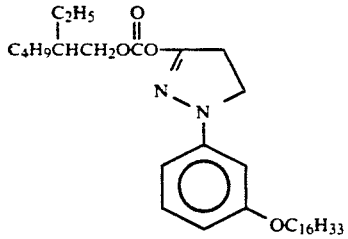
Cpd-11
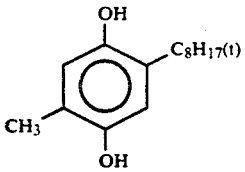
Cpd-12
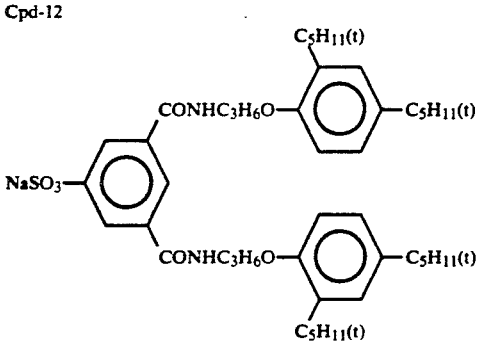
Cpd-13

-continued
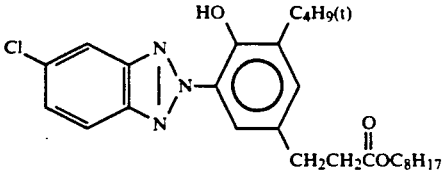
Cpd-14
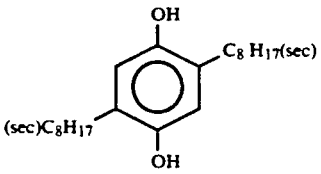
Cpd-15
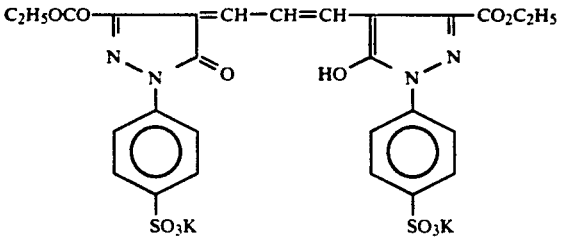
Cpd-16
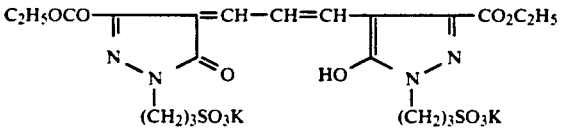
Cpd-17
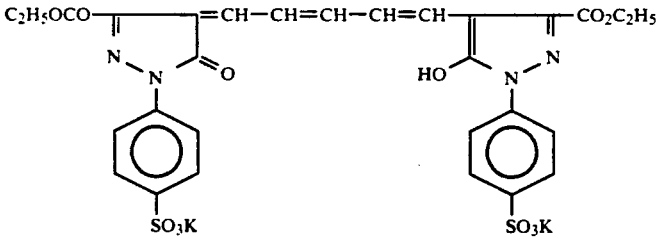
Cpd-18
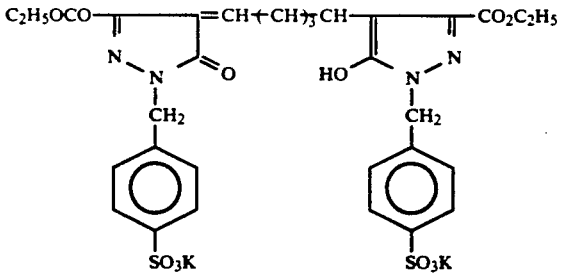
Cpd-19
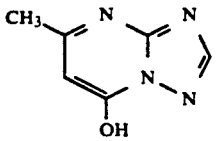
Cpd-20

-continued
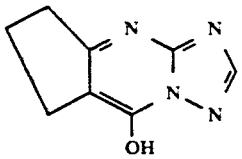
Cpd-21
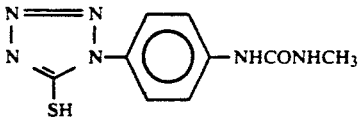
ExC-1
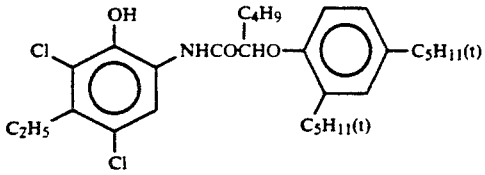
ExC-2
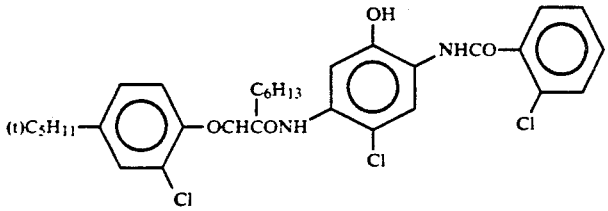
ExM-1
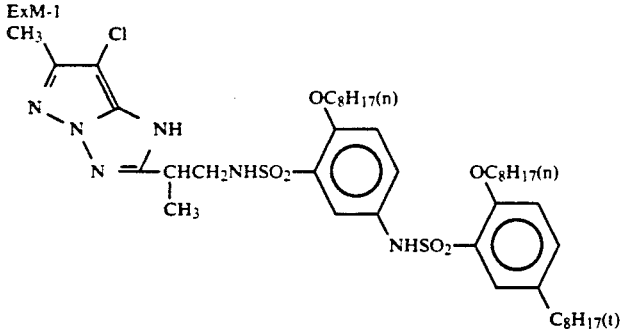
ExY-1
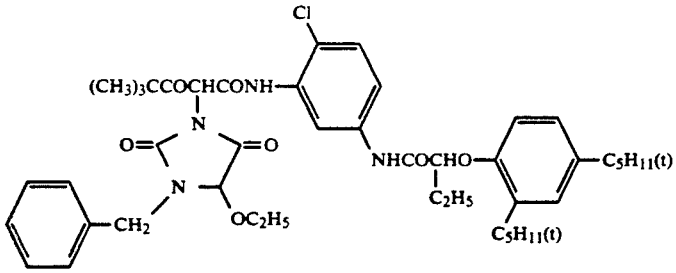
Solv-1
Di(2-ethylhexyl) phthalate
Solv-2
Trinonyl phosphate
Solv-3
Di(3-methylhexyl) phthalate
Solv-4
Trioresyl phosphate
Solv-5
Dibutyl phthalate
Solv-6
Trioctyl phosphate Solv-7

1,2-Bis(vinylsulfonylacetamido)ethane

Emulsion A

Preparation of a monodisperse emulsion having a (100) crystal habit

An aqueous solution of silver nitrate and an aqueous solution containing KBr and KI were added to an aqueous gelatin solution kept at 70° C. by double jet process while keeping pBr at 4.5 to prepare a monodisperse emulsion (edge length: 0.68 μm) having a (100) crystal habit. This core emulsion was divided into three. Shells were formed under the following separate conditions to prepare final grains having a grain size of 0.7 μm and an AgI content of 3 mol %.

Sodium thiosulfate and potassium chloroaurate were added to the cores and chemical sensitization was carried out. Shells were then precipitated under the same conditions as in the preparation of the core.

In this way, a multi-layer photographic material (401) was prepared. The compounds of formulas (II) and (III) in an amount given in Table 7 were added to both the sixth and seventh layers of the multi-layer photographic material (401) to prepare samples (402) to (408).

TABLE 7

| Sample No. | Formula (II) (added amount) | Formula (III) (Added amount) |
|---|---|---|
| 401 | — | — |
| 402 | II-21 (100 mol %) | — |
| 403 | — | III-1 (100 mol %) |
| 404 | — | III-10 (100 mol %) |
| 405 | II-21 (100 mol %) | III-1 (20 mol %) |
| 406 | II-21 (100 mol %) | III-1 (50 mol %) |
| 407 | II-21 (100 mol %) | III-10 (20 mol %) |
| 408 | II-21 (100 mol %) | III-10 (50 mol %) |

The added amounts are based on the amount of the magenta coupler.

Each sample was exposed according to the method described in Example 1. The exposed samples were processed in the following processing stages.

| Processing stage | | |
|---|---|---|
| First development (black-and-white development) | 38° C. | 75 sec. |
| Rinsing | 38° C. | 90 sec. |
| Reversal exposure | at least 100 lux | at least 60 sec. |
| Color development | 38° C. | 135 sec. |
| Rinsing | 38° C. | 45 sec. |
| Bleaching-fixing | 38° C. | 120 sec. |
| Rinsing | 38° C. | 135 sec. |
| Drying | | |

Each processing solution had the following composition.

| | |
|---|---|
| First developing solution | |
| Pentasodium salt of nitrilo-N,N,N-trimethylenephosphonic acid | 0.6 g |
| Pentasodium diethylenetriamine-pentaacetate | 4.0 g |
| Potassium sulfite | 30.0 g |
| Potassium thiocyanate | 1.2 g |
| Potassium carbonate | 35.0 g |
| Hydroquinonemonosulfonate potassium salt | 25.0 g |
| Diethylene glycol | 15.0 ml |

-continued

| | |
|---|---|
| 1-Phenyl-4-hydroxymethyl-4-methyl-3-pyrazolidone | 2.0 g |
| Potassium bromide | 0.5 g |
| Potassium iodide | 5.0 g |
| Add water (pH 9.70) | 1 liter |
| Color developing solution | |
| Benzyl alcohol | 15.0 ml |
| Diethylene glycol | 12.0 ml |
| 3,6-Dithia-1,8-octanediol | 0.2 g |
| Pentasodium salt of nitrilo-N,N,N-trimethylenephosphonic acid | 0.5 g |
| Pentasodium diethylenetriamine-pentaacetate | 2.0 g |
| Sodium sulfite | 2.0 g |
| Potassium carbonate | 25.0 g |
| Hydroxylamine sulfate | 3.0 g |
| N-Ethyl-N-(β-methanesulfonamido-ethyl)-3-methyl-4-aminoaniline sulfate | 5.0 g |
| Potassium bromide | 0.5 g |
| Potassium iodide | 1.0 g |
| Add water (pH 10.40) | 1 liter |
| Bleaching-fixing solution | |
| 2-Mercapto-1,3,4-triazole | 1.0 g |
| Disodium ethylenediaminetetraacetate dihydrate | 5.0 g |
| Ethylenediaminetetraacetic acid Fe(III) ammonium monohydrate | 80.0 g |
| Sodium sulfite | 15.0 g |
| Sodium thiosulfate (solution of 700 g/l) | 160.0 ml |
| Glacial acetic acid | 5.0 ml |
| Add water (pH 6.50) | 1 liter |

The thus-processed samples were subjected to a dry image fastness test to light in the same way as in Example 1. Good results were obtained as in Example 1.

EXAMPLE 5

The surface side of a paper support (thickness: 100 μm, both sides thereof being laminated with polyethylene) was multi-coated with the following first to fourteenth layers and the back side thereof was coated with the following fifteenth and sixteenth layers to prepare a color photographic material. The polyethylene on the side of the first layer contained titanium oxide (4 g/m$^2$) as white pigment and a very small amount of ultramarine (0.003 g/m$^2$) as bluish dye (the chromaticity of the surface of the support was 88.0, −0.20 and −0.75 in L*, a*, b* system).

Compositions of sensitive layers

The following components in the following coating weight (g/m$^2$) were used. The emulsion of each layer was prepared according to the method for preparing the emulsion EMI except that the emulsion of the fourteenth layer was a Lippmann emulsion which was not subjected to surface chemical sensitization.

| | |
|---|---|
| First Layer (antihalation layer) | |
| Back colloidal silver | 0.10 |
| Gelatin | 0.70 |
| Second Layer (intermediate layer) | |
| Gelatin | 0.70 |
| Third Layer (low-sensitivity red-sensitive layer) | |
| Silver bromide (mean grain size: 0.25 μm, size distribution (coefficient of variation): 8%, octahedral) spectrally-sensitized with red sensitizing dyes (ExS-1, 2, 3) | 0.04 |
| Silver chlorobromide (silver chloride: 5 mol %, mean grain size: 0.40 μm, size | 0.08 |

-continued

| | |
|---|---|
| distribution: 10%, octahedral) spectrally-sensitized with red sensitizing dyes (ExS-1, 2, 3) | |
| Gelatin | 1.00 |
| Cyan coupler (ExC-1, 2, 3 = 1:1:0.2) | 0.30 |
| Anti-fading agent (Cpd-1, 2, 3, 4 in equal amounts) | 0.18 |
| Stain inhibitor (Cpd-5) | 0.003 |
| Dispersion medium (Cpd-6) for coupler | 0.03 |
| Solvent (Solv-1, 2, 3 in equal amount) for coupler | 0.12 |
| Fourth Layer (high-sensitivity red-sensitive layer) | |
| Silver bromide (mean grain size: 0.60 μm, size distribution: 15%, octahedral) spectrally-sensitized with red sensitizing dyes (ExS-1, 2, 3) | 0.14 |
| Gelatin | 1.00 |
| Cyan coupler (ExC-1, 2, 3 = 1:1:0.2) | 0.30 |
| Anti-fading (Cpd-2, 3, 4 in equal amounts) | 0.18 |
| Dispersion medium (Cpd-6) for coupler | 0.03 |
| Solvent (Solv-1, 2, 3 in equal amounts) for coupler | 0.12 |
| Fifth Layer (intermediate layer) | |
| Gelatin | 1.00 |
| Color mixing inhibitor (Cpd-7) | 0.08 |
| Solvent (Solv-4, 5 in equal amounts) for color mixing inhibitor | 0.16 |
| Polymer latex (Cpd-8) | 0.10 |
| Sixth Layer (low-sensitivity green-sensitive layer) | |
| Silver bromide (mean grain size: 0.25 μm, size distribution: 8%, octahedral) spectrally-sensitized with green sensitizing dye (ExS-4) | 0.04 |
| Silver chlorobromide (silver chloride: 5 mol %, mean grain size: 0.40 μm, size distribution: 10%, octahedral) spectrally-sensitized with green sensitizing dye (ExS-4) | 0.06 |
| Gelatin | 0.80 |
| Magenta coupler (ExM-1, 2, 3 in equal amounts) | 0.11 |
| Anti-fading agent (Cpd-26) | 0.07 |
| Stain inhibitor (Cpd-10, 11, 12, 13 = 10:7:7:1) | 0.025 |
| Dispersion medium (Cpd-6) for coupler | 0.05 |
| Solvent (Solv-4, 6 in equal amounts) for coupler | 0.15 |
| Seventh Layer (high-sensitivity green-sensitive layer) | |
| Silver bromide (mean grain size: 0.65 μm, size distribution: 16%, octahedral) spectrally-sensitized with green sensitizing dye (ExS-4) | 0.10 |
| Gelatin | 0.80 |
| Magenta coupler (ExM-1, 2, 3 in equal amounts) | 0.11 |
| Anti-fading agent (Cpd-26) | 0.07 |
| Stain inhibitor (Cpd-10, 11, 12, 13 = 10:7:7:1) | 0.025 |
| Dispersion medium (Cpd-6) for coupler | 0.05 |
| Solvent (Solv-4, 6 in equal amounts) for coupler | 0.15 |
| Eighth Layer (intermediate layer) | |
| The same as the fifth layer | |
| Ninth Layer (yellow filter layer) | |
| Yellow colloidal silver (grain size: 100Å) | 0.12 |
| Gelatin | 0.70 |
| Color mixing inhibitor (Cpd-7) | 0.03 |
| Solvent (Solv-4, 5 in equal amounts) for color mixing inhibitor | 0.10 |
| Polymer latex (Cpd-8) | 0.07 |
| Tenth Layer (intermediate layer) | |
| The same as the fifth layer | |
| Eleventh Layer (low-sensitivity blue-sensitive layer) | |
| Silver bromide (mean grain size: 0.40 μm, size distribution: 8%, octahedral) spectrally-sensitized with blue sensitizing dyes (ExS-5, 6) | 0.07 |
| Silver chlorobromide (silver chloride: 8 mol %, mean grain size: 0.60 μm, size distribution: 11%, octahedral) spectrally-sensitized with blue sensitizing dyes (ExS-5, 6) | 0.14 |
| Gelatin | 0.80 |
| Yellow coupler (ExY-1, 2 in equal amounts) | 0.35 |
| Anti-fading agent (Cpd-14) | 0.10 |
| Stain inhibitor (Cpd-5, 15 = 1:5 by ratio) | 0.007 |
| Dispersion medium (Cpd-6) for coupler | 0.05 |
| Solvent (Solv-2) for coupler | 0.10 |
| Twelfth Layer (high-sensitivity blue-sensitive layer) | |
| Silver bromide (mean grain size: 0.85 μm, size distribution: 18%, octahedral) spectrally-sensitized with blue sensitizing dyes (ExS-5, 6) | 0.15 |
| Gelatin | 0.60 |
| Yellow coupler (ExY-1, 2 in equal amounts) | 0.30 |
| Anti-fading agent (Cpd-14) | 0.10 |
| Stain inhibitor (Cpd-5, 15 in a ratio of 1:5) | 0.007 |
| Dispersion medium (Cpd-6) for coupler | 0.05 |
| Solvent (Solv-2) for coupler | 0.10 |
| Thirteenth Layer (ultraviolet light absorbing layer) | |
| Gelatin | 1.00 |
| Ultraviolet light absorber (Cpd-2, 4, 16 in equal amounts) | 0.50 |
| Color mixing inhibitor (Cpd-7, 17 in equal amounts) | 0.03 |
| Dispersion medium (Cpd-6) | 0.02 |
| Solvent (Solv-2, 7 in equal amounts) for ultraviolet light absorber | 0.08 |
| Irradiation preventing dye (Cpd-18, 19, 20, 21, 27 in a ratio of 10:10:13:15:20) | 0.05 |
| Fourteenth Layer (protective layer) | |
| Fine grains of silver chlorobromide (silver chloride: 97 mol %, mean grain size: 0.1 μm) | 0.03 |
| Acrylic-modified copolymer of polyvinyl alcohol (MW = 50,000) | 0.01 |
| Polymethyl methacrylate particles (average particle size: 2.4μ) and silicon oxide (average particle size: 5μ) in equal amounts | 0.05 |
| Gelatin | 1.80 |
| Hardener (H-1, H-2 in equal amounts) for gelatin | 0.18 |
| Fifteenth Layer (back layer) | |
| Gelatin | 2.50 |
| Ultraviolet light absorber (Cpd-2, 4, 16 in equal amounts) | 0.50 |
| Dyes (Cpd-18, 19, 20, 21, 27 in equal amounts) | 0.06 |
| Sixteenth Layer (protective layer for the back) | |
| Polymethyl methacrylate particles (average particle size: 2.4 μm) and silicon oxide (average particle size: 5 μm) in equal amounts | 0.05 |
| Gelatin | 2.00 |
| Hardener (H-1, H-2 in equal amounts) for gelation | 0.14 |

Preparation of emulsion EM-1

An aqueous solution of silver nitrate and potassium bromide were simultaneously added to an aqueous gelatin solution with vigorously stirring at 75° C. over a period of 15 minutes to obtain octahedral silver bromide grains having a mean grain size of 0.35 μm. In the course of the preparation of the grains, 0.3 g of 3,4-dimethyl-1,3-thiazoline-2-thione per mol of silver was added. 6 mg of sodium thiosulfate and then 7 mg of chloroauric acid tetrahydrate were added to the above emulsion, each amount being per mol of silver. The mixture was heated at 75° C. for 80 minutes to carry out chemical sensitization. The resulting grains as a core were further grown under the same precipitation conditions as those first used. There was finally obtained an octahedral monodisperse core/shell type silver bromide emulsion having a mean grain size of 0.7 μm. The coefficient of variation in grain size was about 10%, 1.5 mg of sodium thiosulfate and 1.5 mg of chloroauric acid tetrahydrate were added to the emulsion, each amount being per mol of silver. The mixture was heated at 60° C. for 60 minutes to carry out chemical sensitization, thus obtaining an internal latent image type silver halide emulsion.

$10^{-3}$ wt. % of ExZK-1 and $10^{-2}$ wt. % of ExZK-2 as nucleating agents and $10^{-2}$ wt. % of Cpd-22 as a nucleating accelerator were used in each sensitive layer, each amount being based on the amount of silver halide. Further, Alkanol XC (Du Pont) and sodium alkylbenzenesulfonate as emulsion dispersion aids, succinic ester and Magefac F-120 (Dainippon Ink & Chemicals Inc.) as coating aids were used in each layer. Compounds (Cpd-23, 24, 25) as stabilizers were used for silver halide and colloidal silver-containing layers. The thus-prepared sample was referred to as sample 501. The following compounds were used in this example.

ExS-1

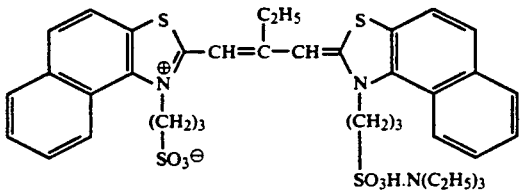

ExS-2

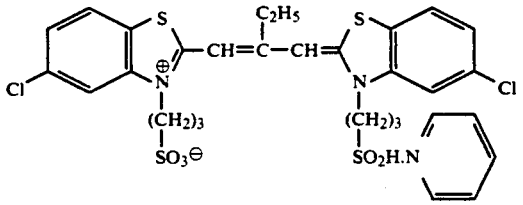

ExS-3

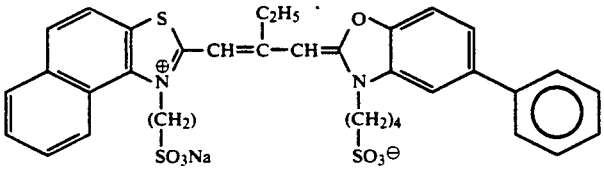

ExS-4

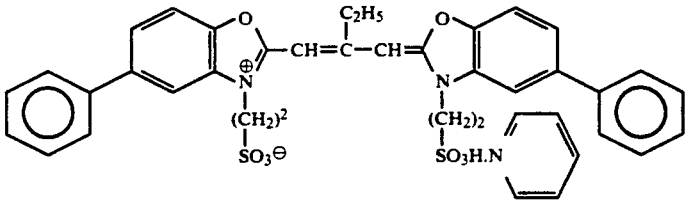

ExS-5

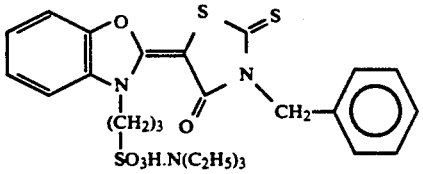

ExS-6

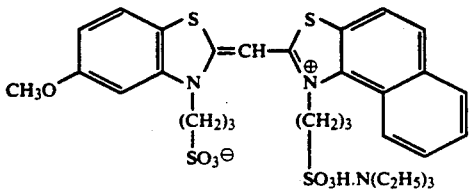

Cpd-1

-continued
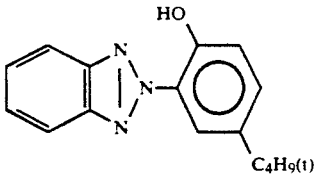
Cpd-2
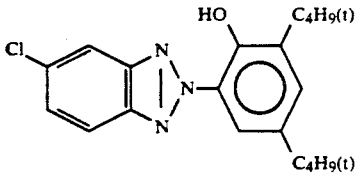
Cpd-3
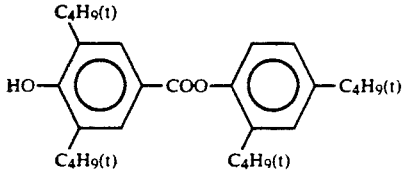
Cpd-4
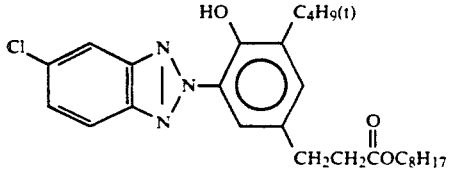
Cpd-5
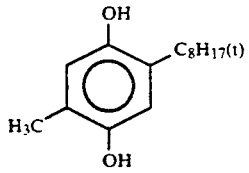
Cpd-6
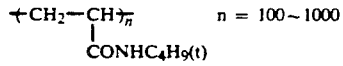
n = 100 ~ 1000
Cpd-7
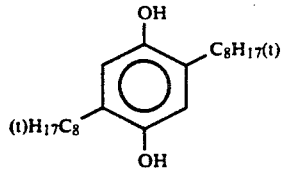
Cpd-8
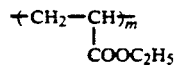
Cpd-10

-continued
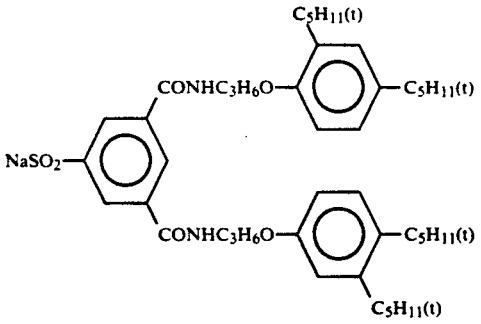
Cpd-11
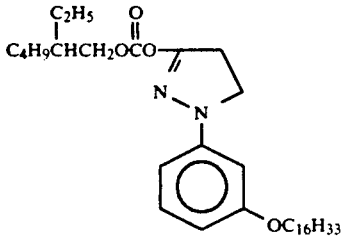
Cpd-12
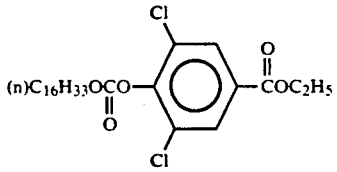
Cpd-13
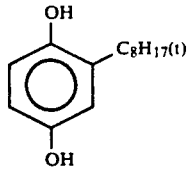
Cpd-14
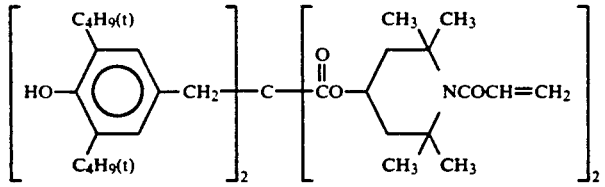
Cpd-15
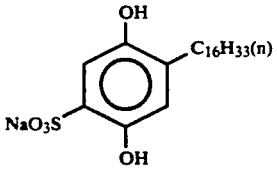
Cpd-16
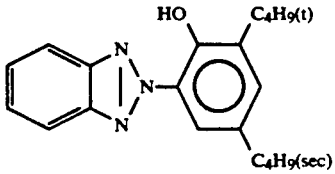
Cpd-17

-continued
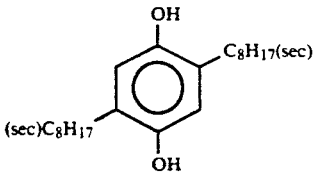
Cpd-18
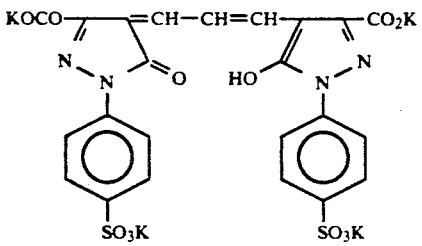
Cpd-19
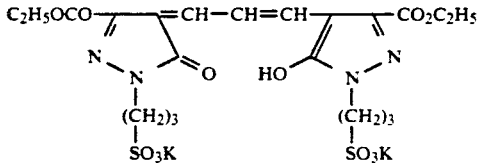
Cpd-20
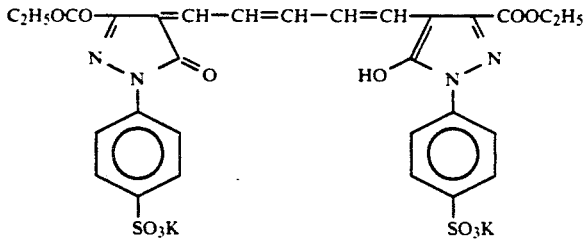
Cpd-21
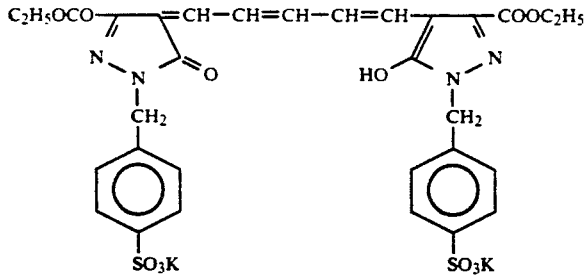
Cpd-22
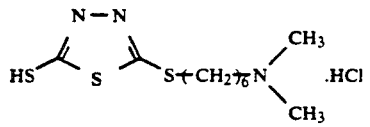
Cpd-23
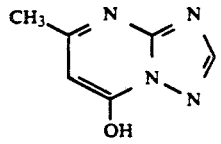
Cpd-24

-continued
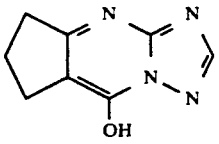
Cpd-25
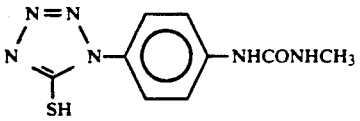
Cpd-26
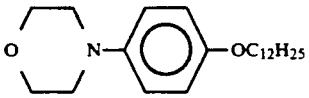
Cpd-27
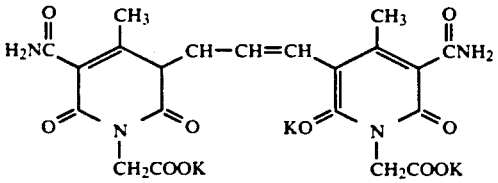
ExC-1
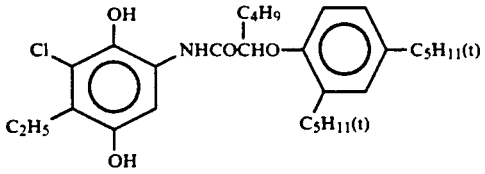
ExC-2
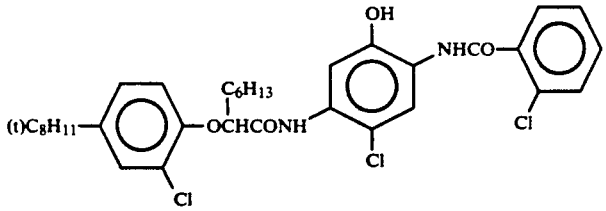
ExC-3
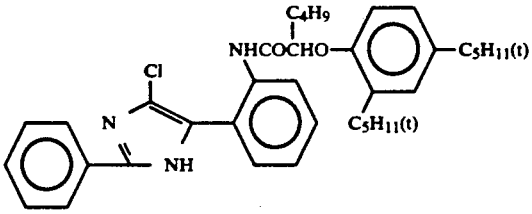
EXM-1

-continued
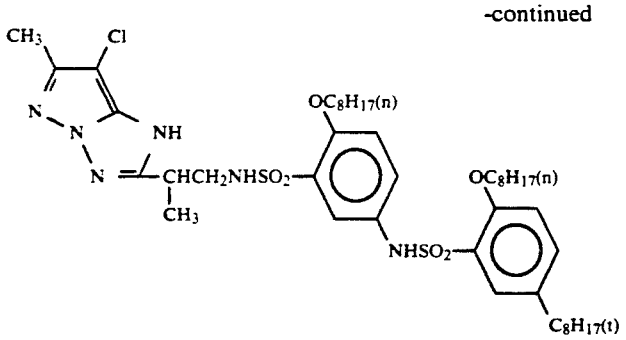
EXM-2
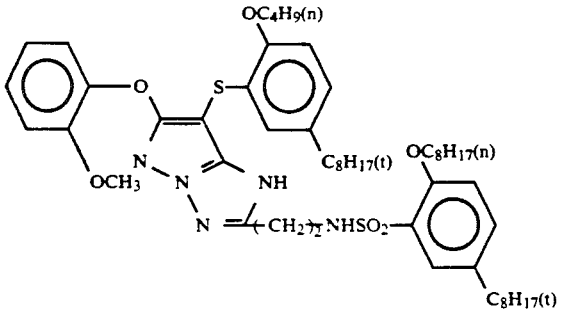
EXM-3
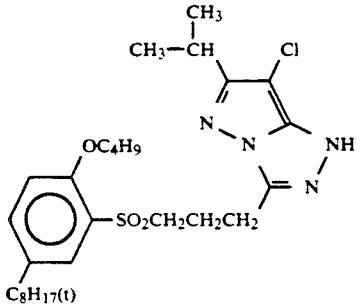
EXY-1
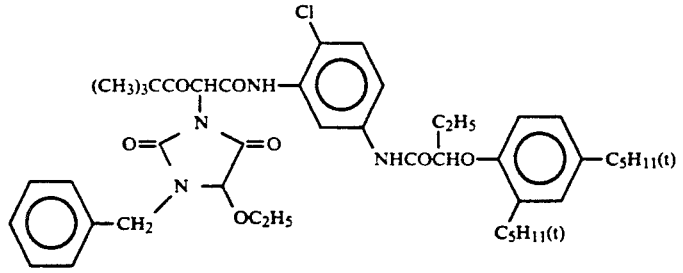
EXY-2
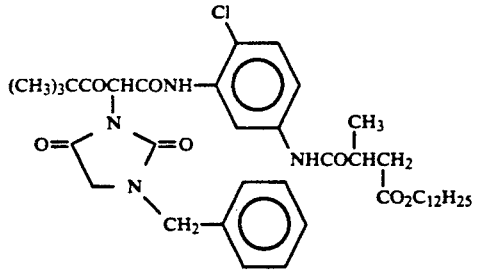
Solv-1
Di-(2-ethylhexyl) sebacate
Solv-2
Trinonyl phosphate Solv-3

Di(3-methylhexyl) phthalate

Solv-4

Tricresyl phosphate

Solv-5

Dibutyl phthalate

Solv-6

Trioctyl phosphate

Solv-7

Di(2-ethylhexyl) phthalate

H-1

1,2-Bis(vinylsulfonylacetamido)ethane

H-2

4,6-Dichloro-2-hydroxy-1,3,5-triazine Na salt

EXZK-1

7-(3-Ethoxythiocarbonylaminobenzamido)-9-methyl-10-propargyl-1,2,3,4-tetrahydroacridinium trifluoromethanesulfonate

EXZK-2

2-[4-{3-[3-{3-[2-chloro-5-(1-dodecyloxycarbonylethoxycarbonyl)phenylcarbamoyl]-4-hydroxy-1-naphthylthio}tetrazole-1-yl]phenyl}ureido]benzenesulfonamido}phenyl]-1-formylhydrazine In this way, the multi-layer color photographic material (501) was prepared. The compounds of formulas (II) and (III) in an amount given in Table 8 were added to the sixth layer and the seventh layer of the multilayer color photographic material (501) to prepare samples (502) to (508).

TABLE 8

| Sample No. | Formula (II) (Added amount) | Formula (III) (Added amount) |
|---|---|---|
| 501 | — | — |
| 502 | II-21 (100 mol %) | — |
| 503 | — | III-1 (100 mol %) |
| 504 | — | III-10 (100 mol %) |
| 505 | II-21 (100 mol %) | III-1 (20 mol %) |
| 506 | II-21 (100 mol %) | III-1 (50 mol %) |
| 507 | II-21 (100 mol %) | III-10 (20 mol %) |
| 508 | II-21 (100 mol %) | III-10 (50 mol %) |

The added amounts of the compounds of formulas (II) and (III) are based on the amount of the magenta coupler.

Each sample was exposed according to the method described in Example 1. The exposed samples were processed in the following processing stages.

| Processing stage | Time | Temperature (°C.) |
|---|---|---|
| First development | 60 sec. | 38 |
| First rinsing | 60 sec. | 33 |
| Color development | 60 sec. | 38 |
| Bleaching | 60 sec. | 38 |
| Bleaching-fixing | 60 sec. | 38 |
| Second rinsing | 60 sec. | 33 |
| Drying | 45 sec. | 75 |

Each processing solution had the following composition.

| First developing solution | Tank solution | Replenisher |
|---|---|---|
| Pentasodium salt of nitrilo-N,N,N-trimethylenephosphonic acid | 1.0 g | 1.0 g |
| Pentasodium diethylenetriaminepentaacetate | 3.0 g | 3.0 g |
| Potassium sulfite | 30.0 g | 30.0 g |
| Potassium thiocyanate | 1.2 g | 1.2 g |
| Potassium carbonate | 35.0 g | 35.0 g |
| Potassium hydroquinone mono-sulfonate | 25.0 g | 25.0 g |
| 1-Phenyl-3-pyrazolidone | 2.0 g | 2.0 g |
| Potassium bromide | 0.5 g | — |
| Potassium iodide | 5.0 mg | — |
| Add water | 1000 ml | 1000 ml |
| pH | 9.6 | 9.7 |

The pH was adjusted with hydrochloric acid or potassium hydroxide.

| First rinsing water | Tank solution | Replenisher |
|---|---|---|
| Ethylenediaminetetramethylenephosphonic acid | 2.0 g | The same as mother solution |
| Disodium phosphate | 5.0 g | |
| Add water | 1000 ml | |
| pH | 7.00 | |

The pH was adjusted with hydrochloric acid or sodium hydroxide.

| Color developing solution | Tank solution | Replenisher |
|---|---|---|
| Benzyl alcohol | 15.0 ml | 18.0 ml |
| Diethylene glycol | 12.0 ml | 14.0 ml |
| 3,6-Dithia-1,8-octane | 2.00 g | 2.50 g |
| Pentasodium salt of nitrilo-N,N,N-trimethylenephosphonic acid | 0.5 g | 0.5 g |
| Pentasodium diethylenetriaminepentaacetate | 2.0 g | 2.0 g |
| Sodium sulfite | 2.0 g | 2.0 g |
| Hydroxylamine sulfate | 3.0 g | 3.6 g |
| N-Ethyl-N-(β-methanesulfonamidoethyl)-3-methylamino-aniline sulfate | 6.0 g | 9.0 g |
| Ethylenediamine | 10.0 ml | 12.0 ml |
| Potassium bromide | 0.5 g | — |
| Potassium iodide | 5.0 ml | — |
| Add water | 1000 ml | 1000 ml |
| pH | 9.60 | 9.70 |

The pH was adjusted with hydrochloric acid or potassium hydroxide.

| First rinsing water | Tank solution | Replenisher |
|---|---|---|
| Ethylenediaminetetramethylenephosphonic acid | 2.0 g | The same as mother solution |
| Disodium phosphate | 5.0 g | |
| Add water | 1000 ml | |
| pH | 7.00 | |

The pH was adjusted with hydrochloric acid or sodium hydroxide.

| Color developing solution | Tank solution | Replenisher |
|---|---|---|
| Benzyl alcohol | 15.0 ml | 18.0 ml |
| Diethylene glycol | 12.0 ml | 14.0 ml |
| 3,6-Dithia-1,8-octane | 2.00 g | 2.50 g |
| Pentasodium salt of nitrilo-N,N,N-trimethylenephosphonic acid | 0.5 g | 0.5 g |
| Pentasodium diethylenetriaminepentaacetate | 2.0 g | 2.0 g |
| Sodium sulfite | 2.0 g | 2.5 g |
| Hydroxylamine sulfate | 3.0 g | 3.6 g |
| N-Ethyl-N-(β-methanesulfonamidoethyl)-3-methyl-aminoaniline sulfate | 6.0 g | 9.0 g |
| Ethylenediamine | 10.0 ml | 12.0 ml |
| Fluorescent brightener (diaminostilbene type) | 1.0 g | 1.2 g |
| Potassium bromide | 0.5 g | — |
| Potassium iodide | 1.0 mg | — |
| Add water | 1000 ml | 1000 ml |
| pH | 10.60 | 11.00 |

The pH was adjusted by adding hydrochloric acid or potassium hydroxide.

| Bleaching solution | Tank solution | Replenisher |
|---|---|---|
| Disodium ethylenediaminetetraacetate | 10.0 g | (same as tank solution) |
| Ethylenediaminetetraacetic acid Fe(III) ammonium dihydrate | 120 g | |
| Ammonium bromide | 100 g | |
| Ammonium nitrate | 10 g | |
| Add water | 1000 ml | |
| pH | 6.30 | |

The pH was adjusted with hydrochloric acid or ammonia liquor.

| Bleachinq-fixinq solution | Tank solution | Replenisher |
|---|---|---|
| Disodium ethylenediaminetetraacetate dihydrate | 5.0 g | (same as mother solution) |
| Ethylenediaminetetraacetic acid Fe(III) ammonium monohydrate | 80.0 g | |
| Sodium sulfite | 15.0 g | |
| Ammonium thiosulfate (700 g/l) | 160 ml | |
| 2-Mercapto-1,3,4-triazole | 0.5 g | |
| Add water | 1000 ml | |
| pH | 6.50 | |

The pH was adjusted with hydrochloric acid or ammonia liquor.

Second rinsing water both tank solution and replenisher

Tap water was passed through a mixed-bed system column packed with a H type strongly acidic cation exchange resin (Amberlite IR-120B, a product of Rohm & Hass Co.) and an OH type anion exchange resin (Amberlite IR-400) to reduce the concentration of each of calcium ion and magnesium ion to 3 mg/l or lower. Sodium dichlorinated isocyanurate (20 mg/l) and sodium sulfate (1.5 g/l) were added thereto. The pH of the resulting solution was in the range of 6.5 to 7.5.

The thus-processed samples were subjected to dye image fastness test to light in the same manner as in Example 1. Good results were obtained as in Example 1.

EXAMPLE 6

A cellulose triacetate film support (thickness: 127 μm) having an under coat was coated with the following layers to prepare a multi-layer color photographic material. This photographic material was referred to as sample 601. Each layer had the following composition. Numerals represent added amounts per $m^2$.

| | |
|---|---|
| First layer (antihalation layer) | |
| Black colloidal silver | 0.25 g |
| Gelatin | 1.9 g |
| U-1 | 0.04 g |
| U-2 | 0.1 g |
| U-3 | 0.1 g |
| Oil-1 | 0.1 g |
| Second layer (intermediate layer) | |
| Gelatin | 0.40 g |
| Cpd-D | 10 mg |
| Oil-3 | 40 mg |
| Third layer (intermediate layer) | |
| Fogged fine silver iodobromide grain emulsion (mean grain size: 0.06 μm, AgI content: 1 mol %) | 0.05 g (in terms of silver) |
| Gelatin | 0.4 g |
| Fourth layer (low-sensitivity red-sensitive emulsion layer) | |
| Silver iodobromide emulsion [a 1:1 mixture of monodisperse cubic emulsion (mean grain size: 0.4 μm, AgI content: 4.5 mol %) and monodisperse cubic emulsion (mean grain size: 0.3 μm, AgI content: 4.5 mol %)] spectrally-sensitized with sensitizing dyes S-1 and S-2 | 0.4 g (in terms of Ag) |
| Gelatin | 0.8 g |
| Coupler C-1 | 0.20 g |
| Coupler C-9 | 0.05 g |
| Oil-1 | 0.1 cc |
| Fifth layer (medium-sensitivity red-sensitive emulsion layer) | |
| Silver iodobromide emulsion (monodisperse cubic, mean grain size: 0.5 μm, AgI content: 4 mol %) spectrally-sensitized with sensitizing dyes S-1 and S-2 | 0.4 g (in terms of silver) |
| Gelatin | 0.8 g |
| Coupler C-1 | 0.2 g |
| Coupler C-2 | 0.05 g |
| Coupler C-3 | 0.2 g |
| Oil-1 | 0.1 cc |
| Sixth layer (high-sensitivity red-sensitive emulsion layer) | |
| Silver iodobromide emulsion (monodisperse twin grains, mean grain size: 0.7 μm, AgI content: 2 mol %) spectrally-sensitized with sensitizing dyes S-1 and S-2 | 0.4 g (in terms of silver) |
| Gelatin | 1.1 g |
| Coupler C-3 | 0.7 g |
| Coupler C-1 | 0.3 g |
| Seventh layer (intermediate layer) | |
| Gelatin | 0.6 g |
| Dye D-1 | 0.02 g |
| Eighth layer (intermediate layer) | |
| Fogged silver iodobromide emulsion (mean grain size: 0.06 μm, AgI content: 0.3 mol %) | |
| Gelatin | 1.0 g |
| Cpd-A | 0.2 g |
| Ninth layer (low-sensitivity green-sensitive emulsion layer) | |
| Silver iodobromide emulsion [a 1:1 mixture of emulsion (monodisperse cubic, mean grain size: 0.4 μm, AgI | 0.5 g (in terms of silver) |

-continued

| | |
|---|---|
| content: 4.5 mol %) and emulsion (monodisperse cubic, mean grain size: 0.2 μm, AgI content: 4.5 mol %)] spectrally-sensitized with sensitizing dyes S-3 and S-4 | |
| Gelatin | 0.5 g |
| Coupler C-4 | 0.15 g |
| Coupler C-7 | 0.15 g |
| II-21 | 0.1 g |
| Cpd-E | 0.03 g |
| Cpd-F | 0.03 g |
| Cpd-G | 0.07 g |
| Cpd-H | 0.1 g |
| Tenth layer (medium-sensitivity green-sensitive emulsion layer) | |
| Silver iodobromide emulsion (monodisperse cubic, mean grain size: 0.5 μm, AgI content: 3 mol %) spectrally-sensitized with sensitizing dyes S-3 and S-4 | 0.4 g (in terms of silver) |
| Gelatin | 0.6 g |
| Coupler C-4 | 0.15 g |
| Coupler C-7 | 0.15 g |
| II-21 | 0.1 g |
| Cpd-E | 0.03 g |
| Cpd-F | 0.03 g |
| Cpd-G | 0.07 g |
| Cpd-H | 0.05 g |
| Eleventh layer (high-sensitivity green-sensitive emulsion layer) | |
| Silver iodobromide emulsion [monodisperse tabular (plate-form) grains, mean value of diameter/thickness of 7, mean grain size (in terms of sphere): 0.6 μm, AgI content: 0.6 μm] spectrally-sensitized with sensitizing dyes S-3 and S-4 | 0.5 g (in terms of silver) |
| Gelatin | 1.0 g |
| Coupler C-4 | 0.4 g |
| Coupler C-7 | 0.4 g |
| II-21 | 0.26 g |
| Cpd-E | 0.08 g |
| Cpd-F | 0.08 g |
| Cpd-G | 0.19 g |
| Cpd-H | 0.1 g |
| Twelfth layer (intermediate layer) | |
| Gelatin | 0.6 g |
| Dye D-2 | 0.05 g |
| Thirteenth layer (yellow filter layer) | |
| Yellow colloidal silver | 0.1 g (in terms of silver) |
| Gelatin | 1.1 g |
| Cpd-A | 0.01 g |
| Fourteenth layer (intermediate layer) | |
| Gelatin | 0.6 g |
| Fifteenth layer (low-sensitivity Blue-sensitive emulsion layer) | |
| Silver iodobromide emulsion [a 1:1 mixture of monodisperse cubic (mean grain size: 0.4 μm, AgI content: 3 mol %) and monodisperse cubic (mean grain size: 0.2 μm, AgI content: 3 mol %)] sensitized with sensitizing dyes S-5 and S-6 | 0.6 g (in terms of silver) |
| Gelatin | 0.8 g |
| Coupler C-5 | 0.6 g |
| Sixteenth layer (medium-sensitivity Blue-sensitive emulsion layer) | |
| Silver iodobromide emulsion (monodisperse cubic, mean grain size: 0.5 μm, AgI content: 2 mol %) sensitized with sensitizing dyes S-5 and S-6 | 0.4 g (in terms of silver) |
| Gelatin | 0.9 g |
| Coupler C-5 | 0.3 g |
| Coupler C-6 | 0.3 g |
| Seventeenth layer (high-sensitivity Blue-sensitive emulsion layer) | |
| Silver iodobromide emulsion (tubular grains, mean value of diameter/thickness of 7, mean grain size of 0.7 μm in terms of sphere, AgI content: 1.5 mol %) sensitized with sensitizing dyes S-5 and S-6 | 0.4 g (in terms of silver) |
| Gelatin | 1.2 g |
| Coupler C-6 | 0.7 g |
| Eighteenth layer (first protective layer) | |
| Gelatin | 0.7 g |
| U-1 | 0.04 g |
| U-3 | 0.03 g |
| U-4 | 0.03 g |
| U-5 | 0.05 g |
| U-6 | 0.05 g |
| Cpd-C | 0.8 g |
| Dye D-3 | 0.05 g |
| Nineteenth layer (second protective layer) | |
| Fogged fine silver iodobromide grain emulsion (mean grain size: 0.06 μm, AgI content: 1 mol %) | 0.1 g (in terms of silver) |
| Gelatin | 0.4 g |
| Twentieth layer (third protective layer) | |
| Gelatin | 0.4 g |
| Polymethyl methacrylate (average particle size: 1.5 μm) | 0.1 g |
| Methyl methacrylate-acrylic acid (4:6) copolymer (average particle size: 1.5 μm) | 0.1 g |
| Silicone oil | 0.03 g |
| Surfactant W-1 | 3.0 mg |

In addition to the above-described composition, a hardener (H-1) for gelatin and a surfactant for coating and emulsification were added to each layer.

C-1

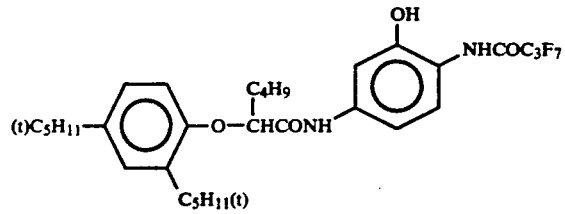

C-2

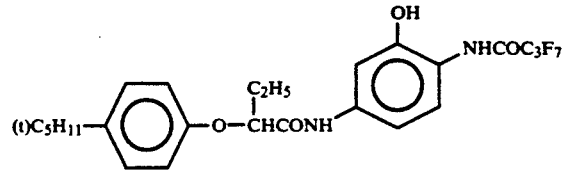

-continued
C-3
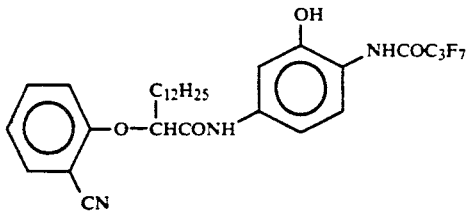
C-4
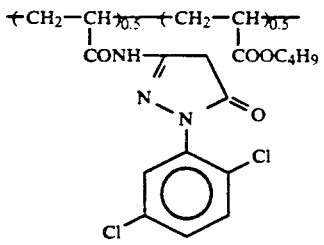
C-5
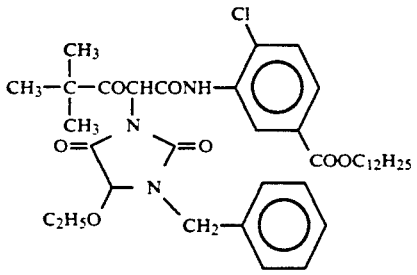
C-6
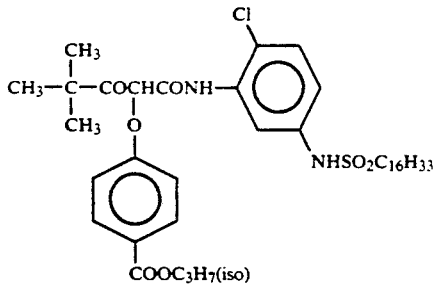
C-7
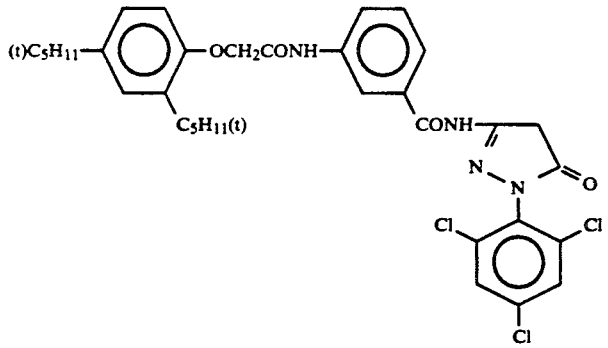
C-9

-continued
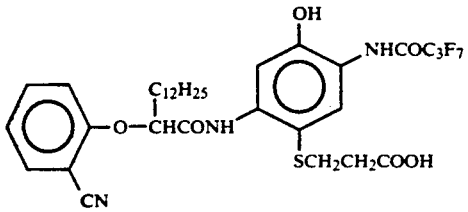
Oil-1 Dibutyl phthalate
Oil-2 Tricresyl phosphate
Oil-3
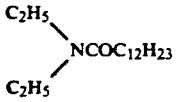
Cpd-A
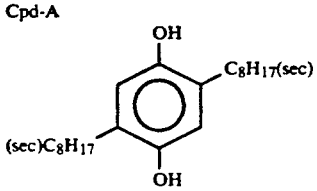
Cpd-C
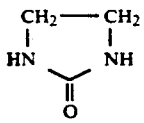
Cpd-E
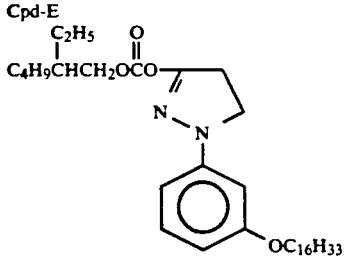
Cpd-F
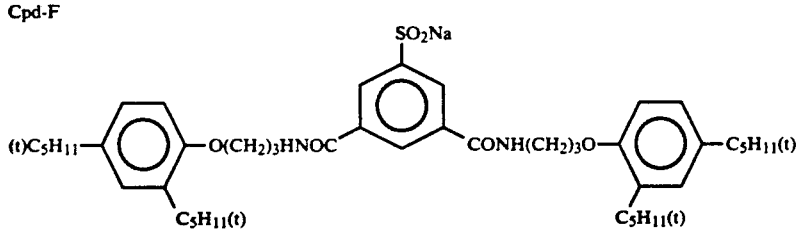
Cpd-G
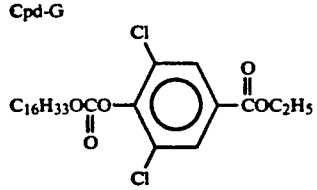
Cpd-H
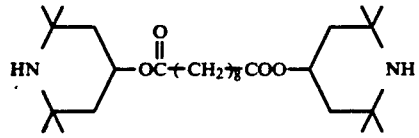
Cpd-D -continued
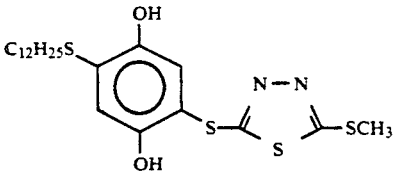
U-1
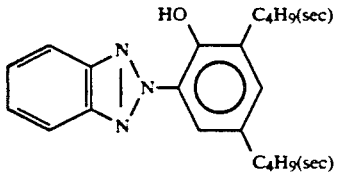
U-2
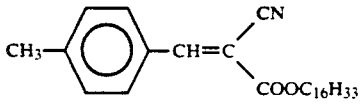
U-3
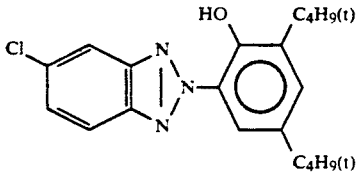
U-4
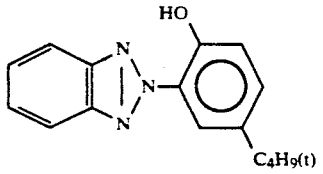
U-5
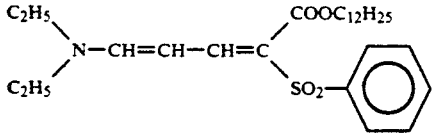
U-6
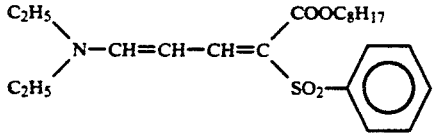
S-1
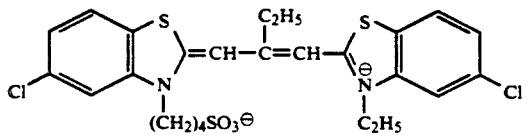
S-2

-continued
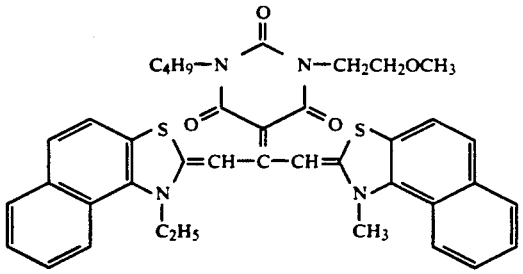
S-3
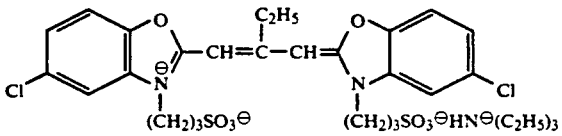
S-4
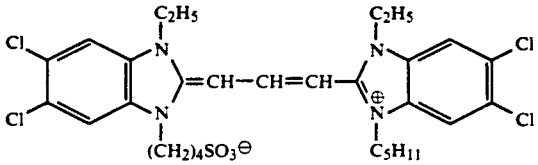
S-5
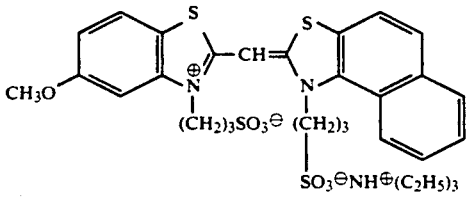
S-6
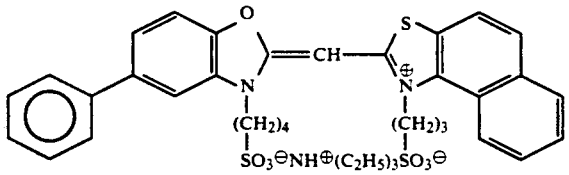
D-7
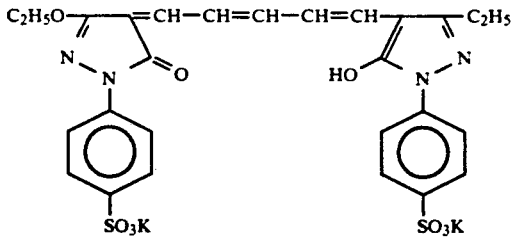
D-2
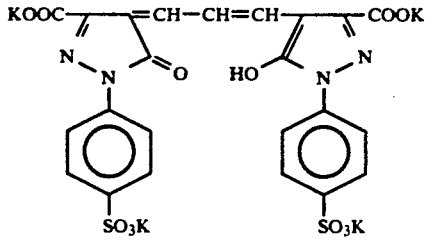
D-3

-continued
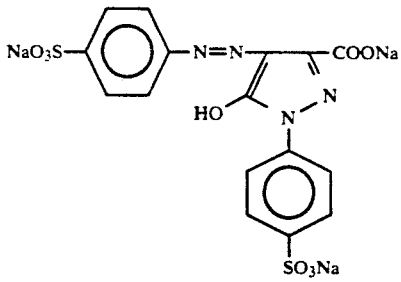
H-1
$CH_2{=}CHSO_2CH_2CONHCH_2$
$\quad\quad\quad

-continued

| | |
|---|---|
| Sodium thiosulfate | 80.0 g |
| Sodium sulfite | 5.0 g |
| Sodium bisulfite | 5.0 g |
| Add water | 1000 ml |
| Stabilizing solution | |
| Water | 800 ml |
| Formalin (37 wt %) | 5.0 ml |
| Fuji Drywell (surfactant manufactured by Fuji Photo Film Co., Ltd.) | 5.0 ml |
| Add water | 1000 ml |

The thus-processed samples were subjected to a dye image fastness test to light.

Fastness test to light

Each sample was irradiated with light for 3 days by using a xenon fade meter (100,000 lux). Dye image fastness was evaluated. Dye image fastness is represented by the absolute value of reduction in density from an initial density of 3.0, 1.0 and 0.5. The results are shown in Table 10.

TABLE 10

| Sample No. | Magenta dye image fastness D = 3.0 | D = 1.0 | D = 0.5 | Remarks |
|---|---|---|---|---|
| 601 | −0.45 | −0.40 | −0.33 | Comparative Example |
| 602 | −0.30 | −0.35 | −0.35 | Comparative Example |
| 603 | −0.30 | −0.30 | −0.25 | Invention |
| 604 | −0.45 | −0.36 | −0.23 | Invention |
| 605 | −0.28 | −0.28 | −0.23 | Invention |
| 606 | −0.25 | −0.23 | −0.20 | Invention |
| 607 | −0.28 | −0.26 | −0.22 | Invention |
| 608 | −0.25 | −0.22 | −0.19 | Invention |

Yellow and cyan dye image fastness were as follows:

| | D = 3.0 | D = 1.0 | D = 0.5 |
|---|---|---|---|
| Yellow | −0.25 | −0.25 | −0.25 |
| Cyan | −0.20 | −0.25 | −0.25 |

Spectral absorption data for the dye image of each of the samples (601), (602) and (603) were as follows:

| Sample No. | D (540 nm) | D (430 nm) |
|---|---|---|
| 601 | 1.00 | 0.20 |
| 602 | 1.00 | 0.09 |
| 603 | 1.00 | 0.09 |

It is apparent from Table 10 that the samples of the present invention were excellent in color reproducibility and had greatly improved dye image fastness and good color balance between magenta, yellow and cyan dye images.

EXAMPLE 7

An undercoated cellulose triacetate film support was multi-coated with the following layers to prepare a multi-layer color photographic material (sample 701). Each layer had the following composition.

Compositions of sensitive layers

Numerals represent the coating wight in g/m$^2$ of each component. The amount of silver halide is represented by coating weight in terms of silver. The amounts of sensitizing dyes are represented by coating weight in mol % per mol of silver halide in the same layer.

| Sample 701 | |
|---|---|
| First layer (antihalation layer) | |
| Black colloidal silver | 0.18 (in terms of silver) |
| Gelatin | 1.40 |
| Second layer (intermediate layer) | |
| 2,5-Di-t-pentadecylhydroquinone | 0.18 |
| EX-1 | 0.07 |
| EX-3 | 0.02 |
| EX-12 | 0.002 |
| U-1 | 0.06 |
| U-2 | 0.08 |
| U-3 | 0.10 |
| HBS-1 | 0.10 |
| HBS-2 | 0.02 |
| Gelatin | 1.04 |
| Third layer (first red-sensitive emulsion layer) | |
| Emulsion A | 0.25 (in terms of silver) |
| Emulsion B | 0.25 (in terms of silver) |
| Sensitizing dye I | $6.9 \times 10^{-5}$ |
| Sensitizing dye II | $1.8 \times 10^{-5}$ |
| Sensitizing dye III | $3.1 \times 10^{-4}$ |
| EX-2 | 0.335 |
| EX-10 | 0.020 |
| U-1 | 0.070 |
| U-2 | 0.050 |
| HBS-1 | 0.060 |
| U-3 | 0.070 |
| Gelatin | 0.87 |
| Fourth layer (second red-sensitive emulsion layer) | |
| Emulsion C | 1.0 (in terms of silver) |
| Sensitizing dye I | $5.1 \times 10^{-5}$ |
| Sensitizing dye II | $1.4 \times 10^{-5}$ |
| Sensitizing dye III | $2.3 \times 10^{-4}$ |
| EX-2 | 0.400 |
| EX-3 | 0.050 |
| EX-10 | 0.015 |
| U-1 | 0.070 |
| U-2 | 0.050 |
| U-3 | 0.070 |
| Gelatin | 1.30 |
| Fifth layer (third red-sensitive emulsion layer) | |
| Emulsion D | 1.60 (in terms of silver) |
| Sensitizing dye I | $5.4 \times 10^{-5}$ |
| Sensitizing dye II | $1.4 \times 10^{-5}$ |
| Sensitizing dye III | $2.4 \times 10^{-4}$ |
| EX-3 | 0.010 |
| EX-4 | 0.080 |
| EX-2 | 0.097 |
| HBS-1 | 0.22 |
| HBS-2 | 0.10 |
| Gelatin | 1.63 |
| Sixth layer (intermediate layer) | |
| EX-5 | 0.040 |
| HBS-1 | 0.020 |
| Gelatin | 0.80 |
| Seventh layer (first green-sensitive emulsion layer) | |
| Emulsion A | 0.15 (in terms of silver) |
| Emulsion B | 0.15 (in terms of silver) |
| Sensitizing dye V | $3.0 \times 10^{-5}$ |
| Sensitizing dye VI | $1.0 \times 10^{-4}$ |
| Sensitizing dye VII | $3.8 \times 10^{-4}$ |
| EX-6 | 0.260 |
| EX-1 | 0.021 |
| EX-7 | 0.030 |
| EX-8 | 0.025 |
| HBS-1 | 0.100 |

-continued

| Sample 701 | |
|---|---|
| HBS-3 | 0.010 |
| Gelatin | 0.63 |
| Eighth layer (second green-sensitive emulsion layer) | |
| Emulsion C | 0.45 (in terms of silver) |
| Sensitizing dye V | $2.1 \times 10^{-5}$ |
| Sensitizing dye VI | $7.0 \times 10^{-5}$ |
| Sensitizing dye VII | $2.6 \times 10^{-4}$ |
| EX-6 | 0.094 |
| EX-8 | 0.018 |
| EX-7 | 0.026 |
| HBS- | 0.160 |
| HBS-3 | 0.008 |
| Gelatin | 0.50 |
| Ninth layer (third green-sensitive emulsion layer) | |
| Emulsion E | 1.2 (in terms of silver) |
| Sensitizing dye V | $3.5 \times 10^{-5}$ |
| Sensitizing dye VI | $8.0 \times 10^{-5}$ |
| Sensitizing dye VII | $3.0 \times 10^{-4}$ |
| EX-13 | 0.015 |
| EX-11 | 0.100 |
| EX-1 | 0.025 |
| HBS-1 | 0.25 |
| HBS-2 | 0.10 |
| Gelatin | 1.54 |
| Tenth layer (yellow filter layer) | |
| Yellow colloidal silver | 0.05 (in terms of silver) |
| EX-5 | 0.08 |
| HBS-1 | 0.03 |
| Gelatin | 0.95 |
| Eleventh layer (first blue sensitive emulsion layer) | |
| Emulsion A | 0.08 (in terms of silver) |
| Emulsion B | 0.07 (in terms of silver) |

-continued

| Sample 701 | |
|---|---|
| Emulsion F | 0.07 (in terms of silver) |
| Sensitizing dye VIII | $3.5 \times 10^{-4}$ |
| EX 9 | 0.721 |
| EX-8 | 0.042 |
| HBS-1 | 0.28 |
| Gelatin | 1.10 |
| Twelfth layer (second blue-sensitive emulsion layer) | |
| Emulsion C | 0.45 (in terms of silver) |
| Sensitizing dye VIII | $2.1 \times 10^{-4}$ |
| EX-9 | 0.154 |
| EX-10 | 0.007 |
| HBS-1 | 0.05 |
| Gelatin | 0.78 |
| Thirteenth layer (third blue-sensitive emulsion layer) | |
| Emulsion H | 0.77 (in terms of silver) |
| Sensitizing dye VIII | $2.2 \times 10^{-4}$ |
| EX-9 | 0.20 |
| HBS-1 | 0.07 |
| Gelatin | 0.69 |
| Fourteenth layer (first protective layer) | |
| Emulsion I | 0.20 (in terms of silver) |
| U-4 | 0.11 |
| U-5 | 0.17 |
| HBS-1 | 0.05 |
| Gelatin | 1.00 |
| Fifteenth layer (second protective layer) | |
| Polymethyl acrylate particles (diameter: about 1.5 μm) | 0.54 |
| S-1 | 0.20 |
| Gelatin | 1.20 |

In addition to the above components, hardener H-1 for gelatin and a sufficient were added to each layer.

| | Average AgI content (%) | Mean grain size (μm) | Coefficient of variation in grain size (%) | Ratio of diameter/thickness | Ratio of amount of silver (AgI content, %) |
|---|---|---|---|---|---|
| Emulsion A | 4.0 | 0.45 | 27 | 1 | core/shell = 1/3(13/1), double structure grain |
| Emulsion B | 8.9 | 0.70 | 14 | 1 | core/shell = 3/7(25/2), double structure grain |
| Emulsion C | 10 | 0.75 | 30 | 2 | core/shell = 1/2(24/3), double structure grain |
| Emulsion D | 16 | 1.05 | 35 | 2 | core/shell = 4/6(40/0), double structure grain |
| Emulsion E | 10 | 1.05 | 35 | 3 | core/shell = 1/2(24/3), double structure grain |
| Emulsion F | 4.0 | 0.25 | 28 | 1 | core/shell = 1/3(13/1), double structure grain |
| Emulsion G | 14.0 | 0.75 | 25 | 2 | core/shell = 1/2(42/0), double structure grain |
| Emulsion H | 14.5 | 1.30 | 25 | 3 | core/shell = 37/63(34/3), double structure grain |
| Emulsion I | 1 | 0.07 | 15 | 1 | uniform grain |

-continued
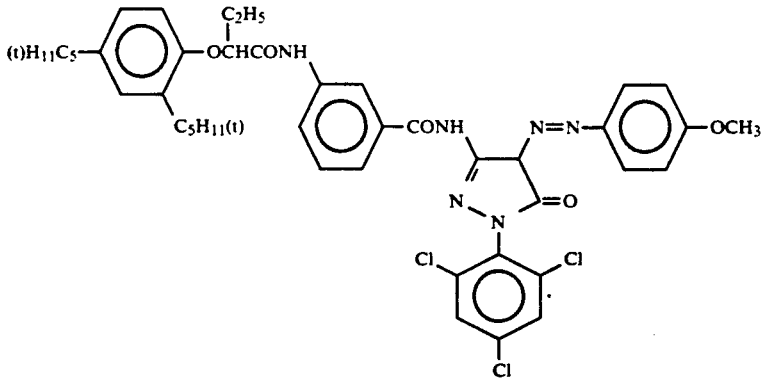
EX-2
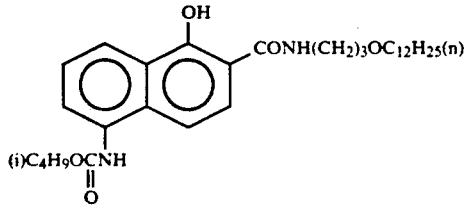
EX-3
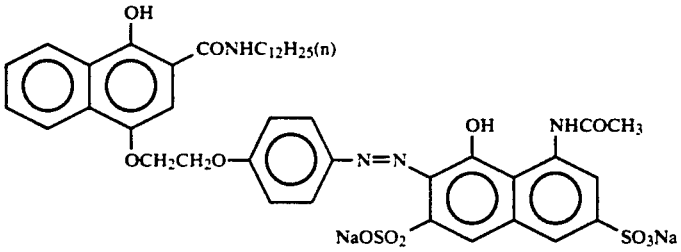
EX-4
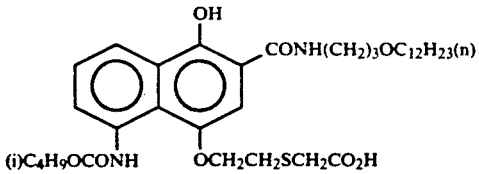
EX-5
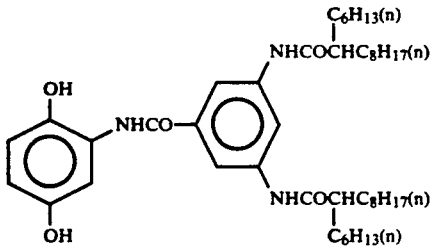
EX-6

-continued
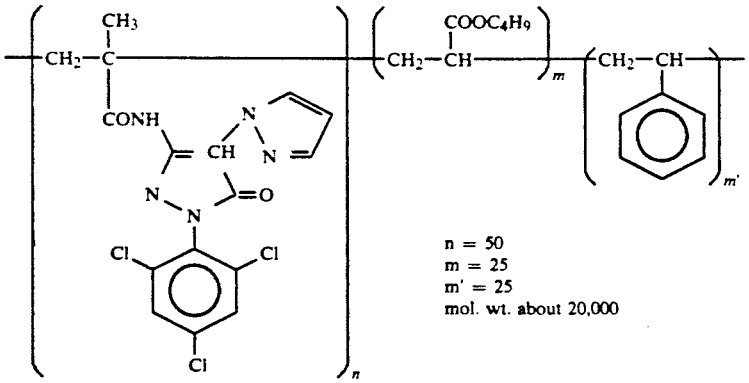
EX-7
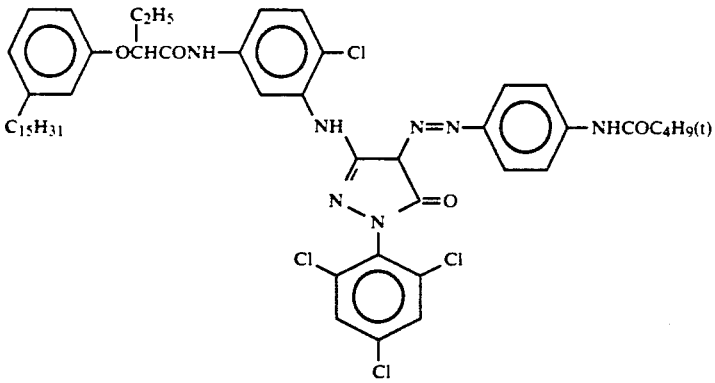
EX-8
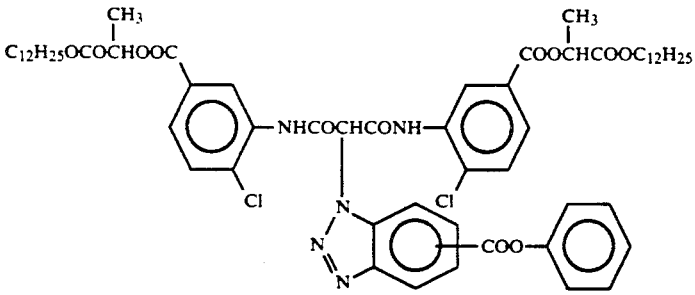
EX-9
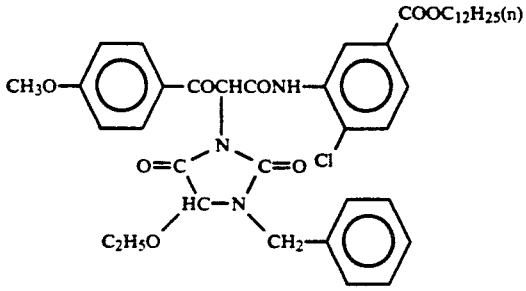
EX-10

-continued
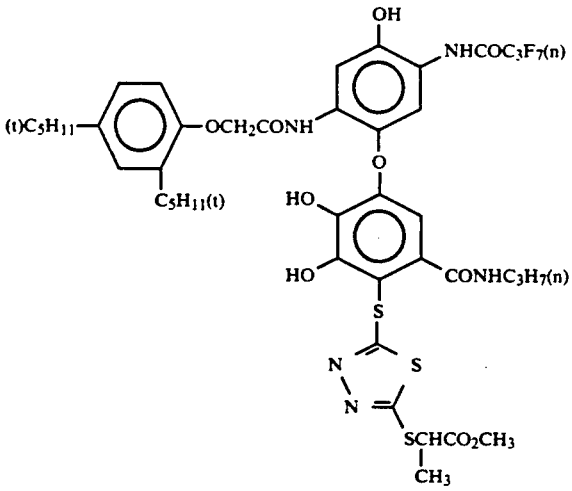
EX-11
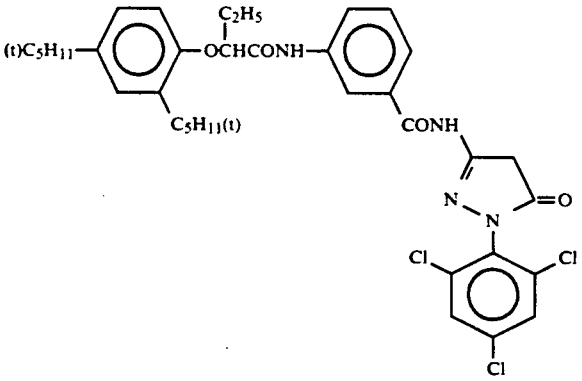
EX-12
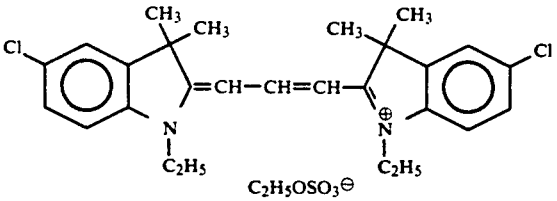
EX-13
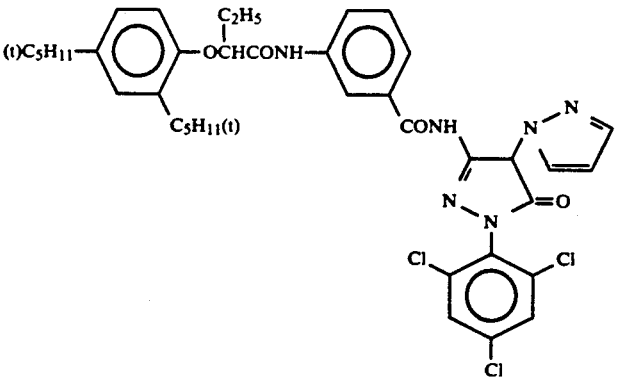
U-1

-continued
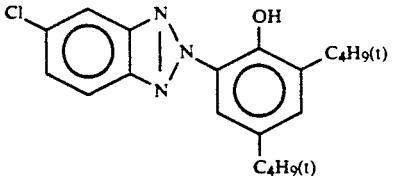
U-2
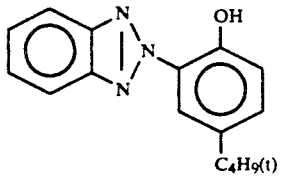
U-3
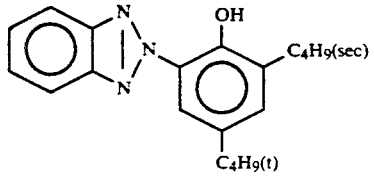
U-4
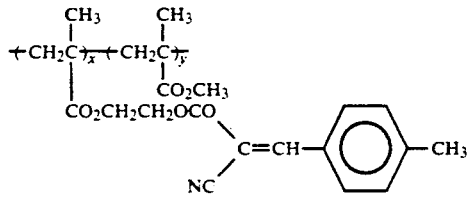
U-5
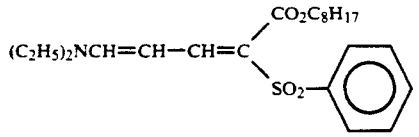
HBS-1
Tricresyl phosphate
HBS-2
Di-n-butyl phthalate
HBS-3
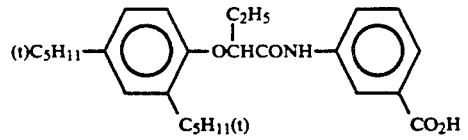
Sensitizing dye I
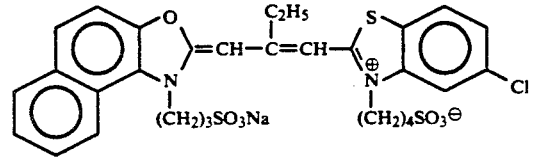
Sensitizing dye II -continued

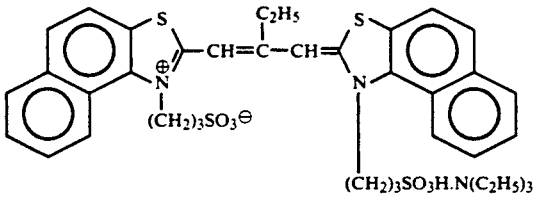

Sensitizing dye III

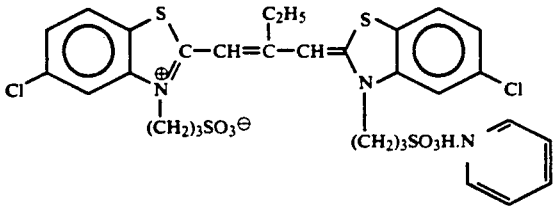

Sensitizing dye V

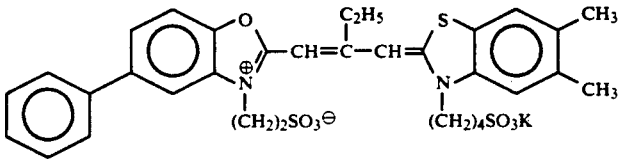

Sensitizing dye VI

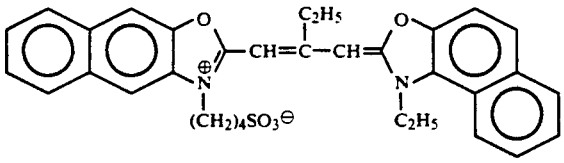

Sensitizing dye VII

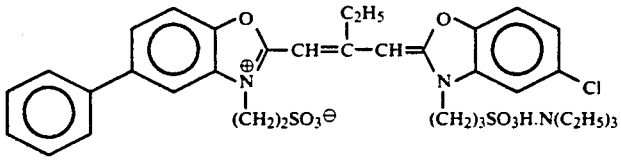

Sensitizing dye VIII

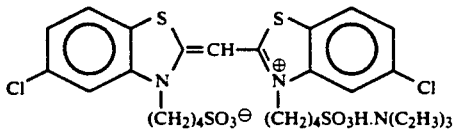

S-1

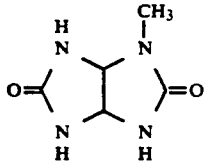

H-1

$CH_2{=}CH{-}SO_2{-}CH_2{-}CONH{-}CH_2$
$CH_2{=}CH{-}SO_2{-}CH_2{-}CONH{-}CH_2$

Samples (702) to (704) were prepared in the same manner as in the preparation of the sample (701) except that the 7th, 8th and 9th layers of the sample (701) were modified in the manner given in Table 11.

TABLE 11

| Sample No. | 7th layer | | 8th layer | | 9th layer | |
|---|---|---|---|---|---|---|
| 701 | EX-6 | 0.260 | EX-6 | 0.094 | EX-11 | 0.10 |

TABLE 11-continued

| Sample No. | 7th layer | | 8th layer | | 9th layer | |
|---|---|---|---|---|---|---|
| 702 | I-50 | 0.260 | I-50 | 0.094 | I-50 | 0.10 |
| 703 | I-50 | 0.260 | I-50 | 0.094 | I-50 | 0.10 |
| | II-21 | 0.086 | II-21 | 0.031 | II-21 | 0.03 |
| 704 | I-50 | 0.260 | I-50 | 0.094 | I-50 | 0.10 |
| | II-21 | 0.086 | II-21 | 0.031 | II-21 | 0.03 |
| | III-10 | 0.027 | III-10 | 0.010 | III-10 | 0.01 |

Each sample was exposed according to the method described in Example 1. The exposed samples were processed in the following processing stages.

| Stage | Processing time | Processing temperature (°C.) |
|---|---|---|
| Color development | 3 min. 15 sec. | 38 |
| Bleaching | 6 min. 30 sec. | 38 |
| Rinsing | 2 min. 10 sec. | 24 |
| Fixing | 4 min. 20 sec. | 38 |
| Rinsing (1) | 1 min. 5 sec. | 24 |
| Rinsing (2) | 2 min. 10 sec. | 24 |
| Stabilization | 1 min. 5 sec. | 38 |
| Drying | 4 min. 20 sec. | 55 |

Each processing solution had the following composition.

| | unit (g) |
|---|---|
| Color developing solution | |
| Diethylenetriaminepentaacetic acid | 1.0 |
| 1-Hydroxyethylidene-1,1-diphosphonic acid | 3.0 |
| Sodium sulfite | 4.0 |
| Potassium carbonate | 30.0 |
| Potassium bromide | 1.4 |
| Potassium iodide | 1.5 mg |
| Hydroxylamine sulfate | 2.4 |
| 4-(N-Ethyl-N-β-hydroxyethylamino)-2-methylaniline sulfate | 4.5 |
| Add water | 1.0 liter |
| pH | 10.05 |
| Bleaching solution | |
| Ethylenediaminetetraacetic acid iron(III) sodium trihydrate | 100.0 |
| Disodium ethylenediaminetetraacetate | 10.0 |
| Ammonium bromide | 140.0 |
| Ammonium nitrate | 30.0 |
| Ammonia water (27%) | 6.5 ml |
| Add water | 1.0 liter |
| pH | 6.0 |
| Fixing solution | |
| Disodium ethylenediaminetetraacetate | 0.5 |
| Sodium sulfite | 7.0 |
| Sodium bisulfite | 5.0 |
| Ammonium thiosulfate (70% aqueous solution) | 170.0 ml |
| Add water | 1.0 liter |
| pH | 6.7 |
| Stabilizing solution | |
| Formalin (37%) | 2.0 ml |
| Polyoxyethylene p-monononylphenyl ether (average degree of polymerization: 10) | 0.3 |
| Disodium ethylenediaminetetraacetate | 0.05 |
| Add water | 1.0 liter |
| pH | 5.0–8.0 |

The thus-prepared samples were subjected to a dye image fastness test to light in the same way as in Example 6. The results are shown in Table 12.

TABLE 12

| Sample No. | Magenta dye image fastness D = 2.0 | D = 1.0 | D = 0.5 | Remarks |
|---|---|---|---|---|
| 701 | −0.52 | −0.40 | −0.35 | Comparative Example |
| 702 | −0.80 | −0.65 | −0.39 | Comparative Example |
| 703 | −0.30 | −0.33 | −0.30 | Comparative Example |
| 704 | −0.28 | −0.26 | −0.22 | Invention |

It is apparent from Table 12 that the invention provided superior fading effects similar to those of Example 6.

According to the present invention, a silver halide color photographic material which has good color reproducibility and gives a dye image by color development having greatly improved fastness to light in the region of high density as well as low density.

The color balance of the color photograph obtained by color development scarcely changes with the passage of time.

Further, the color photograph is resistant to stain and the staining of white area during storage or even when irradiated with light.

While the present invention has been described in detail and with reference to specific embodiments thereof, it is apparent to one skilled in the art that various changes and modifications can be made therein without departing from the spirit and the scope of the present invention.

What is claimed is:

1. A silver halide color photographic material comprising a support having thereon at least three kinds of silver halide emulsion layers each sensitive to radiation each having a different spectral region, at least one of said silver halide emulsion layers containing the combination of a coupler represented by formula (I), a compound represented by formula (II) and a compound represented to formula (III):

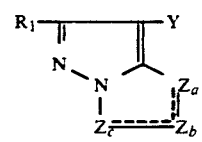

(I)

wherein $R_1$ represents a hydrogen or a substituent; $Z_a$, $Z_b$ and $Z_c$ each represents methine, substituted methine, =N— or —NH—; and Y represents hydrogen or a coupling-off group; provided that $R_1$, Y or a substituted methine group represented by $Z_a$, $Z_b$ or $Z_c$ may be linked to a second coupler represented by formula (I) or a polymer;

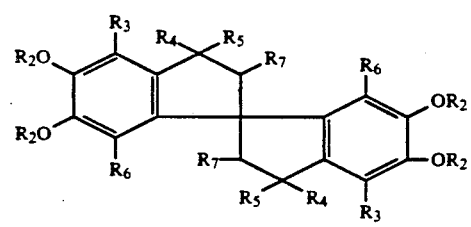

(II)

wherein $R_2$ represents an aliphatic group, an aromatic group, a heterocyclic group or a substituted silyl group represented by

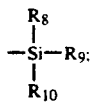

wherein $R_8$, $R_9$ and $R_{10}$, which may be the same of different, each represents an aliphatic group, an aromatic group, and aliphatic oxy group or an aromatic oxy group; $R_3$, $R_4$, $R_5$, $R_6$ and $R_7$ which may be the same or different, each represents hydrogen, an aliphatic group, an aromatic group, an acylamino group, a monoalkylamino group, a dialkylamino group, an aliphatic thio group, an aromatic thio group, an aliphatic oxycarbonyl group, an aromatic oxycarbonyl group or an $—OR_2$ group; and

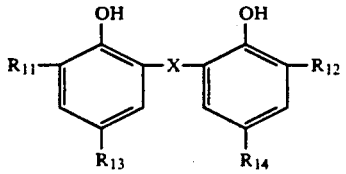

(III)

wherein $R_{11}$ and $R_{12}$ each represents a methyl group, and $R_{13}$ and $R_{14}$, which may be the same or different, each represents an alkyl group containing from 1 to 18 carbon atoms, provided that the total number of carbon atoms contained in $R_{11}$, $R_{12}$, $R_{13}$ and $R_{14}$ is at most 32; and X represents a group represented by

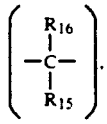

wherein $R_{15}$ is hydrogen and $R_{16}$ is hydrogen or an alkyl group containing 1 to 10 carbon atoms; and n is an integer of 1.

2. The silver halide color photographic material as claimed in claim 1, wherein said coupler represented by formula (I) is a magenta coupler represented by formulae (V), (VI), (VIII) or (IX):

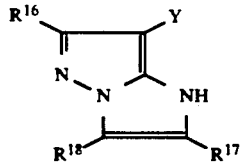

(V)

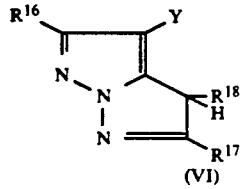

(VI)

-continued

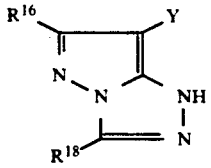

(VII)

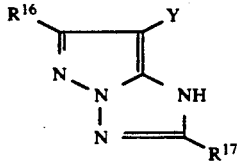

(VIII)

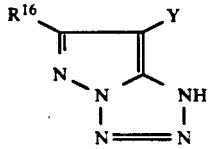

(IX)

wherein $R_{16}$, $R_{17}$ and $R_{18}$ in formula (V) to (IX), which may be the same or different, each represents hydrogen, a halogen atom, a cyano group, an imido group, a substituted or unsubstituted aliphatic group, a substituted or unsubstituted aromatic group, a substituted or unsubstituted heterocyclic group, a substituted or unsubstituted carbamoyl group, a substituted or unsubstituted sulfamoyl group, a substituted or unsubstituted ureido group, a substituted or unsubstituted sulfamoylamino group, RO—,

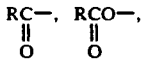

RS—, RSO—, $RSO_2$—, $RSO_2NH$—,

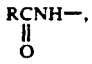

RNH—,

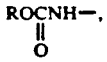

wherein R represents an alkyl group, an aryl group or a heterocyclic group; and Y represents hydrogen a halogen atom, an alkoxy group, an aryloxy group, an acyloxy group, an aliphatic sulfornyloxy group, an aromatic sulfonyloxy group, an acylamino group, an aliphatic sulfonamido group, an aromatic sulfonamido group, an alkoxycarbonyloxy group, an aryloxycarboyloxy group, an aliphatic thio group, an aromatic thio group, a heterocyclic thio group, a carbamoylamino group, a 5-membered nitrogen-containing heterocyclic ring, a 6-membered nitrogen-containing heterocyclic ring, an imido group, or an aromatic azo group.

3. The silver halide color photographic material as claimed in claim 2, wherein each said substituted group represented by $R_{16}$, $R_{17}$ and $R_{18}$ (in formula (V) to (IX) is substituted with 247 at least one substituent selected from the group consisting of an alkyl group, an aryl group, a heterocyclic group, an alkoxy group, an aryloxy group, an alkenyloxy group, an acyl group, an ester group, an amido group, a carbamoyl group, a sulfamoyl group, an imido group, a ureido group, an aliphatic sulfonyl group, an aromatic sulfonyl group, an aliphatic thio group, an aromatic thio group, a hydroxyl group, a cyano group, a carboxyl group, a nitro group, a sulfo group and a halogen atom.

4. The silver halide color photographic material claimed as in claim 2, wherein said coupler having the formula (I) is a magenta coupler represented by formula (V), (VII) or (VIII).

5. The silver halide color photographic material claimed as in claim 4, wherein at least one of $R_{16}$, $R_{17}$ and $R_{18}$ in said magenta coupler represented by formula (V), (VII) or (VIII) is a branched alkyl group.

6. The silver halide color photographic material claimed as in claim 4, wherein said magenta coupler is represented by formula (VII).

7. The silver halide color photographic material claimed as in claim 4, wherein said magenta coupler is represented by formula (VIII).

8. The silver halide color photographic material claimed as in claim 2, wherein said coupler having the formula (I) is a magenta coupler represented by formula (VII) or (VIII).

9. The silver halide color photographic material claimed as in claim 1, wherein said coupler represented by formula (I), said compound represented by formula (II) and said compound represented by formula (III) are each present in a silver halide emulsion layer sensitive to green light.

10. The silver halide color photographic material claimed as in claim 9, wherein said coupler represented by formula (I) is present in an amount of $1\times10^{-2}$ to 1 mol per mol of silver halide in said emulsion layer; said compound represented by formula (II) is present in an amount of 10 to 500 mol % based on the amount of said coupler represented by formula (I); and said compound represented by formula (III) is present in an amount of 1 to 200 mol % based on the amount of said coupler represented by formula (I).

11. The silver halide color photographic material claimed as in claim 1, wherein said compound having the formula (II) is a compound wherein $R_2$ is an alkyl group, $R_4$ and $R_5$ are a hydrogen atom or methyl group, and $R_3$, $R_6$ and $R_7$ is a hydrogen atom.

12. The silver halide color photographic material claimed as in claim 11, wherein said compound having the formula (II) is a compound wherein $R_2$ is an alkyl group, $R_4$ and $R_5$ are methyl group and $R_3$, $R_6$ and $R_7$ is a hydrogen atom.

13. The silver halide color photographic material claimed as in claim 1, wherein each said light-sensitive silver halide emulsion comprises silver chloride or silver chlorobromide containing at least 95 mol % of silver chloride and containing substantially no silver iodide.

14. The silver halide color photographic material as claimed in claim 1, wherein at least three kinds of the silver halide emulsion layer comprises a silver halide emulsion layer sensitive to red light, a silver halide emulsion layer sensitive to green light and a silver halide emulsion layer sensitive to blue light, and said silver halide emulsion layer sensitive to red light comprises at least one cyan coupler represented by formula (C-I) of (C-II); said silver halide emulsion layer sensitive to blue light comprises at least one yellow coupler represented by formula (Y) and said silver halide emulsion layer sensitive to green light comprises in addition to said coupler represented by formula (I), said compound represented by formula (II) and said compound represented by formula (III), with or without at least one magenta coupler represented by formula (M-I):

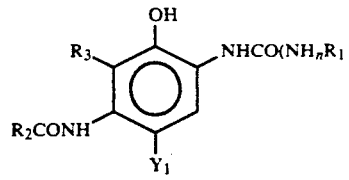

(C-I)

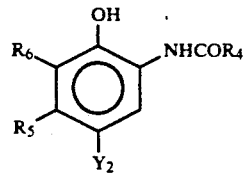

(C-II)

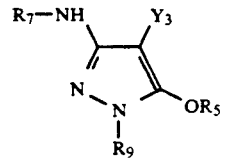

(M-I)

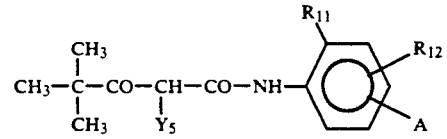

(Y)

wherein, in formula (C-I), (C-II), M-I) and Y, $R_1$, Rand $R_4$, which may be the same or different, each represents a substituted or unsubstituted aliphatic group, a substituted or unsubstituted aromatic group, or a substituted or unsubstituted heterocyclic group; $R_3$, $R_5$ and $R_6$, which may be the same or different, each represents hydrogen, a halogen atom, an aliphatic group, an aromatic group or an acylamino group; provided that $R_3$ and $R_2$ may be linked to form a 5-membered nitrogen-containing ring; $Y_1$ and $Y_2$ each represents hydrogen or a coupling-off group; n is 0 or 1; $R_7$ and $R_9$, which may be the same or different, each represents a substituted or unsubstituted aryl group, $R_8$ represents a hydrogen, an aliphatic acyl group, an aromatic acyl group, an aliphatic sulfonyl group, or an aromatic sulfonyl group; $Y_3$ represents hydrogen or a coupling-off group, $R_{11}$ represents a halogen atom, an alkoxy group, a trifluoromethyl group or an aryl group; $R_{12}$ represents hydrogen, a halogen atom or an alkoxy group; A represents $—NHCOR_{13}$, $—NHSO_2—R_{13}$, $$—SO_2\underset{\underset{R_{14}}{|}}{N}—R_{13},$$

$—COOR_{13}$ or $—SO_2NH—R_{13}$, wherein $R_{13}$ and $R_{14}$, which may be the same or different, each represents an alkyl group, an aryl group or an acyl group; and $Y_5$ represents a coupling-off group.

15. The silver halide color photographic material claimed as in claim 14, wherein each said coupler represent by (C-I), C-II), M-I) and (Y) is present in an amount of from 0.1 to 1.0 mol per mol of silver halide in said silver halide emulsion layer.

16. The silver halide color photographic material claimed as in claim 1, wherein said support is a reflection type support.

* * * * *